US005901798A

United States Patent [19]

Herrera et al.

[11] Patent Number: 5,901,798

[45] Date of Patent: May 11, 1999

[54] DRILL PIPE TUBING AND CASING PROTECTORS

[75] Inventors: Derek Herrera; Alex Joseph Gerard Herrera; Gregory John Herrera; John Philip Corkhill, all of Aberdeen, United Kingdom

[73] Assignee: Hydril U.K. Limited, London, United Kingdom

[21] Appl. No.: 08/628,719

[22] PCT Filed: Oct. 12, 1994

[86] PCT No.: PCT/GB94/02236

§ 371 Date: Sep. 16, 1996

§ 102(e) Date: Sep. 16, 1996

[87] PCT Pub. No.: WO95/10685

PCT Pub. Date: Apr. 20, 1995

[30] Foreign Application Priority Data

Oct. 14, 1993 [GB] United Kingdom ..... 9321257

[51] Int. Cl.[6] ..... E21B 17/10

[52] U.S. Cl. ..... 175/325.3; 166/241.3

[58] Field of Search ..... 166/241.3, 241.1, 166/241.2, 241.4; 175/325.3, 325.5, 326, 325.6

[56] References Cited

U.S. PATENT DOCUMENTS

| | | | |
|---|---|---|---|
| 1,699,087 | 1/1929 | Woodmansee et al. | 166/241.3 |
| 1,737,578 | 12/1929 | Fentress | 175/325.3 |
| 1,756,195 | 4/1930 | Holdaway | 175/325.3 |
| 1,764,488 | 6/1930 | Zublin | 175/325.3 |
| 1,801,294 | 4/1931 | Sutton | 166/241.3 |
| 1,824,257 | 9/1931 | Bull | 175/325.3 |
| 1,877,395 | 9/1932 | Goeser | 175/325.3 |
| 2,127,796 | 8/1938 | Willis | 166/241.3 |
| 2,248,160 | 7/1941 | Crawford | 175/325.3 |
| 2,308,316 | 1/1943 | Smith et al. . | |
| 2,318,878 | 5/1943 | Miller . | |
| 2,368,415 | 1/1945 | Grant . | |
| 2,715,552 | 8/1955 | Lane . | |
| 2,793,917 | 5/1957 | Ward . | |
| 2,860,013 | 11/1958 | Medearis . | |
| 2,943,009 | 6/1960 | Mirsky et al. . | |
| 3,063,759 | 11/1962 | Moore et al. . | |
| 3,088,532 | 5/1963 | Kellner . | |

(List continued on next page.)

FOREIGN PATENT DOCUMENTS

| | | |
|---|---|---|
| 140311 | 5/1985 | European Pat. Off. . |
| 307212 | 3/1920 | United Kingdom . |
| 271839 | 3/1928 | United Kingdom . |
| 1157044 | 7/1969 | United Kingdom . |
| 1173202 | 12/1969 | United Kingdom . |
| 2048340 | 12/1980 | United Kingdom . |
| 2253428 | 9/1992 | United Kingdom . |
| 2275284 | 8/1994 | United Kingdom . |
| 91/00411 | 1/1991 | WIPO . |

*Primary Examiner*—Frank Tsay
*Attorney, Agent, or Firm*—Rosenthal & Osha LLP

[57] ABSTRACT

A drill pipe protector comprises an annular body (820) adapted to surround a drill pipe (824) in a borehole to protect the drill pipe and borehole (or borehole casing) against damage caused by contact between the two, such that the drill pipe may rotate freely within the annular body upon contact between the body and the borehole (or borehole casing), so as to reduce the torque and drag produced by such contact. The assembly may further include annular clamps (822) secured to the drill pipe (824) to restrict the longitudinal movement of the body along the pipe. Various features of such assemblies are disclosed including features of the shape and configuration of the annular body and clamps, the use of bearing members on the internal and external surfaces of the annular body and between the body and the clamps or drill pipe joints, and materials for use in the fabrication of the body and bearings. These are particularly concerned with optimising the bearing arrangements to promote thin film lubrication and to employ sacrificial self-lubrication when such thin film lubrication breaks down, configuring the assembly to promote fluid flow around and through the assembly and the avoidance of snagging of the assembly on downhole obstructions.

21 Claims, 47 Drawing Sheets

U.S. PATENT DOCUMENTS

| | | | |
|---|---|---|---|
| 3,282,345 | 11/1966 | Tripplehorn . | |
| 3,320,004 | 5/1967 | Garrett . | |
| 3,343,890 | 9/1967 | Homer . | |
| 3,370,894 | 2/1968 | Pourchot . | |
| 3,397,017 | 8/1968 | Grant et al. . | |
| 3,410,613 | 11/1968 | Kuus . | |
| 3,528,499 | 9/1970 | Collett . | |
| 3,948,575 | 4/1976 | Rosser . | |
| 3,999,811 | 12/1976 | Gray . | |
| 4,071,101 | 1/1978 | Ford . | |
| 4,083,612 | 4/1978 | Olson . | |
| 4,102,552 | 7/1978 | Kellner . | |
| 4,372,622 | 2/1983 | Cheek . | |
| 4,606,417 | 8/1986 | Webb et al. | 175/325.3 X |
| 4,757,861 | 7/1988 | Klyne | 166/241.3 |
| 4,796,670 | 1/1989 | Russell et al. | 138/110 |
| 4,820,140 | 4/1989 | Bishop . | |
| 4,858,688 | 8/1989 | Edwards et al. . | |
| 5,069,297 | 12/1991 | Krueger et al. . | |

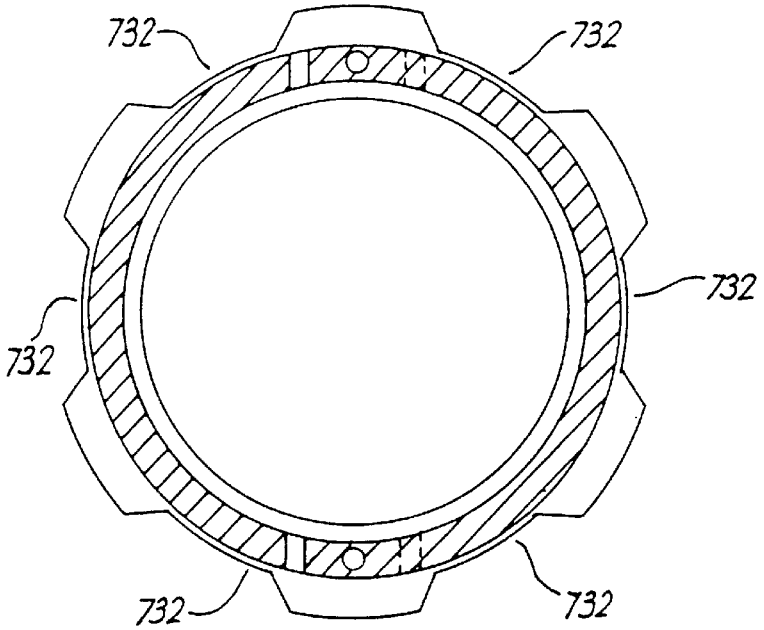
FIG. 19a
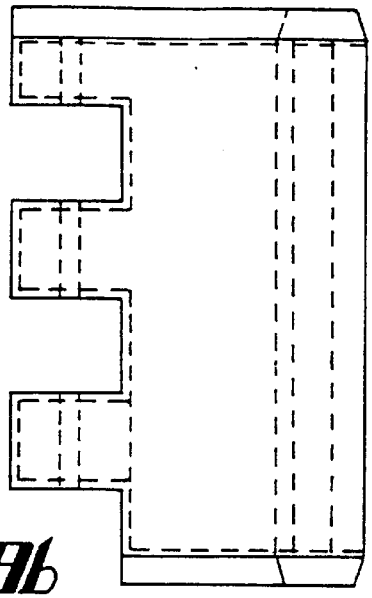
FIG. 19b
FIG. 19c
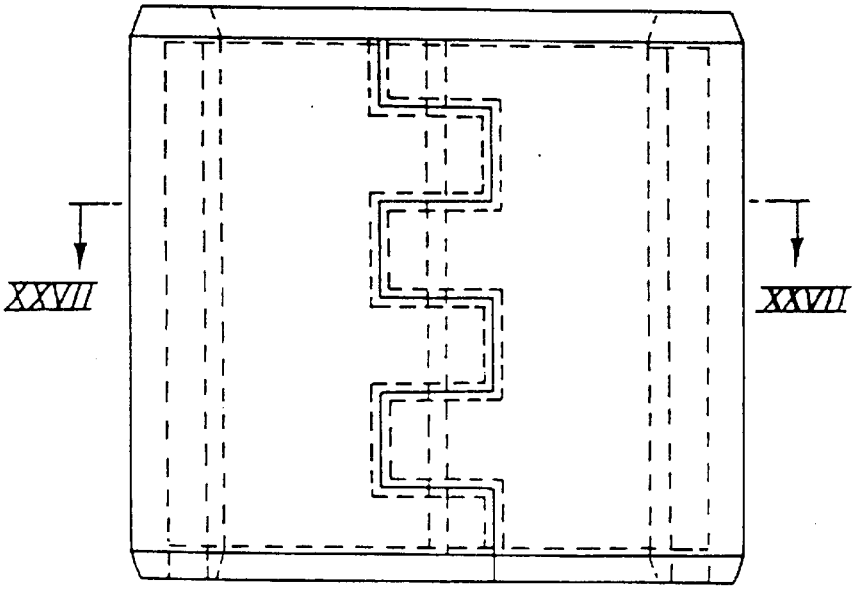

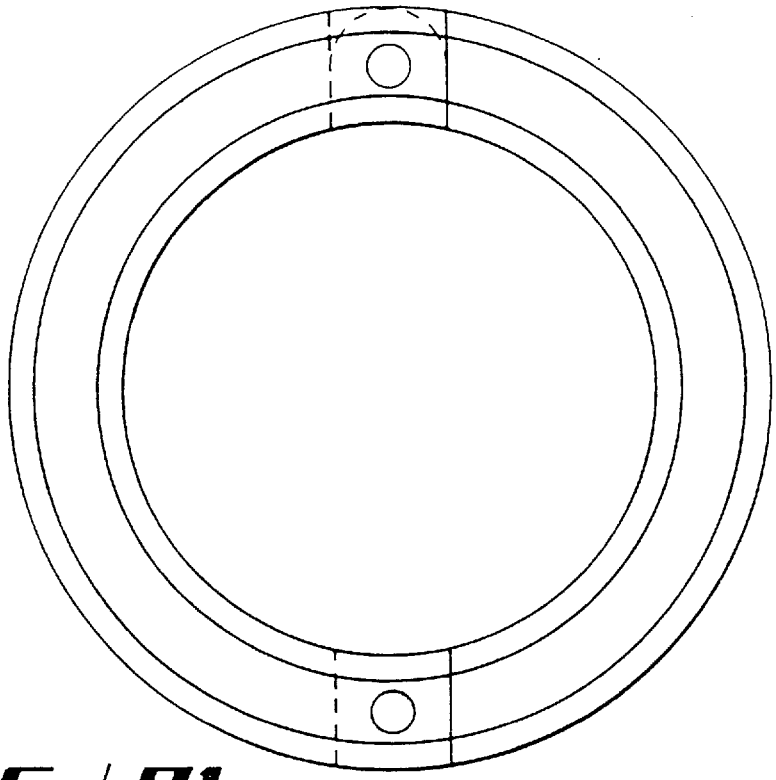
FIG. 21a
FIG. 21b
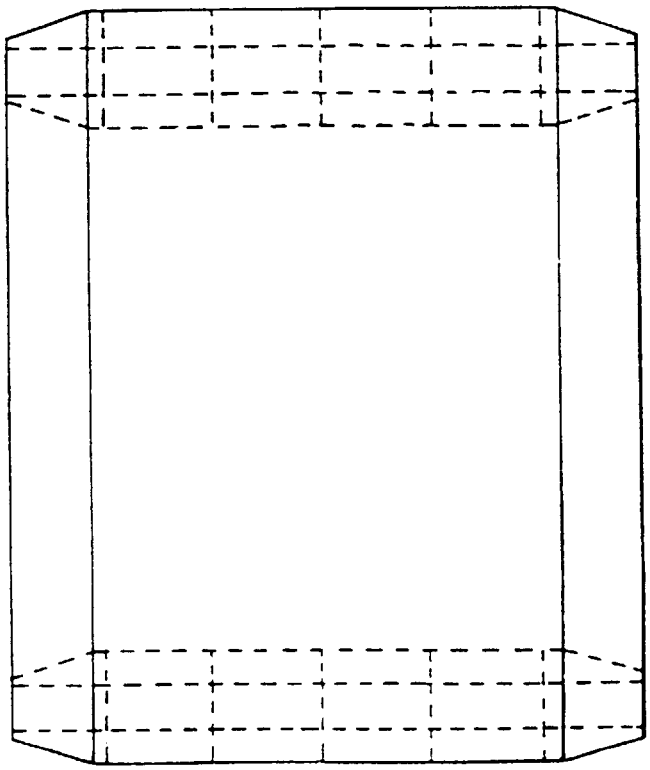

FIG. 24a
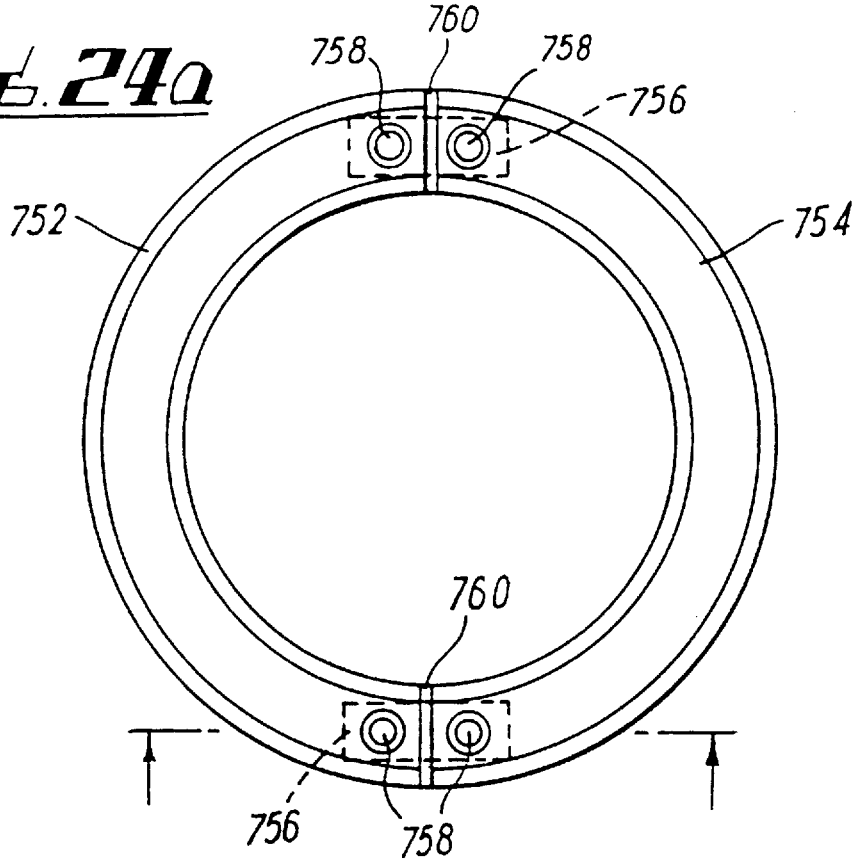
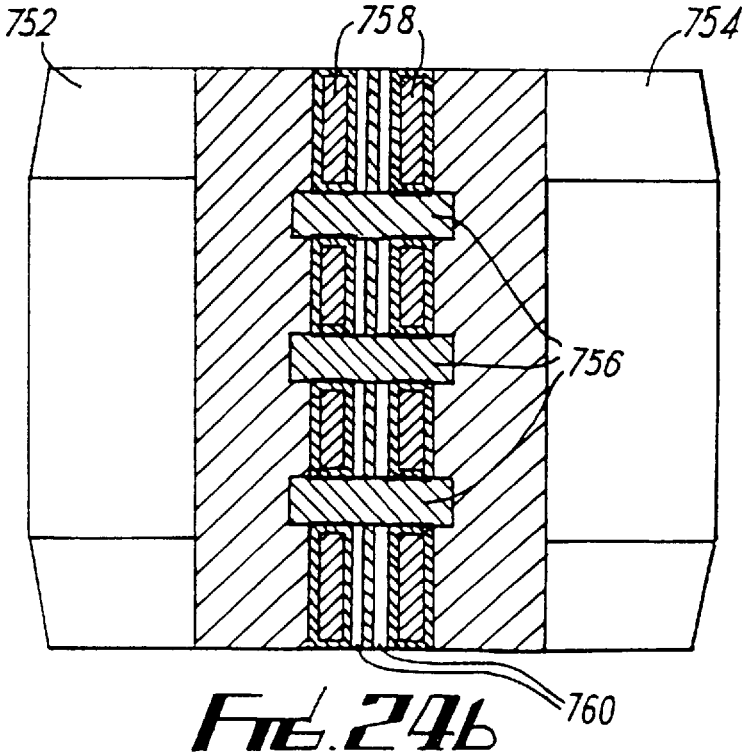
FIG. 24b

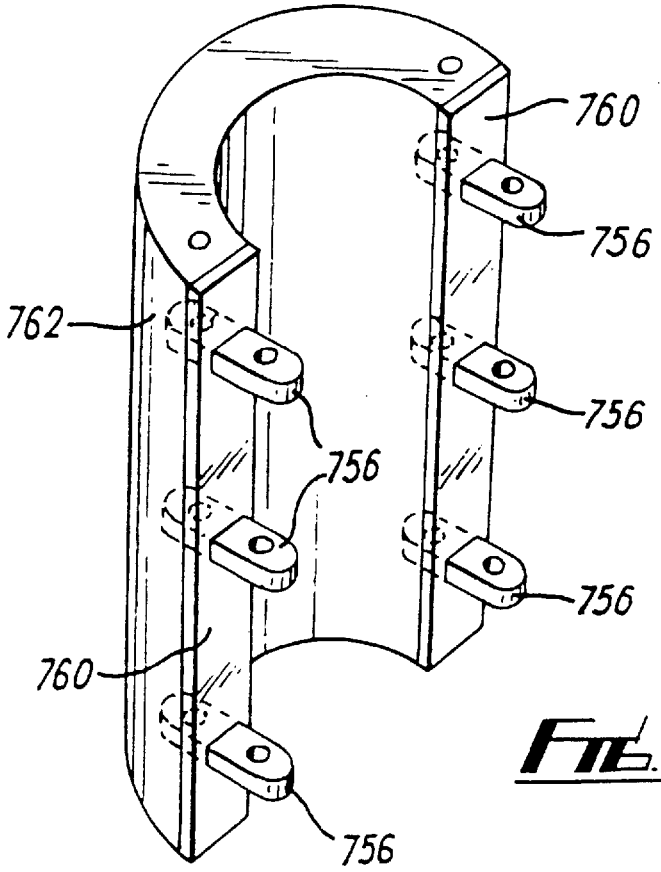
FIG. 25
FIG. 28a
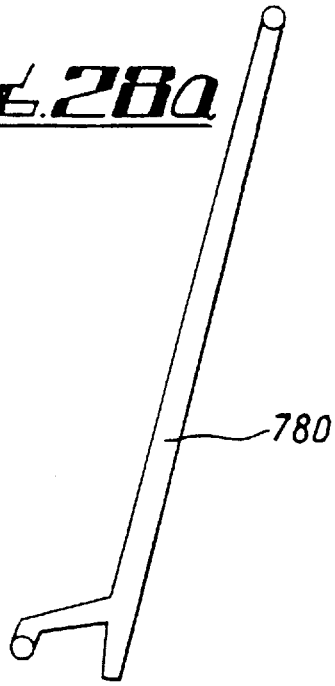
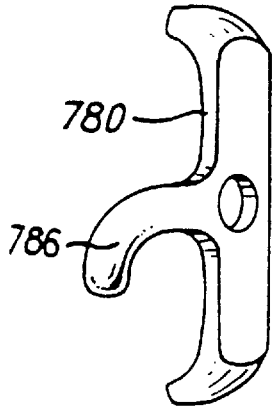
FIG. 28b

FIG. 30a
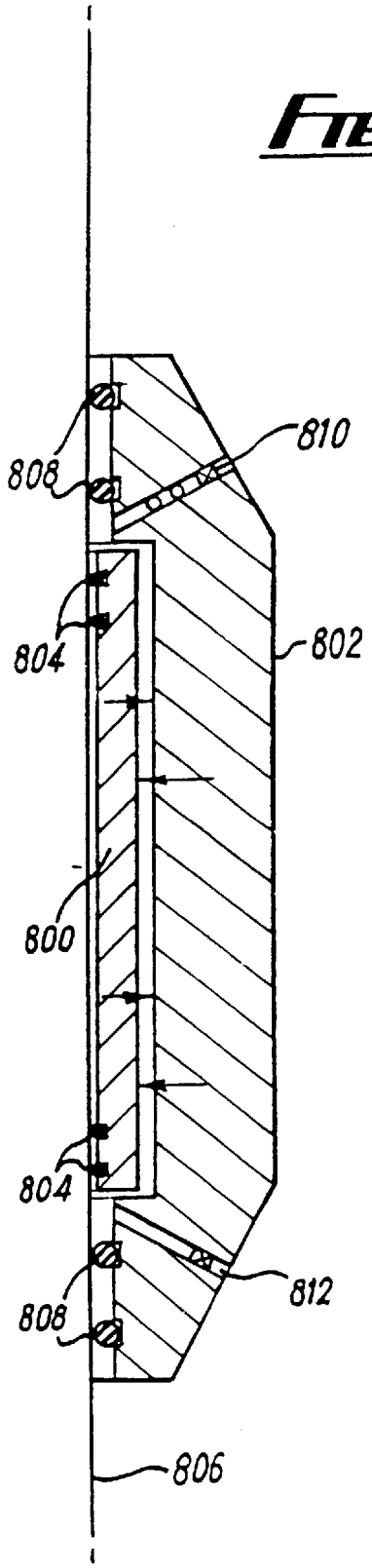
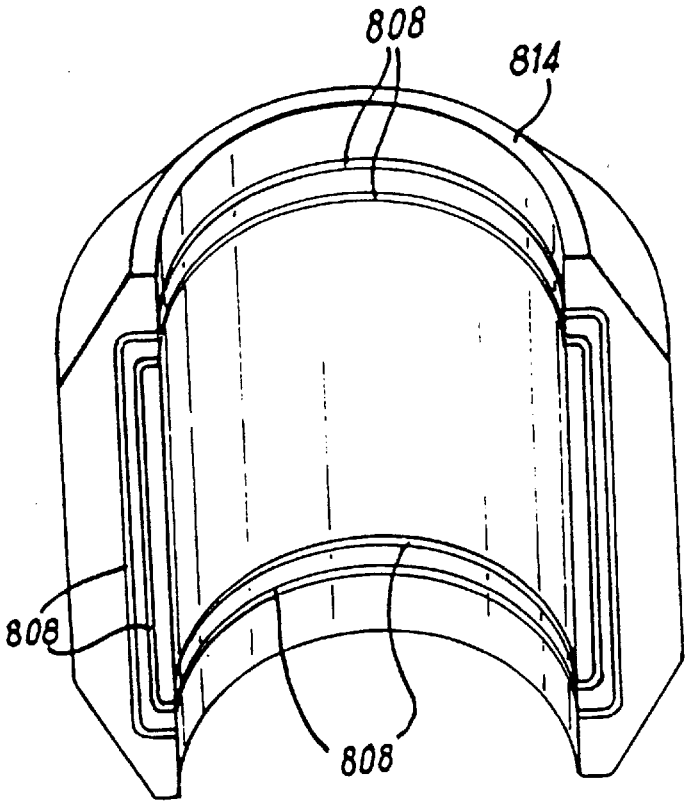
FIG. 30b

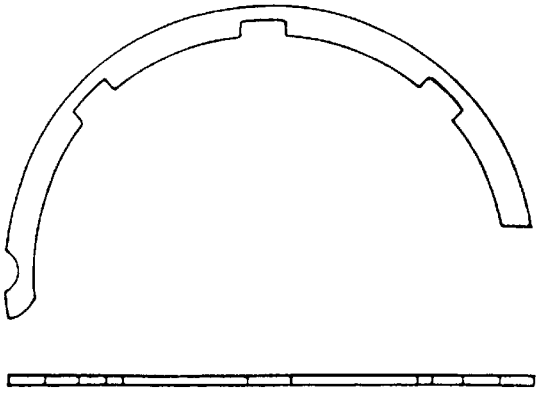
FIG. 35d
FIG. 35a
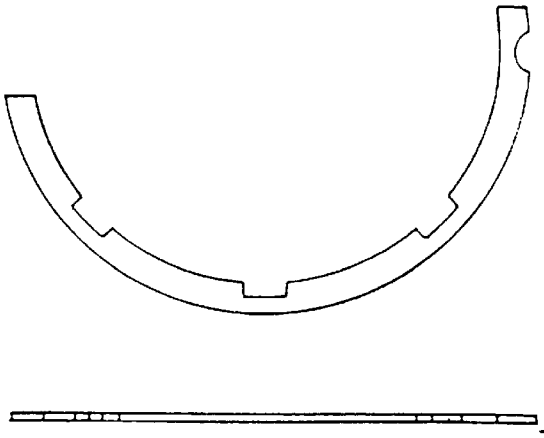
FIG. 35e
FIG. 35b
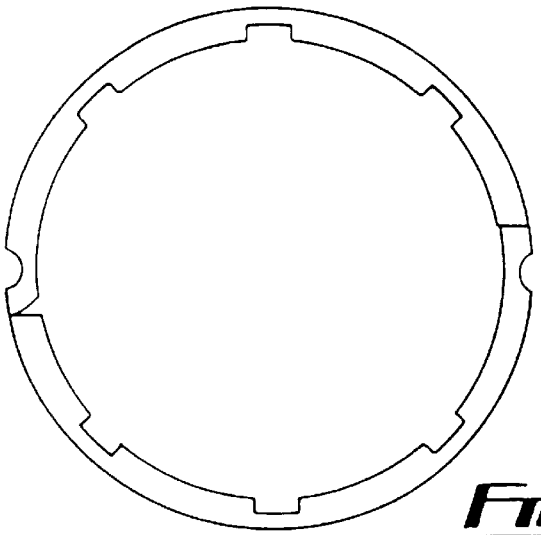
FIG. 35c 866
868

866
868

868
870
866

866
868

868
866

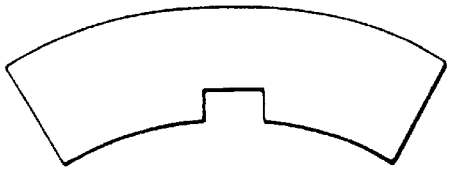
FIG. 40a
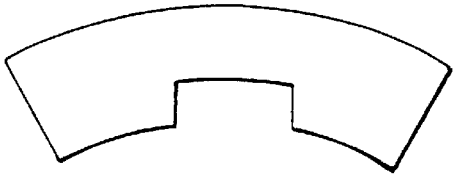
FIG. 40b
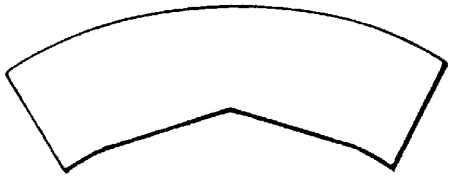
FIG. 40c
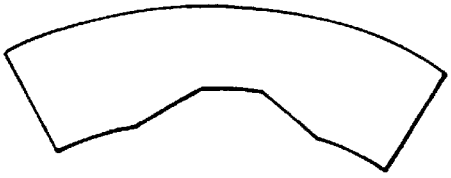
FIG. 40d
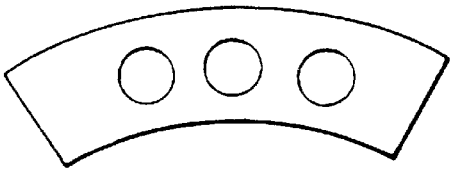
FIG. 40e
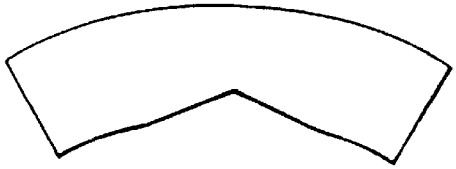
FIG. 40f
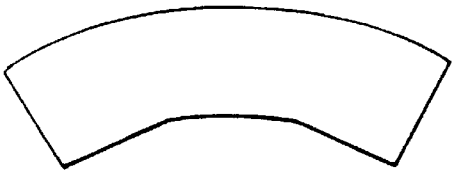
FIG. 40g
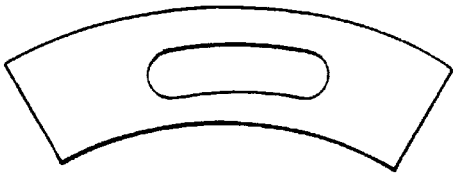
FIG. 40h
FIG. 40i
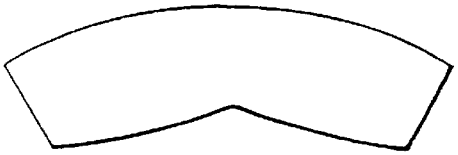
FIG. 40j
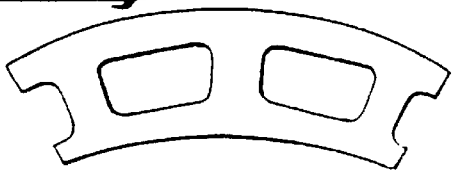

DRILL PIPE TUBING AND CASING PROTECTORS

This invention relates to protectors, and relates more particularly to protectors for pipe strings movable within the bore of a well (for example, a hydrocarbon well).

Protectors of this general type are described in published UK Patent GB 2204895-B (U.S. Pat. No. 4907661), the specification of which discusses the desirability of protectors for the protection of pipe strings in well bores, and for the protection of casings which may line such wells. FIGS. 1 and 2 of the present application illustrate the general usage of protectors of this type.

The protector 1 comprises a generally annular body which surrounds the drill pipe 2 and is free to rotate with respect thereto. The outer diameter of the protector 1 is greater than the maximum outer diameter of the pin and box portions 3 and 4 of the length of drill pipe 2, and less than the inside diameter of the well bore 5 or casing 6 (if present). The protector 1 serves to prevent the string of drill pipe 2 coming into contact with the bore 5 or casing 6, and is constructed so as to provide a relatively low coefficient of friction between the drill pipe 2 and its own inner surface and also between the outer surface of the protector and the bore or casing. A number of protectors can be fitted to the pipe string as required, with one or more protectors on individual pipe sections.

In the event that the protector 1 contacts the surface of the bore/casing, the drill pipe 2 may still rotate freely within the protector 1. This minimises the increases in torque or drag which would otherwise be caused by contact between the pipe string and the bore/casing, reduces the likelihood of damage being caused to either the pipe or casing thereby, and allows drilling parameters such as the weight-on-bit to be controlled more effectively so as to improve the rate of penetration.

FIG. 1 shows a simple installation of a protector 1 on the drill pipe 2. In this case the protector is free to move longitudinally between the upper and lower ends of the pipe 2. Alternatively, as shown in FIG. 2, annular retaining clamps 7 may be applied to the pipe 2 above and below the protector 1 to restrict its range of longitudinal movement. The clamps 7 may be positioned so as to locate the protector 1 at a fixed position, or may be more widely spaced to allow longitudinal movement over a predetermined length of the pipe 2.

The present invention provides various improvements over the protectors and clamps of the type described in GB 2204895-B. The improvements provided by the various aspects of the invention arise from the shape and configuration of the protector and associated clamps, the use of separate bearing elements in various arrangements and the selection of materials. These various factors may be combined in various ways to provide protector assemblies which are robust, resistant to snagging on obstacles and which minimise torque and drag in use.

As noted above, the protector must firstly allow low-friction rotation of the pipe with respect thereto, and must also perform the function of spacing the pipe string from the bore/casing. Accordingly, the device must provide the required low-friction characteristics and must be capable of bearing the mechanical loads encountered in use. It must also be able to withstand the temperatures, pressures and hostile chemical conditions of a downhole environment.

As used hereinafter, references to the "bore" of a well are to be taken as including references to a casing lining a bore, and vice versa, as appropriate.

The protector as disclosed in GB-2204895-B is formed, essentially, from a single material, which must satisfy all of the requirements noted above.

In accordance with the present invention, there is provided a protector assembly for a pipe string movable within the bore of a well, said protector assembly comprising a generally annular body internally dimensioned to fit around said pipe string and externally dimensioned to fit within said bore, said body being formed from a first material or materials, and further comprising bearing means interposed, in use, between said annular body and said pipe string so as to permit free rotation of said pipe string relative to said annular body in the event of said annular body contacting the surface of said bore.

In certain embodiments said bearing means comprises at least one bearing element formed separately from said annular body.

In other embodiments, said bearing means is provided by an inner surface of said annular body extending around said drill pipe.

In still other embodiments said bearing means is provided by a coating of material applied at least to an inner surface of said annular body extending around said drill pipe.

Preferably, the bearing means is formed separately from the annular body and comprises at least one bearing element formed from a second material or materials.

In certain embodiments of the invention, said at least one bearing element is secured to the inner surface of said annular body. In other embodiments, said at least one bearing element is secured, in use, to the outer surface of said pipe string. In still other embodiments of the invention, said at least one bearing element is interposed, in use, between said annular body and said pipe string and is rotatable with respect to both. In the latter case, the bearing element may be constrained by retaining means for longitudinal movement with said annular body.

Where the bearing element is secured to either the annular body or the pipe string, the element may be substantially cylindrical or may comprise a plurality of separate elements located on the surfaces thereof.

Where the bearing element is rotatable with respect to the annular body and the pipe string, the element is preferably substantially cylindrical, and may further be provided with annular flanges at either longitudinal end thereof, said flanges overlying the longitudinal ends of said annular body, in use.

In an alternative embodiment, the protector assembly includes fluid bearing means, a cylindrical inner sleeve being provided on the drill pipe with first sealing means providing a fluid seal thereto, said inner sleeve being enclosed by the annular protector body and second sealing means providing a fluid seal between the ends of the annular body, above and below the inner sleeve, and the drill pipe so defining a sealed volume between the interior of the annular body and the exterior surface of the inner sleeve, said fluid bearing means being provided by lubricating fluid introduced into said sealed volume.

Optionally, the annular body may include second bearing means on the external surface thereof subject to contact with the surface of said bore. Said second bearing means may comprise, for example, an outer covering for said annular body or a band surrounding said annular body.

In certain embodiments of the invention, the assembly further includes first and second substantially annular clamp means, adapted to be secured to said pipe string on either side of said annular body so as to restrict longitudinal movement of the annular body along the pipe string, in use. Where applicable, the clamp means may serve to secure said at least one bearing element to the pipe string.

Where said clamp means are employed, the annular body and/or the clamp means may be provided with bearing means on the annular end surfaces thereof which are subject to contact with one another in use. The external surfaces of the clamps may also be provided with external bearing means similar to the second bearing means of the annular body.

Preferably also, the clamp means are adapted to grip the drill pipe by means of grooves or serrations on their inner, pipe-contacting surfaces. Alternatively or additionally, the grip of the clamp may be enhanced by means of coating the inside diameter of the clamp with a high temperature epoxy resin, or the like, having an abrasive aggregate added thereto prior to drying, thereby forming a high friction interface between the clamp and the drill pipe and preventing electron flow between dissimilar metals.

Said annular body is preferably formed of metal or from plastic or from elastomeric material.

The bearing means are preferably formed from plastic or elastomeric materials or from metal.

The materials from which the annular body and bearing means are formed are preferably selected from the following:

metals including: aluminium and aluminium alloys; steel and steel alloys; copper alloys including gun metal, aluminium bronze, phosphor bronze, cupro-nickel; zinc alloys; such metals may be provided with coatings including polytetrafluoroethylene (PTFE), electroless nickel, zinc and paints, rubber and rubber compounds;

plastics and elastomers, including: carbon reinforced polyetheretherketone; polyphthalamide; polyvinylidene fluoride; rubber compounds; phenolic resins or compounds; thermosetting plastics; thermoplastic elastomers; thermoplastic compounds; thermoplastics including polyetheretherketone, polyphenylenesulfide, polyphthalamide, polyetherimide, polysulphone, polyethersulphone, all polyimides, all polyamides (including nylon compounds), polybutyleneterephthalate, polyetherketoneketone; and filler materials for use with the above mentioned metals and plastics, including: glass, carbon, PTFE, silicon, teflon, molybdenum disulphide, graphite, oil and wax.

It is particularly preferred that the materials used for bearing surfaces, either of the annular body or of any bearing elements associated therewith, are of a type which are capable of acting as sacrificial, self-lubricating materials, or are combined with filler materials which are capable of acting in such a manner or which allow the annular body or bearing elements to act in such a manner.

The annular body and the clamp means, where used, are preferably shaped so as to minimise the risk of snagging within the well bore, the longitudinal ends thereof being bevelled or curved.

It is further preferred that the annular body and clamp means, where used, are configured to promote smooth fluid flow around and/or through the assembly. It is particularly preferred that bearing surfaces between the protector body and drill pipe be configured to promote thin film lubrication upon relative rotation thereof.

Preferably also, the inner surface of the annular body may be provided with longitudinally extending grooves or flutes (including helical or the like longitudinally extending grooves or flutes) whereby drilling fluid may circulate to provide a thin film lubrication/hydrodynamic bearing effect and also to act as a coolant. Additionally or alternatively, the outer surface of the bearing means may be similarly grooved or fluted. Where the bearing means is intended to be rotatable with respect to the drill pipe, the inner surface thereof may be similarly grooved or fluted.

Preferably also, the external surface of the annular body may also be grooved or fluted to facilitate fluid passage. Alternatively or additionally, the internal and/or external surfaces of the retaining clamps, where used, may be similarly grooved or fluted. Alternatively or additionally, the annular body and/or clamps may be provided with longitudinally extending fluid passage bores extending therethrough.

According to further aspects, the present invention provides a number of alternative constructions for forming the annular protector body and/or the annular retaining clamps, where used, in which the protector body or clamps are each formed from two hemi-annular sections each having first and second mating end surfaces which are secured together around the drill pipe, in use, by one of the following arrangements or by combinations thereof:

At least one pair of mating surfaces may be connected by means of complementary castellations and a pin, screw or bolt inserted into a longitudinal bore extending through the castellations. Said castellations may be configured to provide a hinge arrangement. Both pairs of mating surfaces may be castellated. The number of castellations may vary.

At least one pair of mating surfaces may be connected by means of plate members located in recesses formed in the mating surfaces and pins, screws or bolts inserted into longitudinal bores extending through the recesses in each section and through the ends of the plate members located therein. Said recesses and plate members may be configured to provide a hinge arrangement. Both pairs of mating faces may be connected by such recesses and plate members. The number of recesses and plate members may vary.

At least one pair of mating faces may be connected by means of screws or bolts located in transverse bores extending through said mating faces. Preferably, the other pair of mating faces are hinged together by means of one of the hinge arrangements defined above. The number of screws or bolts may vary.

At least one pair of mating faces may be connected together by means of a clip member engaging recesses formed on the external surfaces of the hemi-annular sections adjacent said mating faces. Preferably, the other pair of mating faces are hinged together by means of one of the hinge arrangements defined above. The number of clip members applied may vary.

Embodiments of the invention will now be described by way of example, with reference to the accompanying drawings wherein:

FIGS. 15 to 21 show various constructions of protectors in accordance with the invention, which are applicable to several of the embodiments of FIGS. 1 to 13 and also to annular clamps, as follow:

Figure 18A:
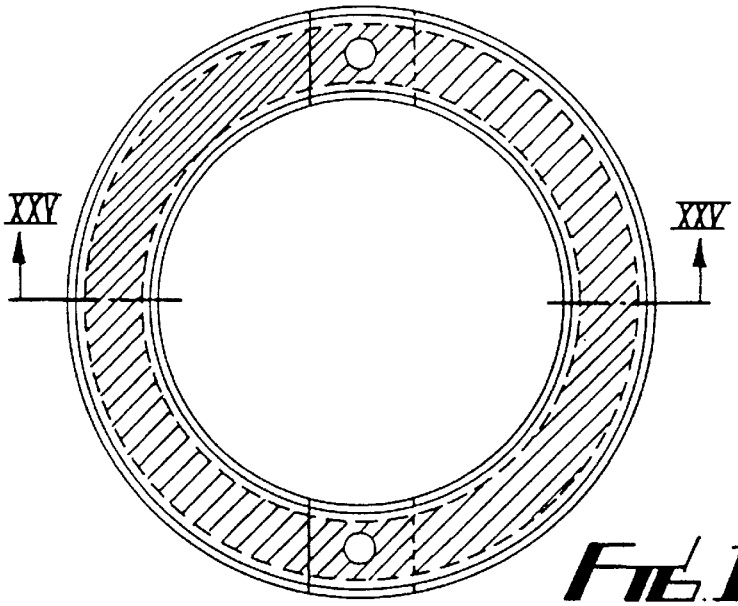
Figure 18B:
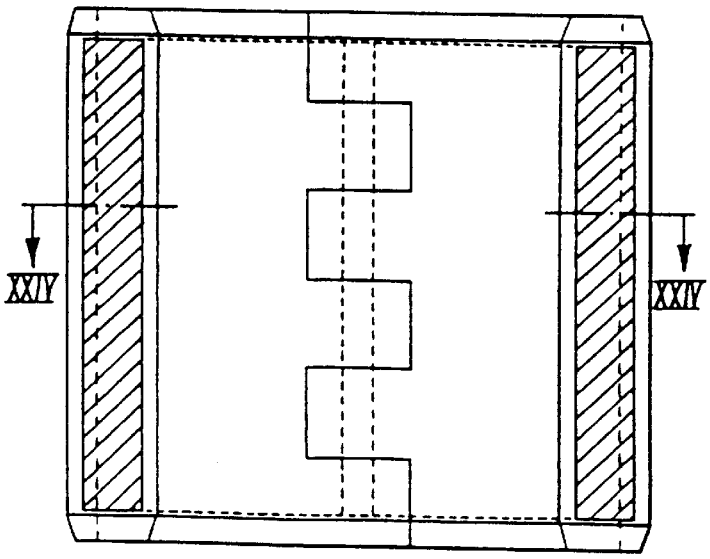
Figure 18C:
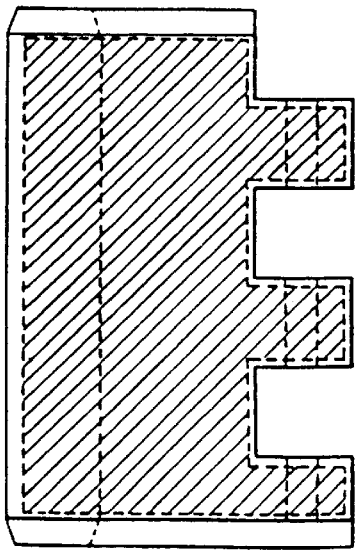
Figure 20A:
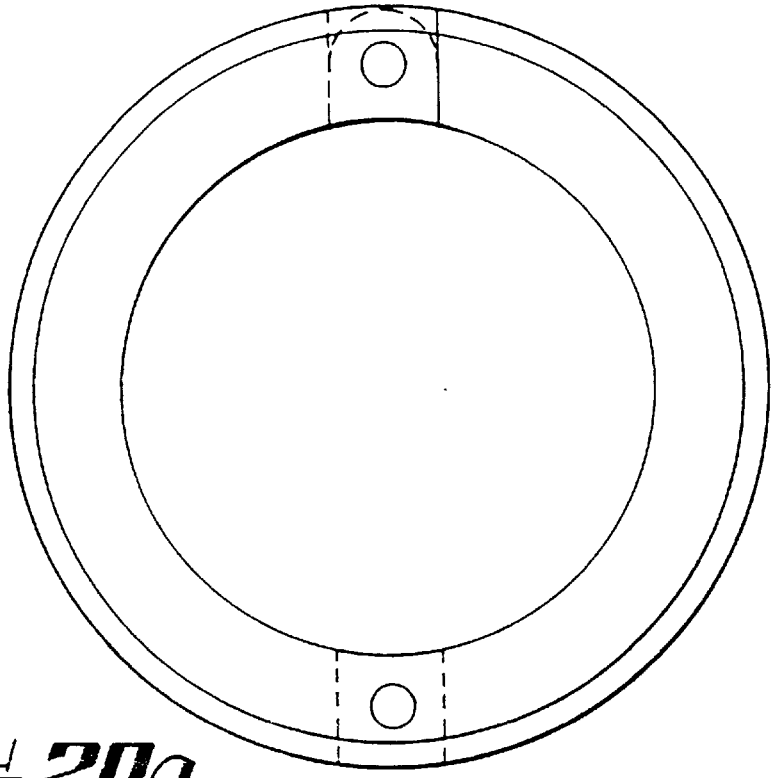
Figure 20B:
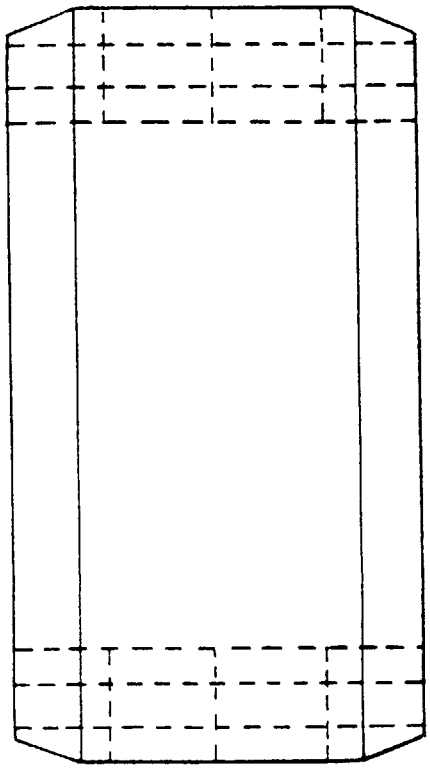
Figure 22A:
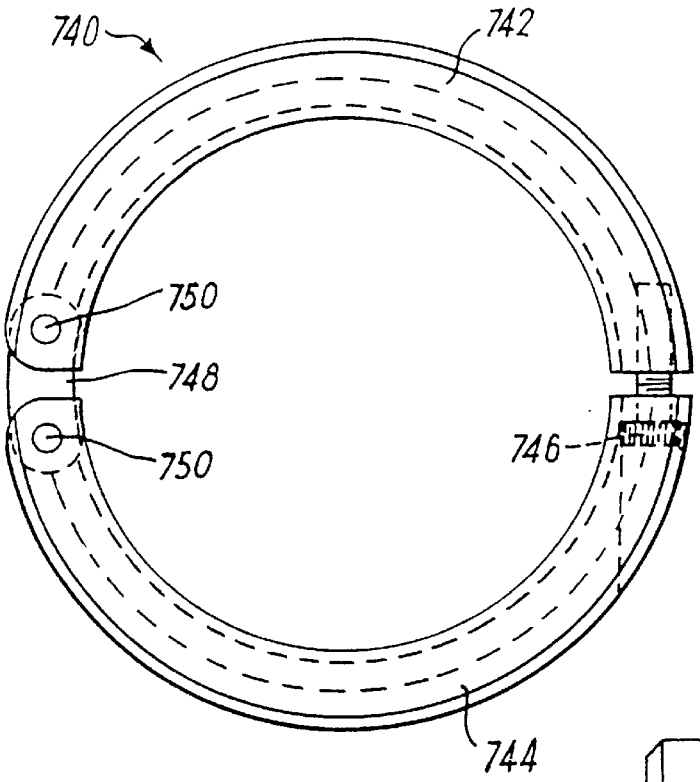
Figure 22B:
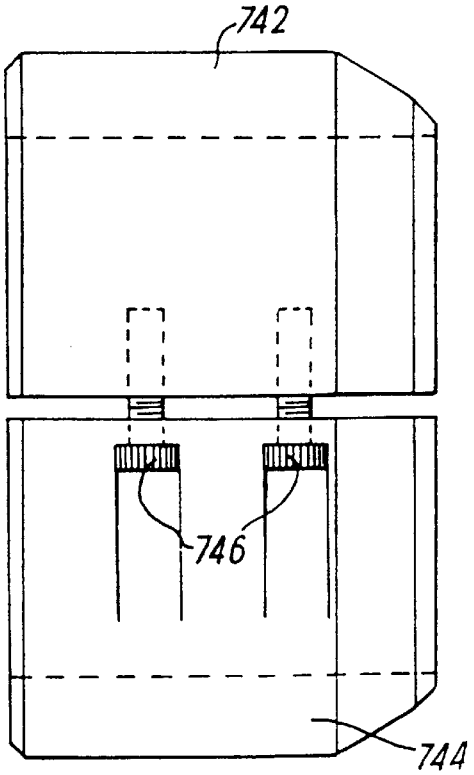
Figure 22C:
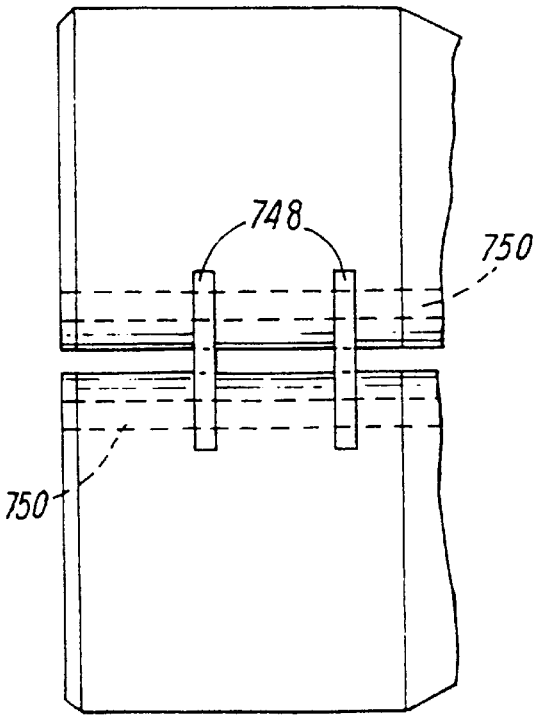
Figure 23A:
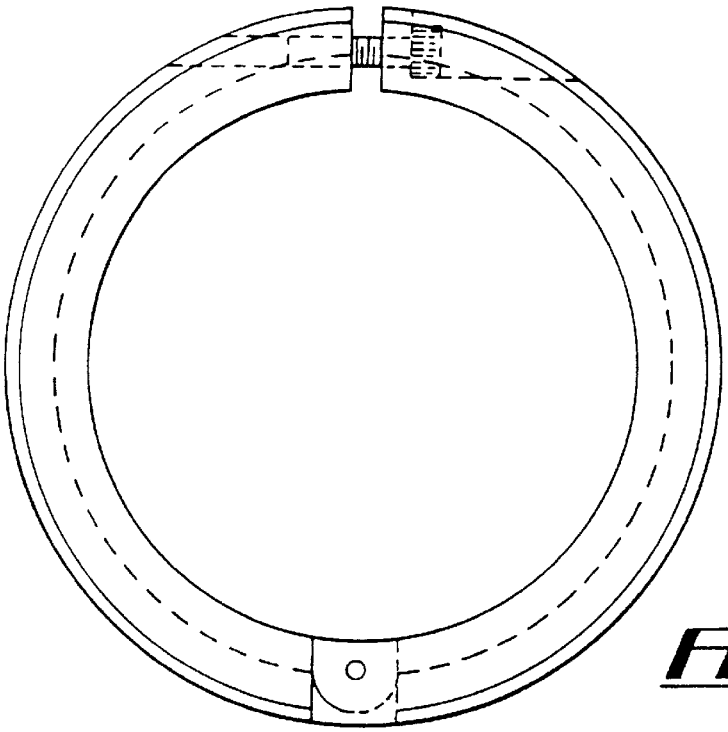
Figure 23B:
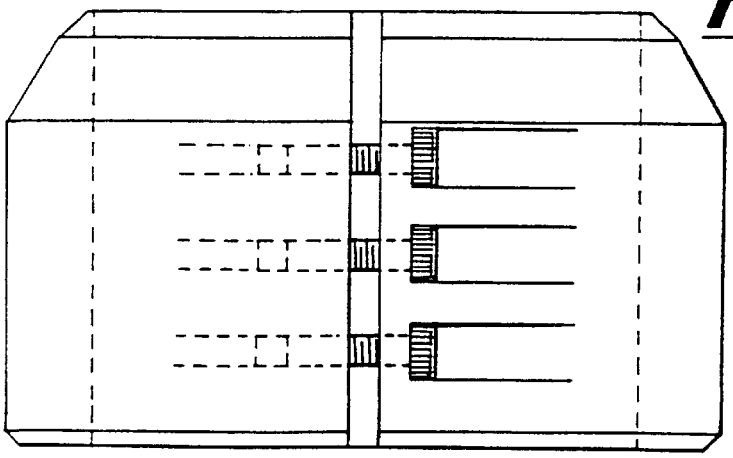
Figure 23C:
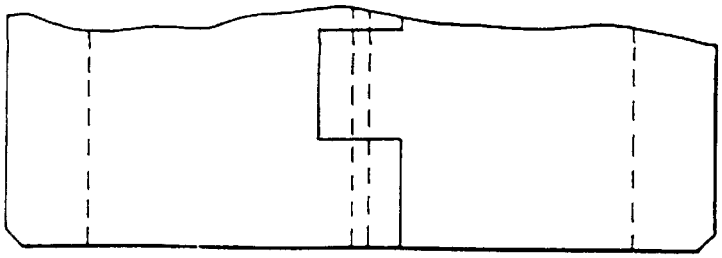
Figure 26A:
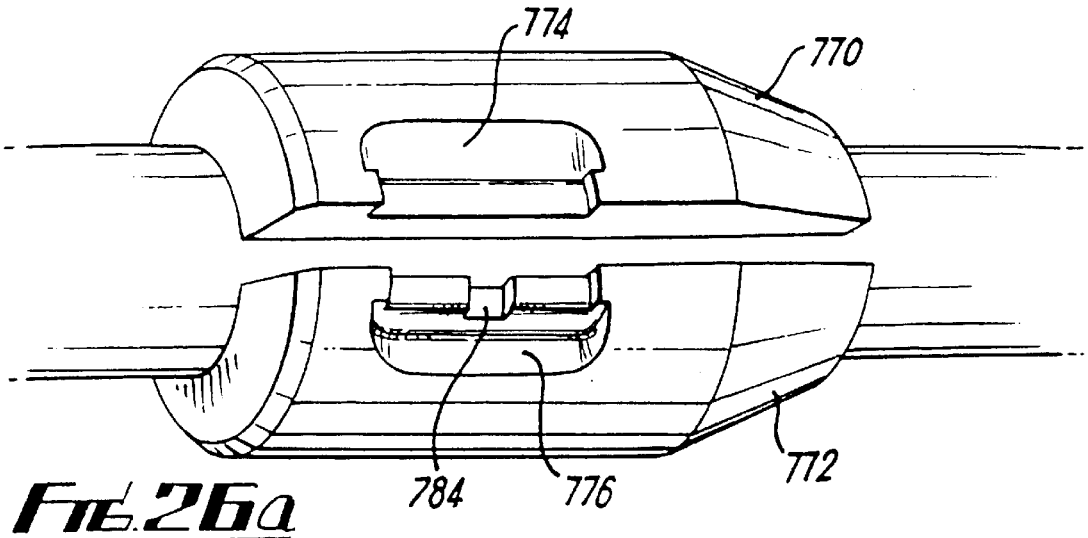
Figure 26B:
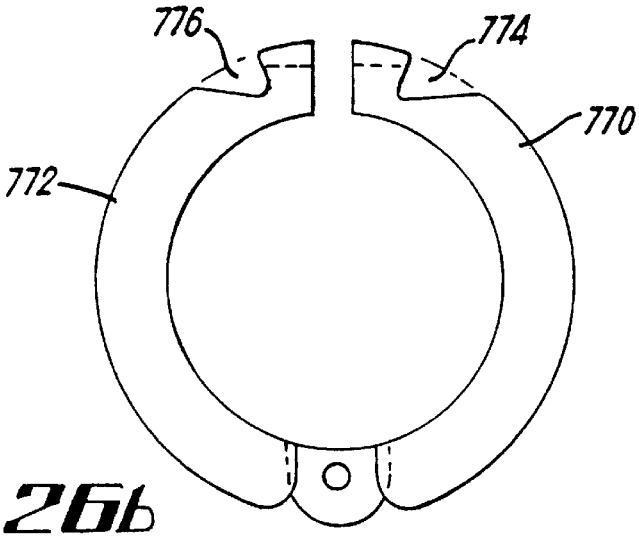
Figure 27:
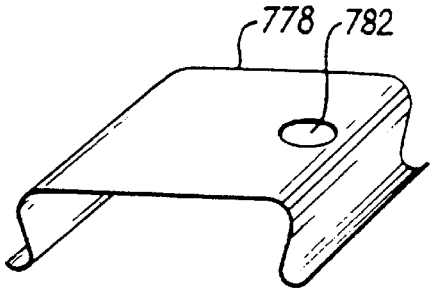
Figure 26C:
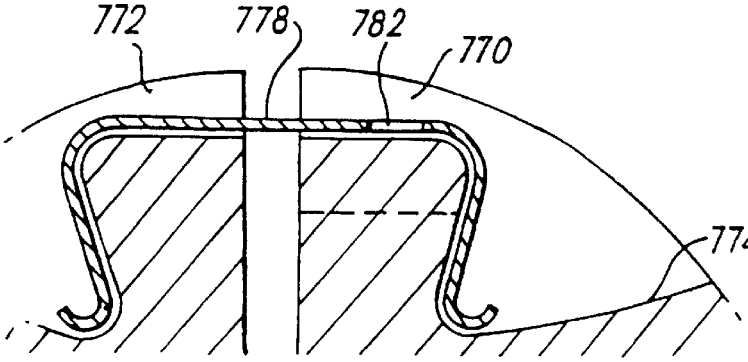
Figure 29:
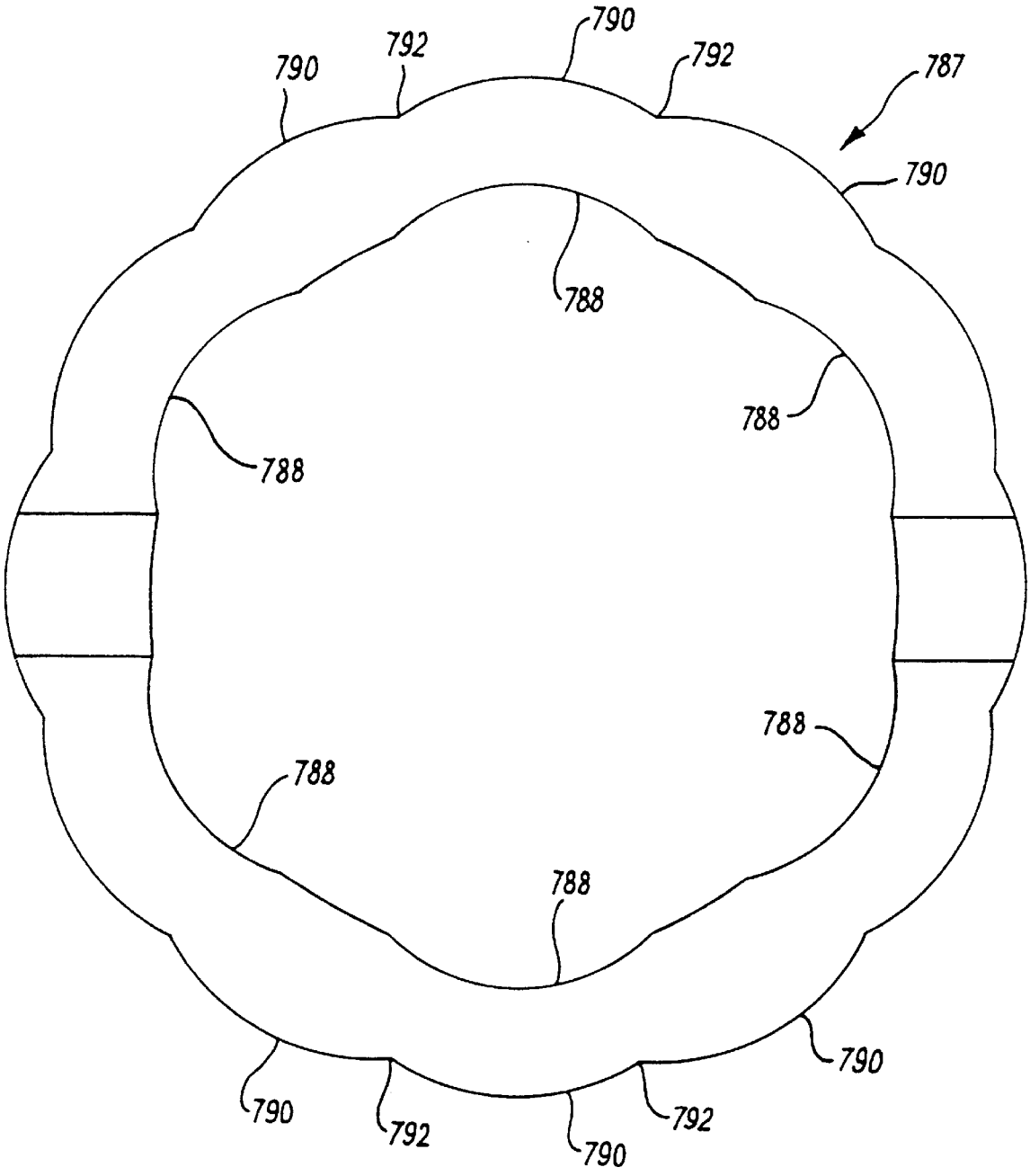
Figure 31A:
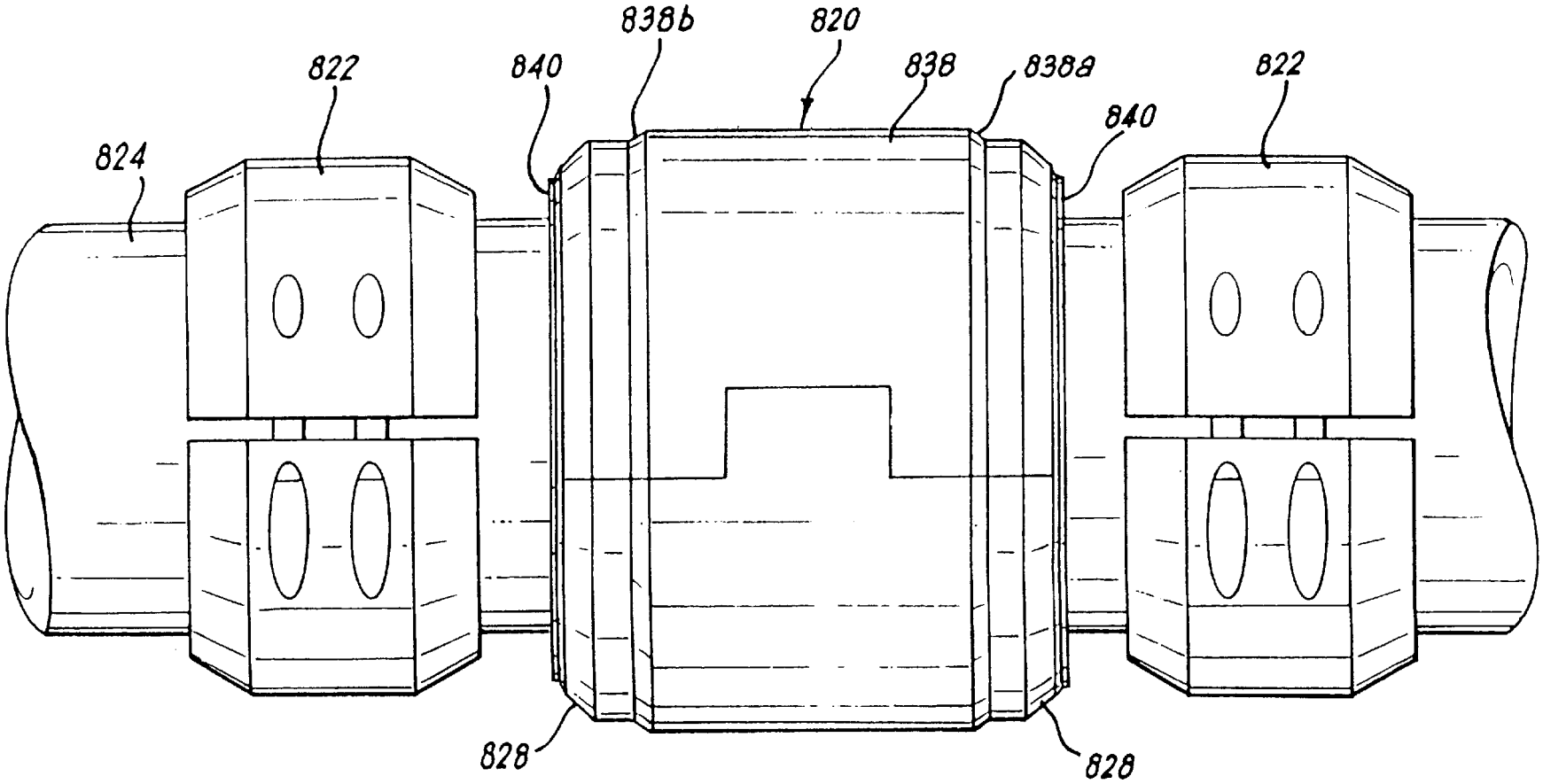
Figure 31B:
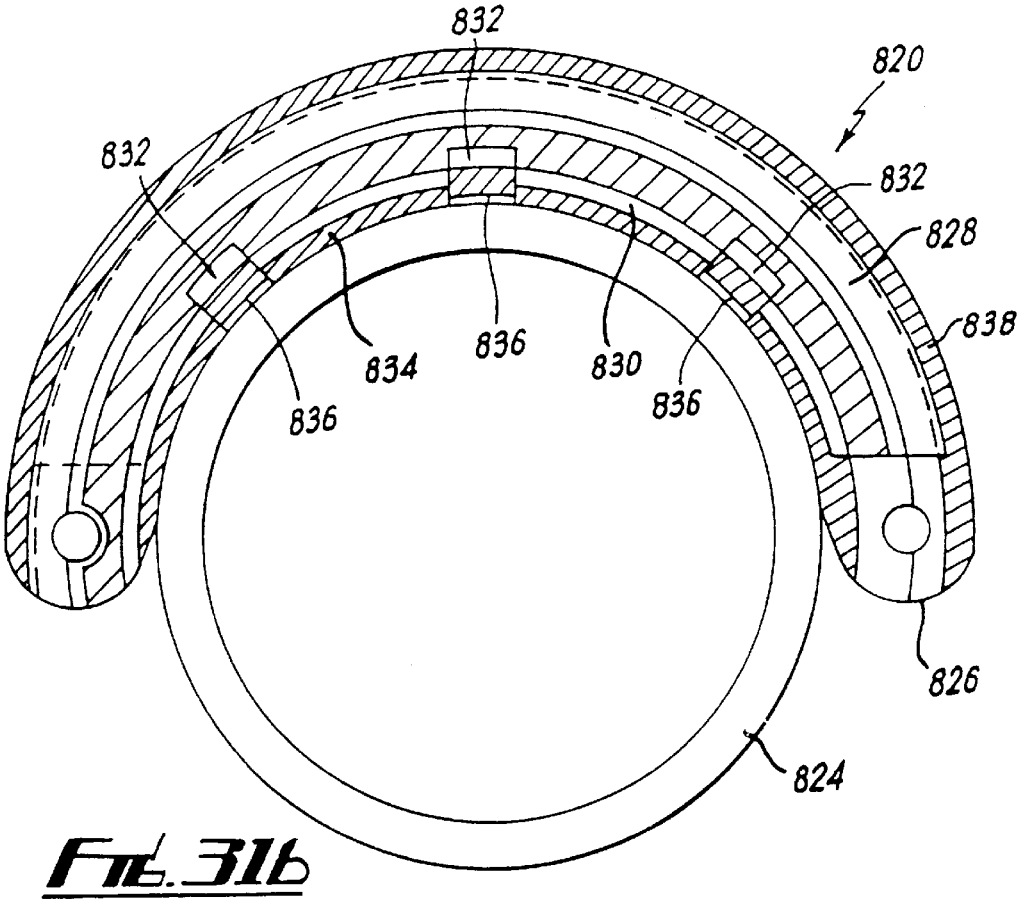
Figure 31C:
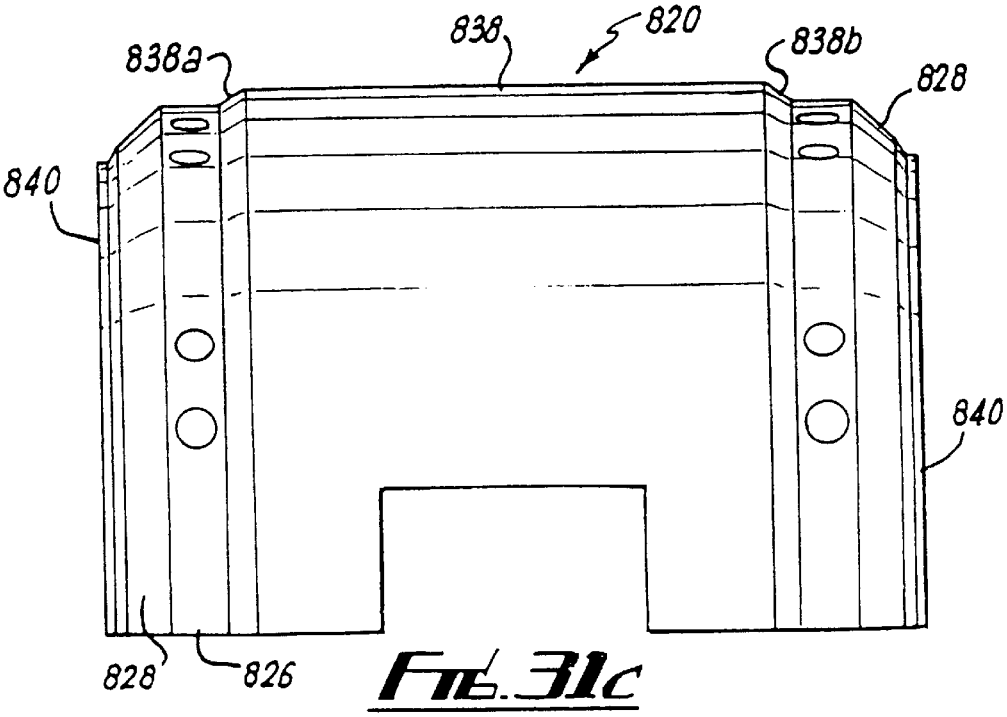
Figure 31D:
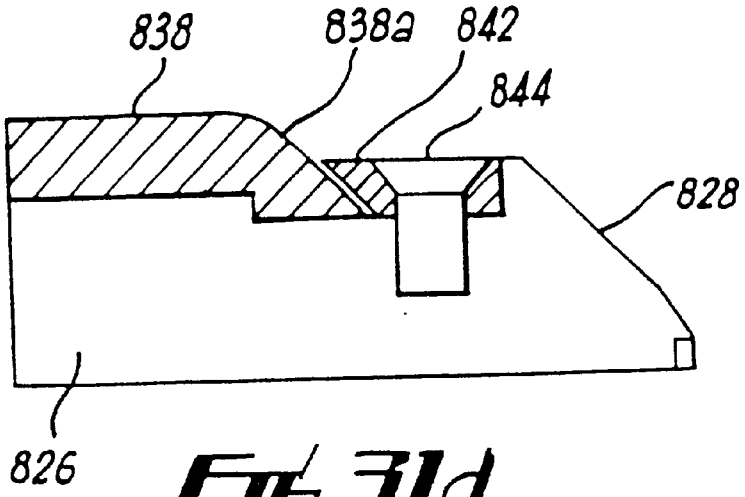

FIGS. 15 (*a*), (*b*), (*c*), (*d*) and (*e*) are, respectively, a plan view, a side view and a side view in partial section of a first protector construction, and a plan view and a perspective view of one of two components comprising said construction;

FIGS. 16 (*a*), (*b*), (*c*), (*d*), (*e*) and (*f*) are, respectively, a plan view and an elevational view of a second construction of a protector in accordance with the present invention, an elevational view of one component and an elevational view of another component, of the second construction and fragmentary views, to an enlarged scale, of parts of the components illustrated in FIGS. 16 (*c*) and (*d*);

FIGS. 17 (*a*), (*b*), (*c*), (*d*), (*e*) and (*f*) are, respectively, a plan view and an elevational view of a third construction of a protector in accordance with the present invention, an elevational view of one component and an elevational view of another component, of the third construction and fragmentary views, to an enlarged scale, of parts of the components illustrated in FIGS. 17 (*c*) and (*d*);

FIG. 18(*a*) is a sectional plan view, taken on the line XXIV—XXIV in FIG. 18(*b*), of a fourth construction of protector in accordance with the present invention;

FIG. 18(*b*) is a sectional elevation, taken on the line XXV—XXV in FIG. 18(*a*), of the fourth construction;

FIG. 18(*c*) is an elevational view of one component of the fourth construction;

FIG. 19(*a*) is a sectional plan view, taken on the line XXVII—XXVII in FIG. 19(*b*), of a fifth construction of protector in accordance with the present invention;

FIG. 19(*b*) is an elevational view of the fifth construction;

FIG. 19(*c*) is an elevational view of one component of the fifth construction;

FIG. 20(*a*) and (*b*) are, respectively, plan and elevational views of a sixth construction of protector in accordance with the present invention;

FIG. 21(*a*) and (*b*) are, respectively, plan and elevational views of a seventh construction of protector in accordance with the present invention;

FIGS. 22(*a*), (*b*) and (*c*) are, respectively a plan view, an elevational view, from one side, and a fragmentary elevational view from the other side of a first embodiment of an annular retaining clamp in accordance with the present invention;

FIGS. 23(*a*), (*b*) and (*c*) are, respectively a plan view, an elevational view, from one side, and a fragmentary elevational view from the other side of a second embodiment of an annular retaining clamp in accordance witch the present invention;

FIGS. 24(*a*) and (*b*) are, respectively, plan and part-sectional elevational views of a further construction of protector in accordance with the present invention;

FIG. 25 is a perspective view illustrating one of two components of the construction of FIGS. 24(*a*) and (*b*);

FIGS. 26 (*a*)–(*c*) are, respectively, a perspective view, an end view and a fragmentary, sectional, detail view of a further construction of a protector body or clamp in accordance with the invention;

FIG. 27 is a perspective view of a clip member used in the construction of FIG. 26;

FIGS. 28 (*a*) and (*b*) are, respectively, side and end views of a tool for applying and removing the clip member of FIG. 27;

FIG. 29 is an end view of a further embodiment of annular protector body in accordance with the invention;

FIGS. 30 (*a*) and (*b*) are, respectively, a partial, sectional side view of still a further embodiment of annular protector body in accordance with the invention and a perspective view of one hemi-annular section thereof.

FIG. 31(*a*) is a side view of a preferred embodiment of protector and clamps mounted on a drill pipe;

FIGS. 31(*b*) and (*c*) are, respectively, end and side views of one half of the protector of FIG. 31(*a*);

FIG. 31(*d*) is a detailed view of a portion of the protector half of FIGS. 31(*b*) and (*c*), showing one means of securing a bearing element thereto.

Figure 51:
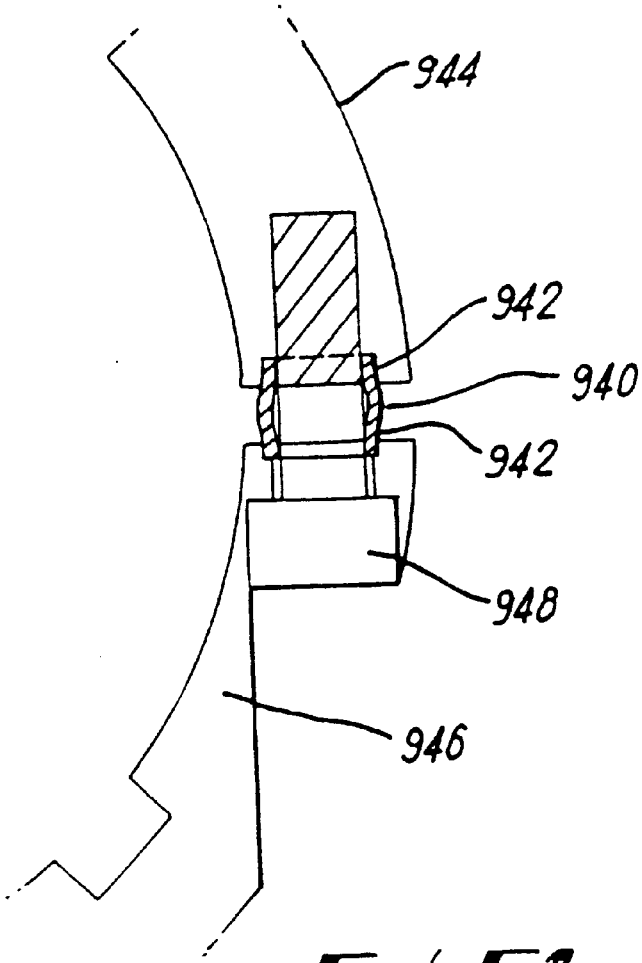
Figure 32:
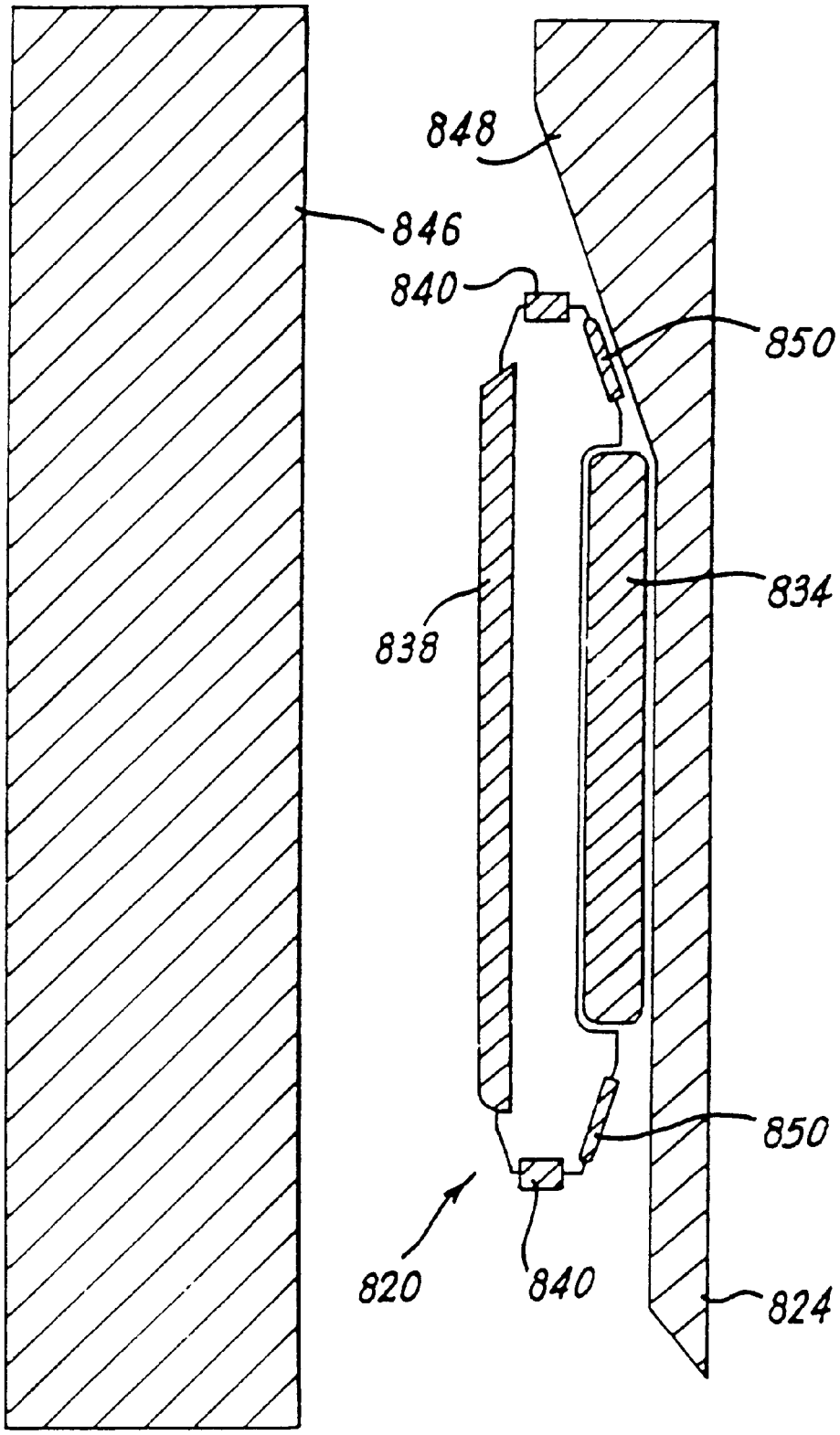
Figure 33A:
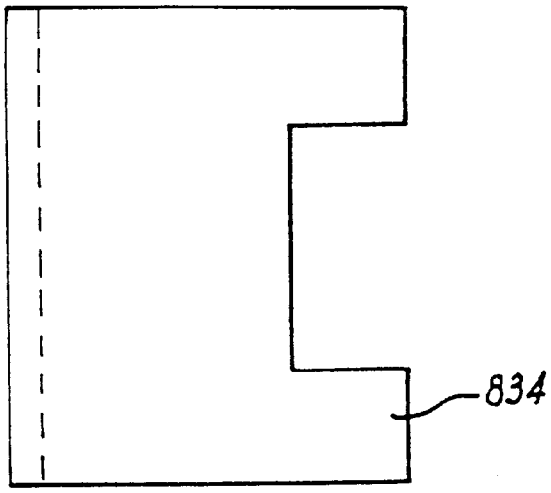
Figure 33B:
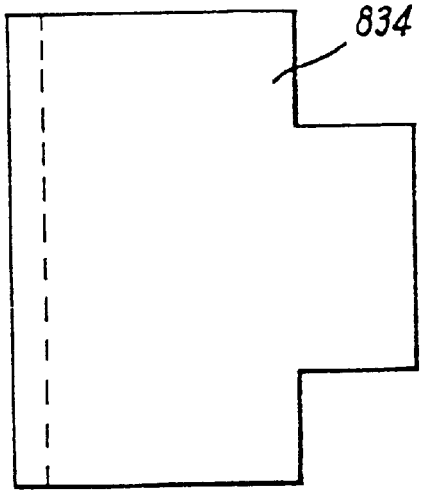
Figure 33C:
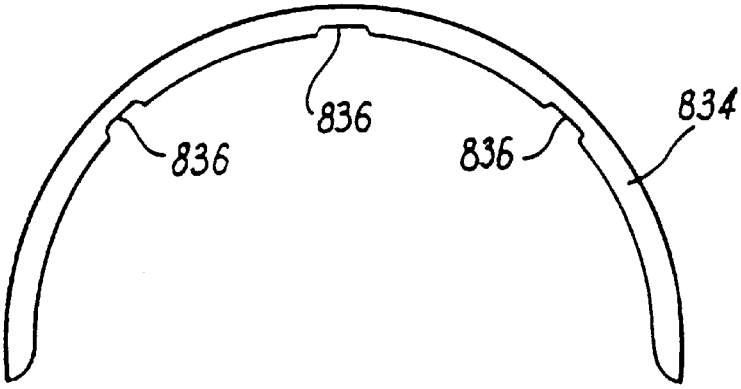
Figure 34A:
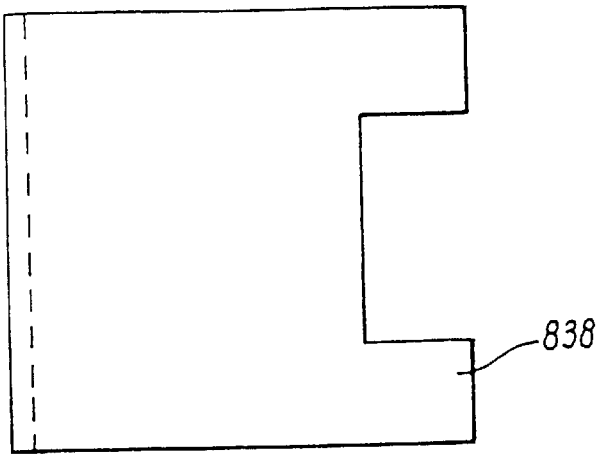
Figure 34B:
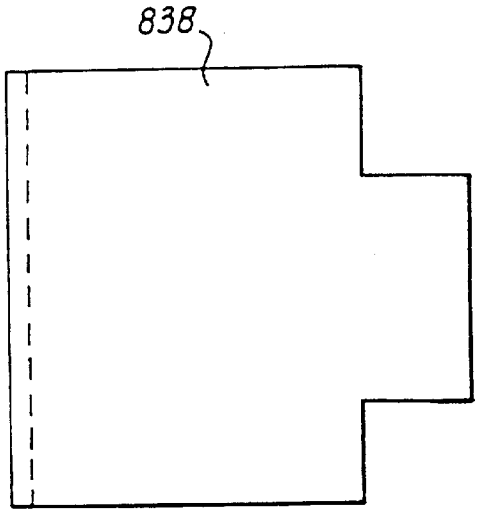
Figure 34C:
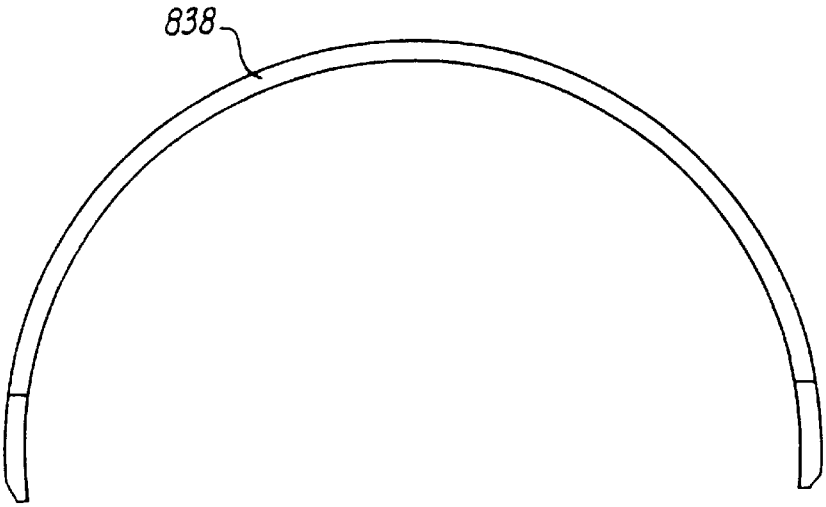
Figures 36A, 36B, 36C:
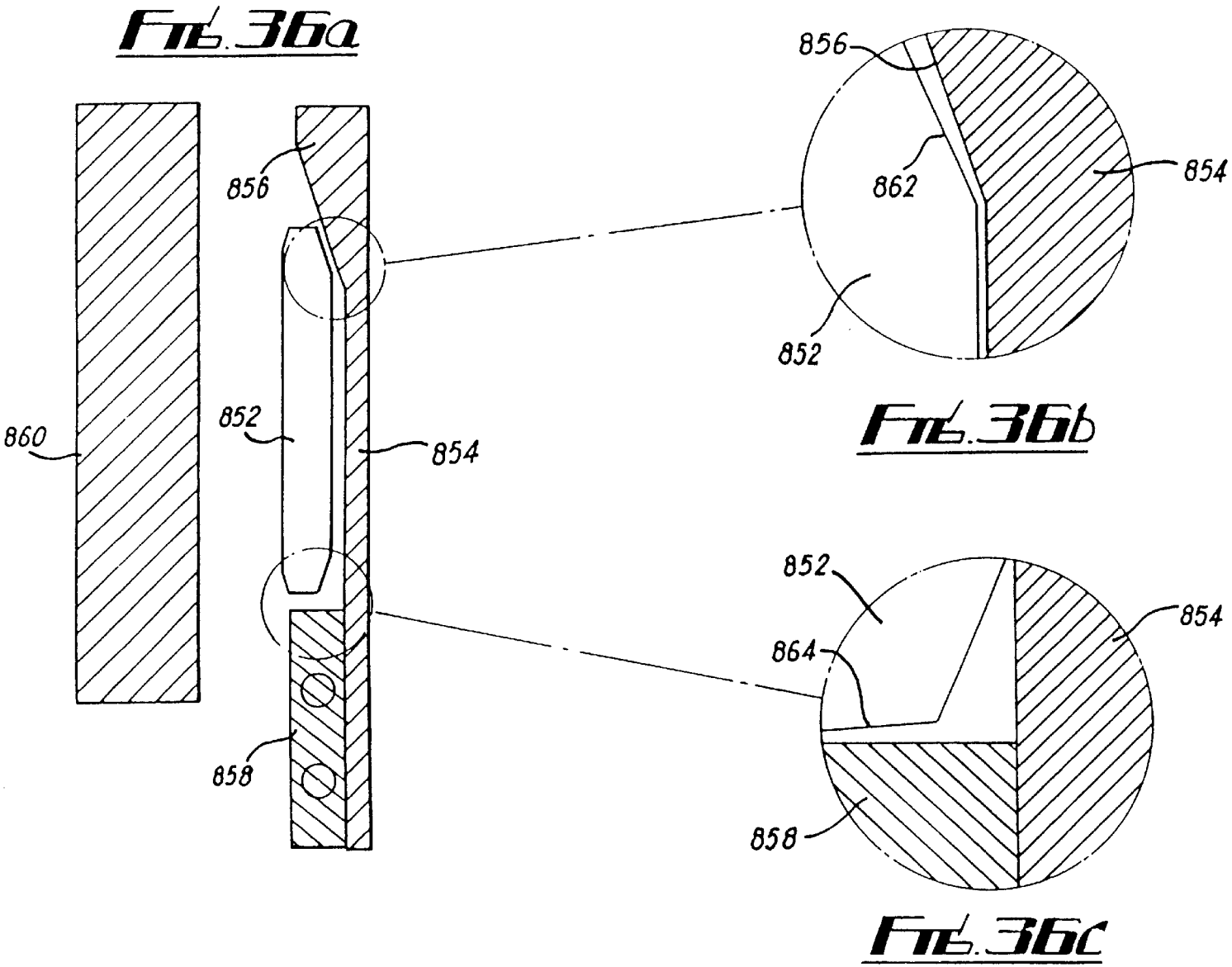
Figures 37A, 37B, 37C, 37D, 37E:
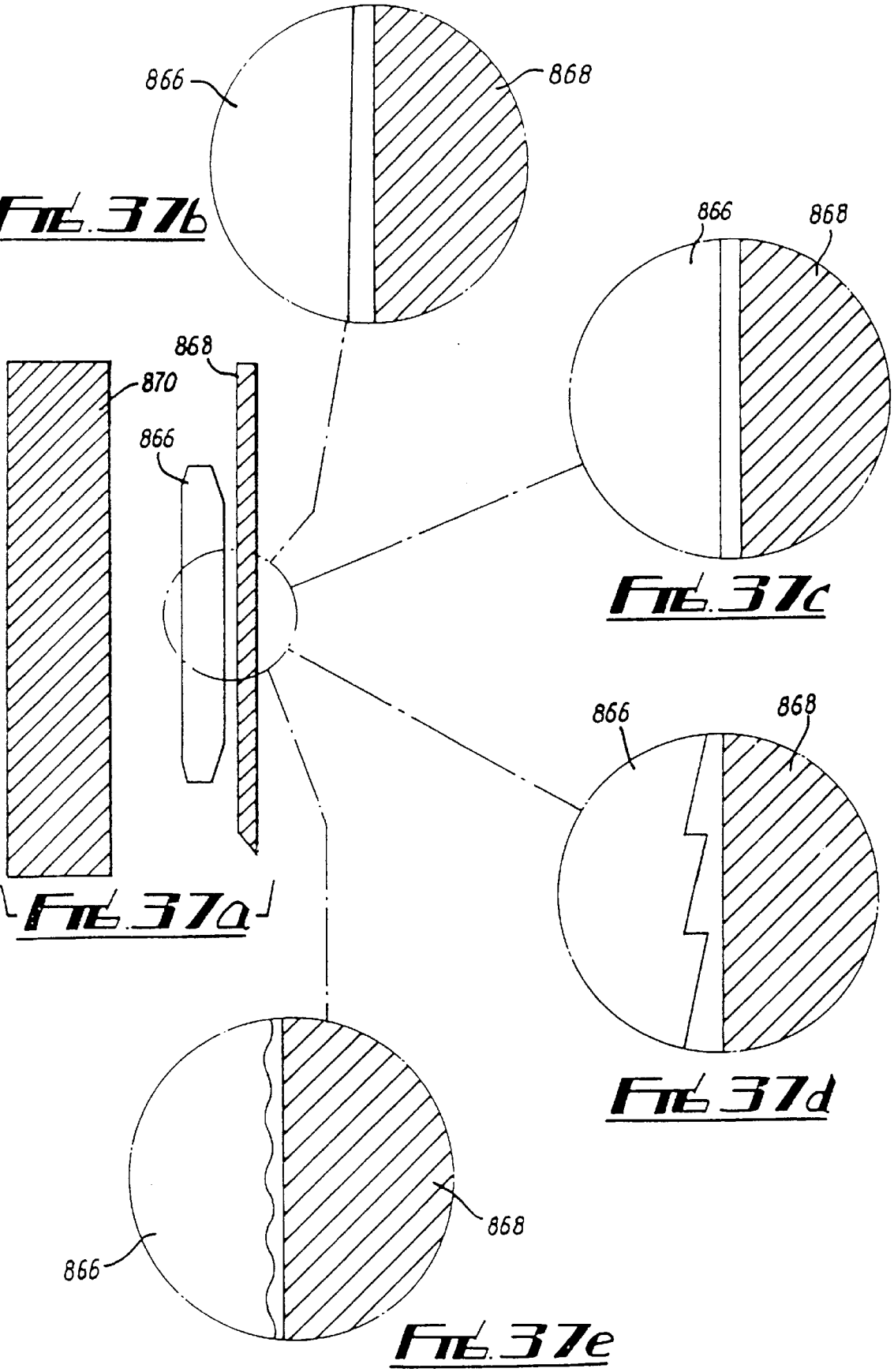
Figure 38A:
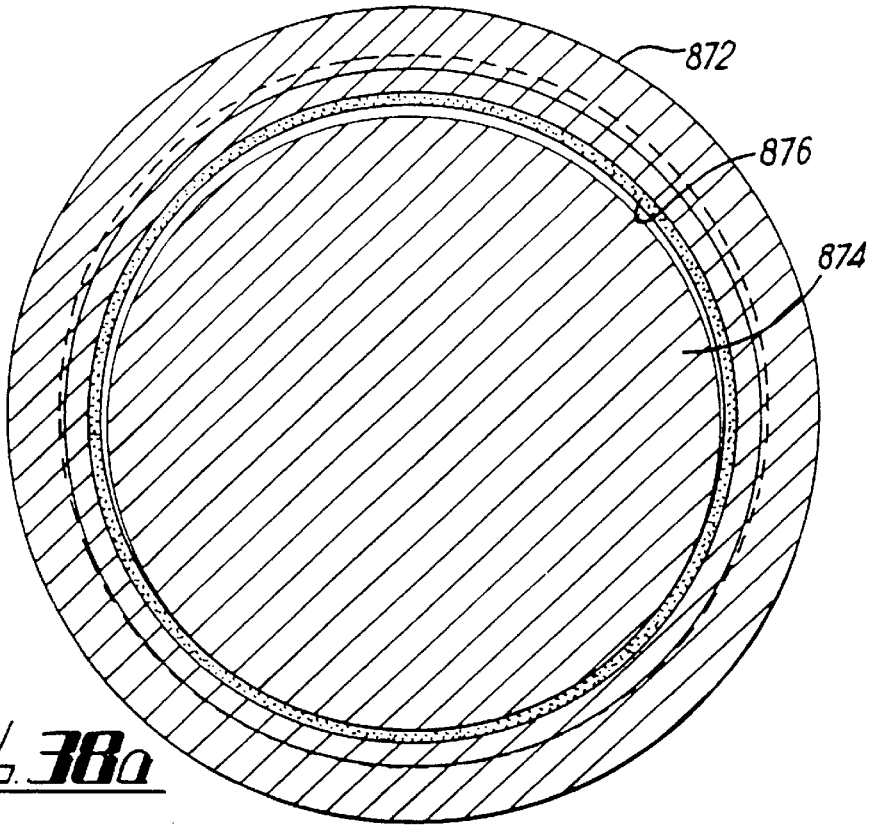
Figure 38B:
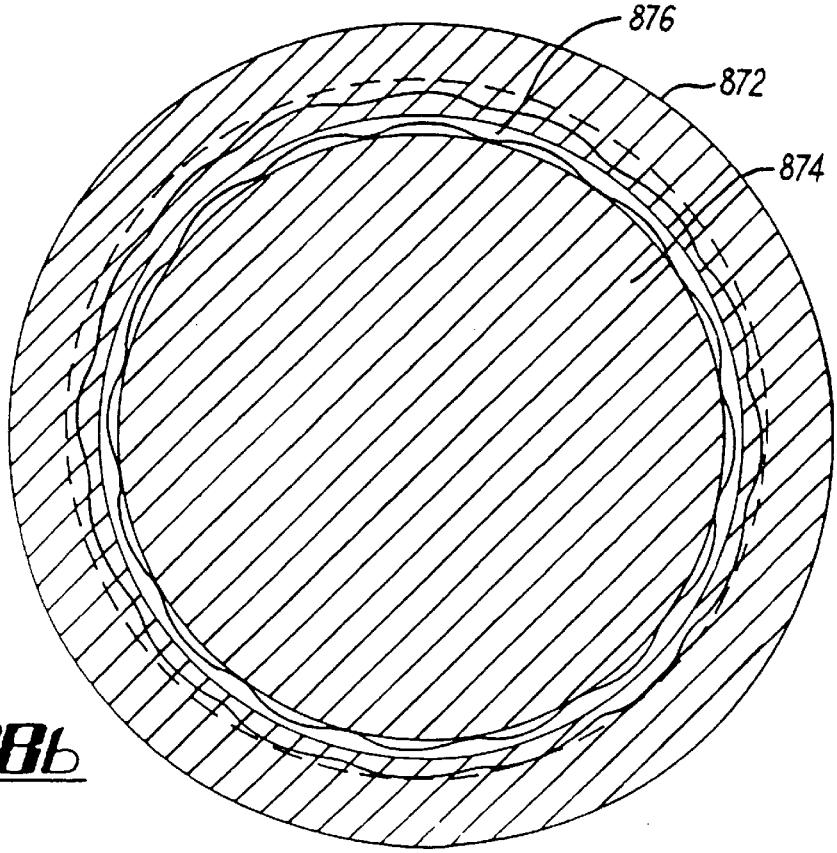
Figure 39A:
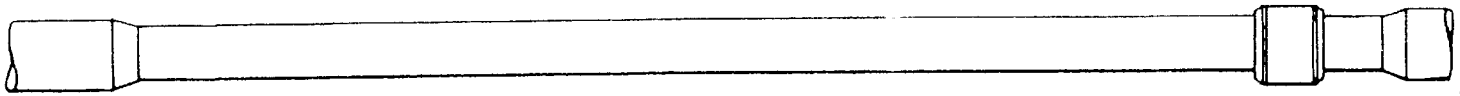
Figure 39B:
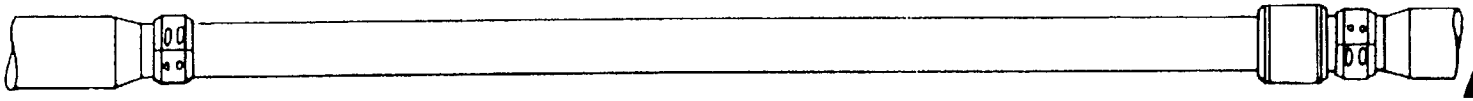
Figure 39C:
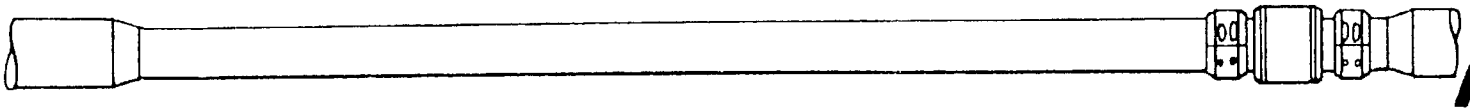
Figure 39D:
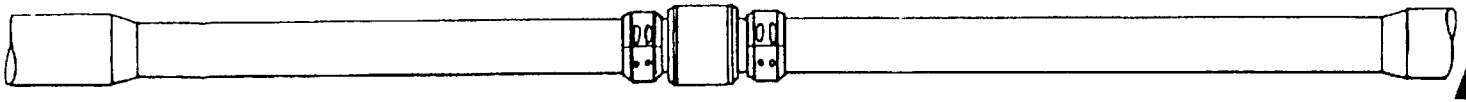
Figure 39E:
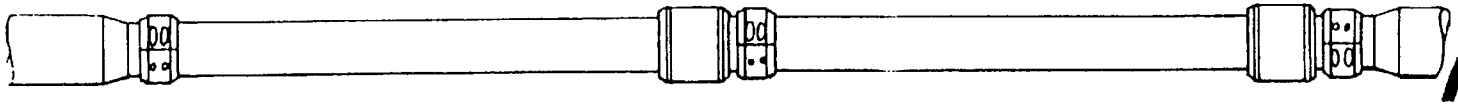
Figure 39F:
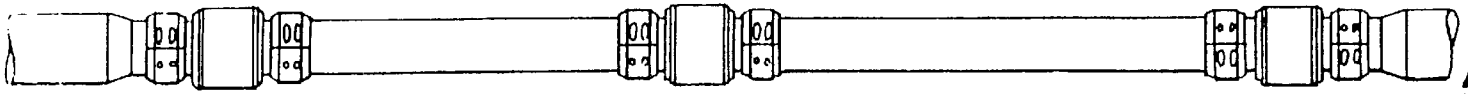
Figure 41A:
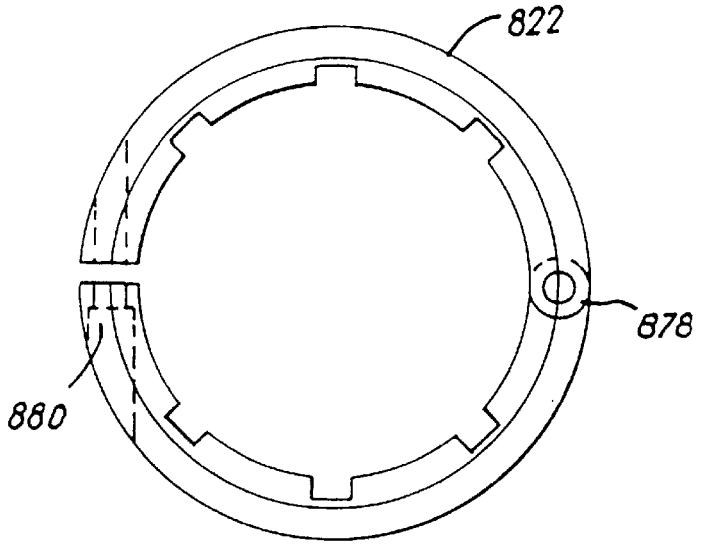
Figure 41B:
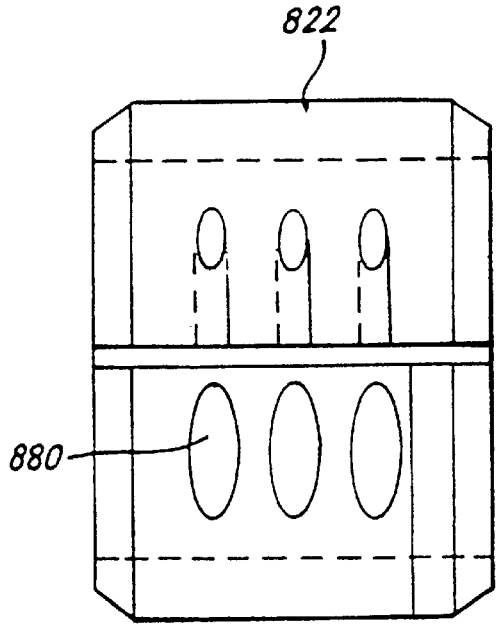
Figure 41C:
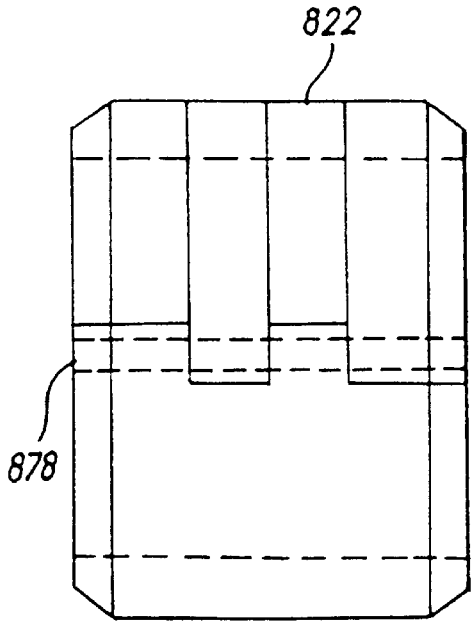
Figure 42A:
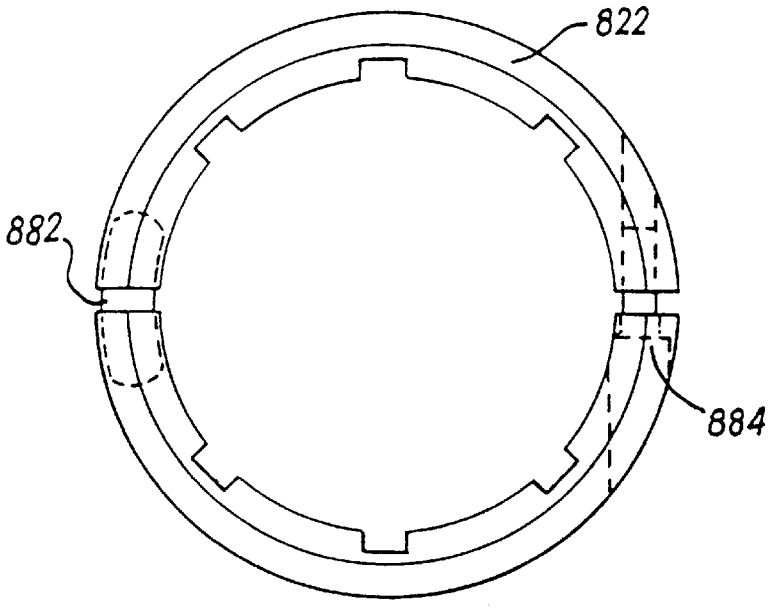
Figure 42B:
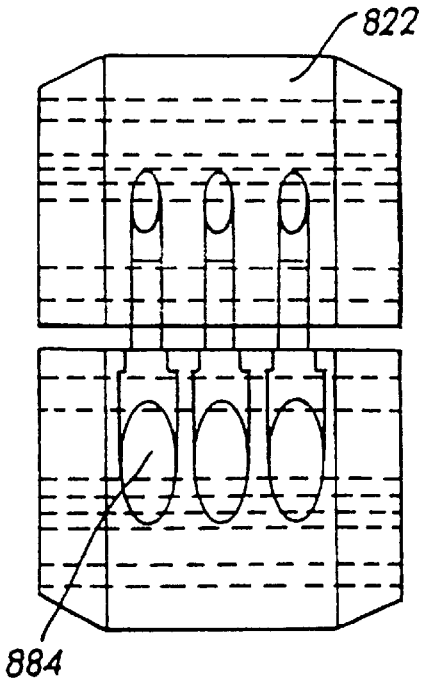
Figure 42C:
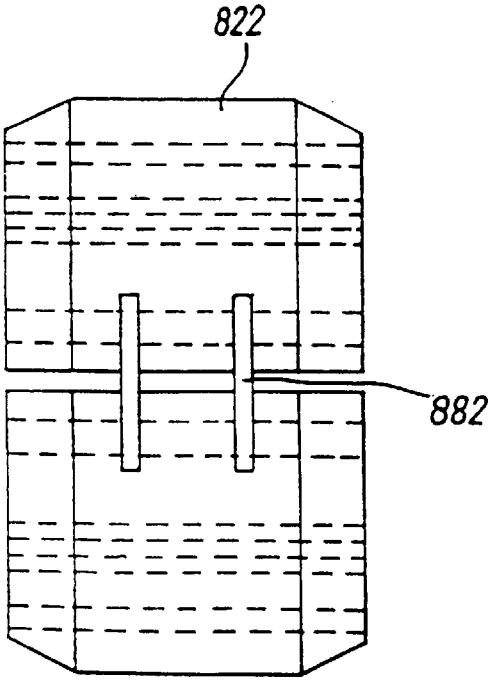
Figure 43A:
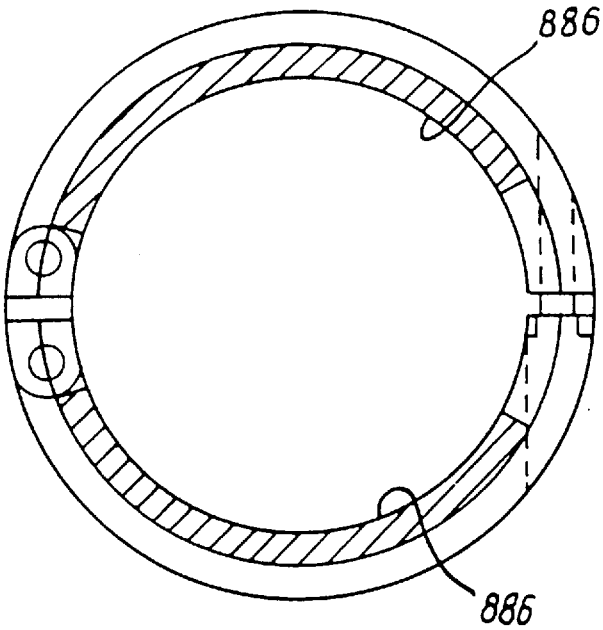
Figure 43B:
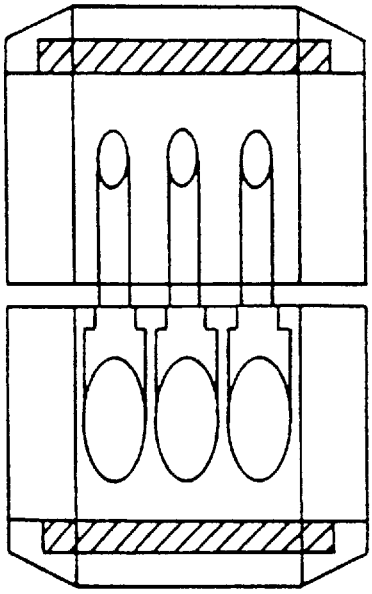
Figure 43C:
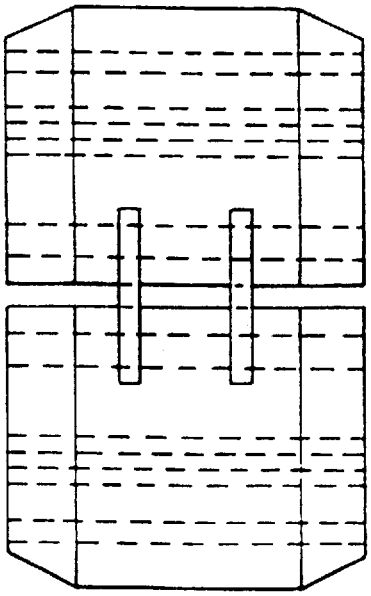
Figure 44A:
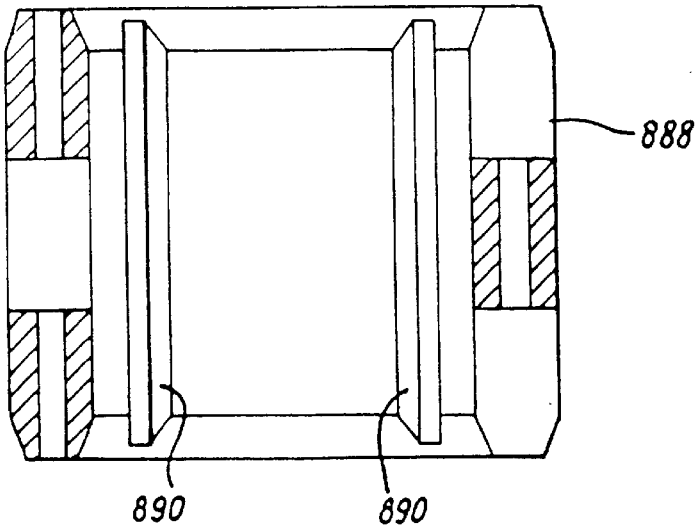
Figure 44B:
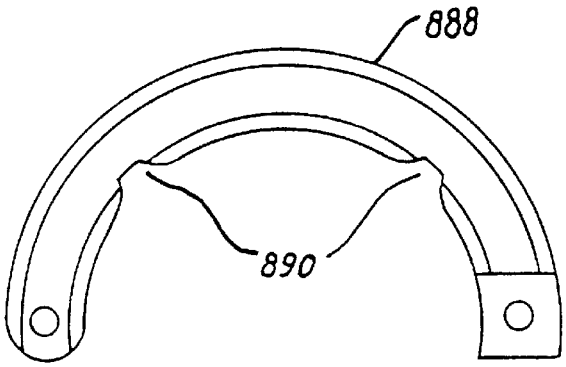
Figure 44C:
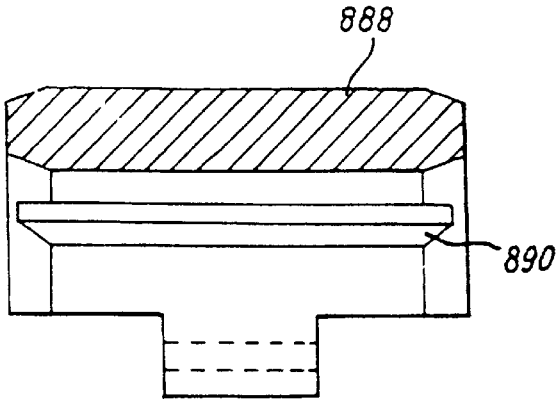
Figure 44D:
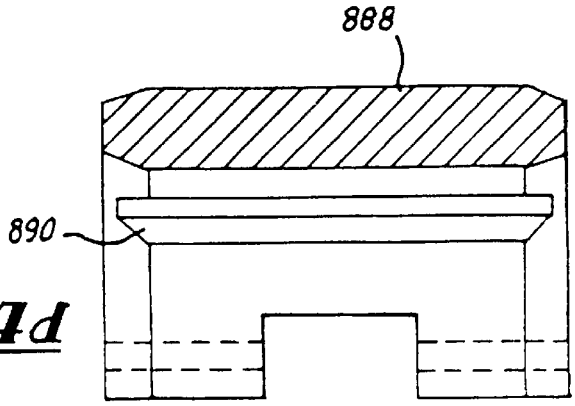
Figure 45A:
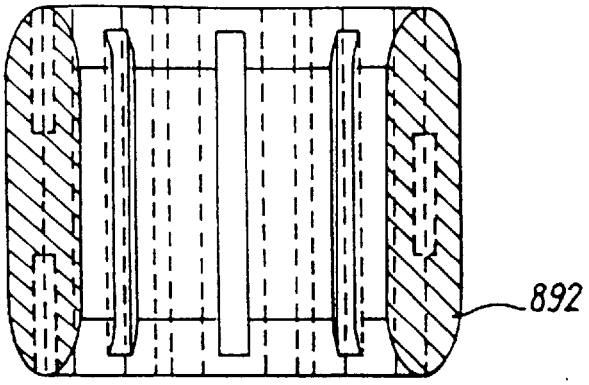
Figure 45B:
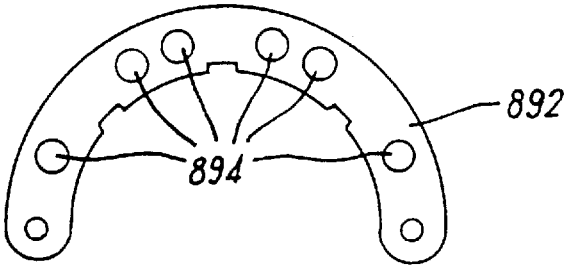
Figure 45C:
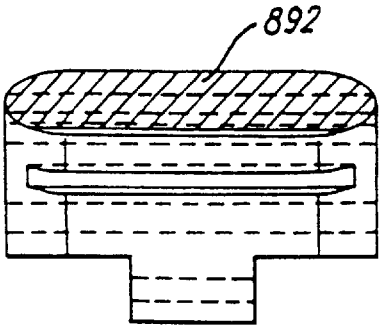
Figure 45D:
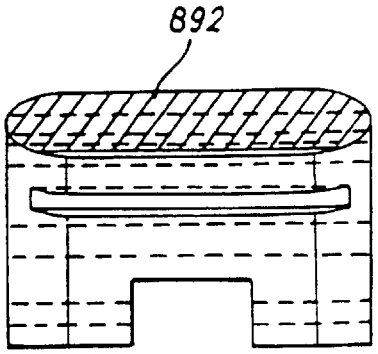
Figure 46A:
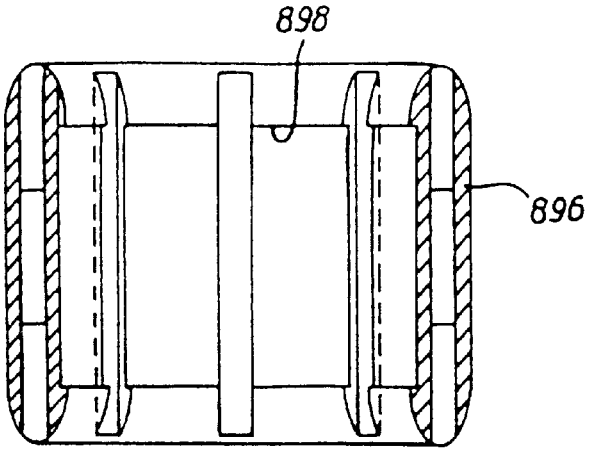
Figure 46B:
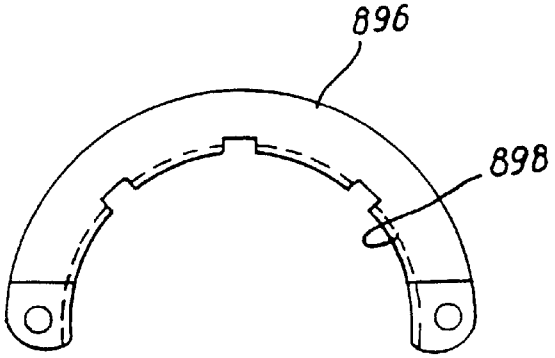
Figure 46C:
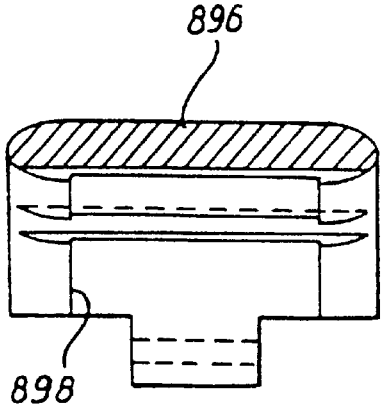
Figure 46D:
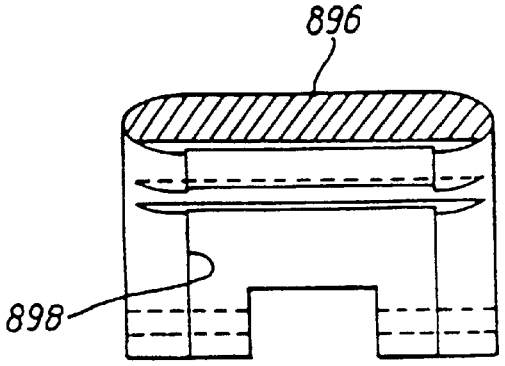
Figure 47A:
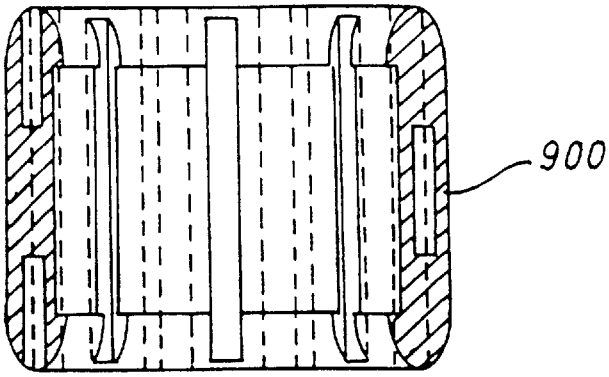
Figure 47B:
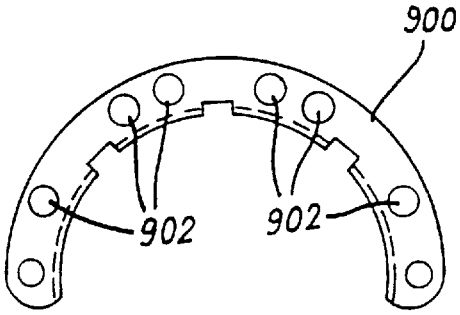
Figure 47C:
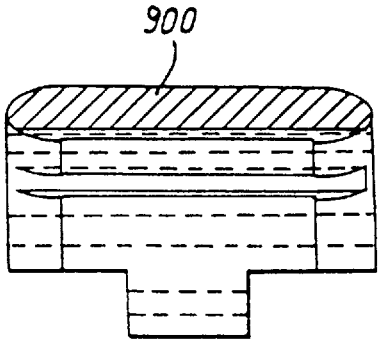
Figure 47D:
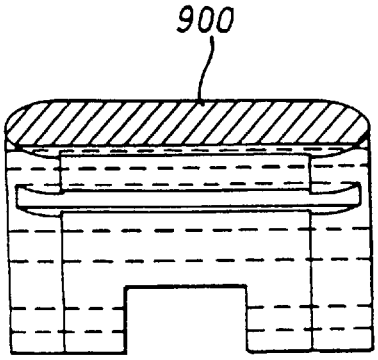
Figure 48A:
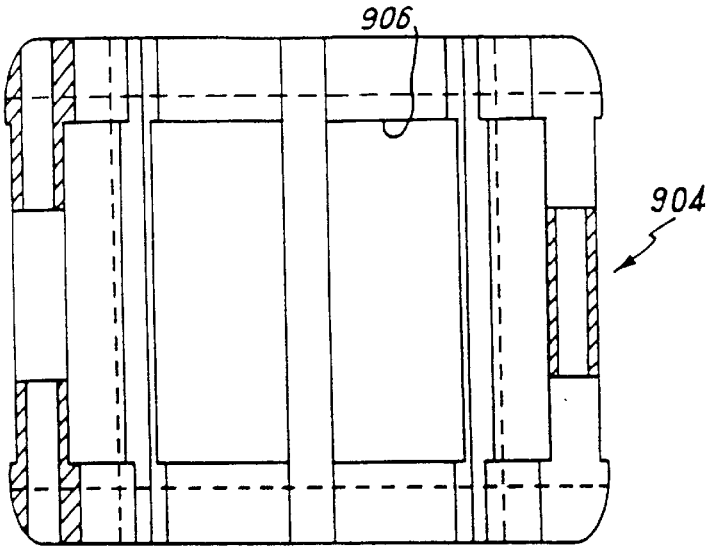
Figure 48B:
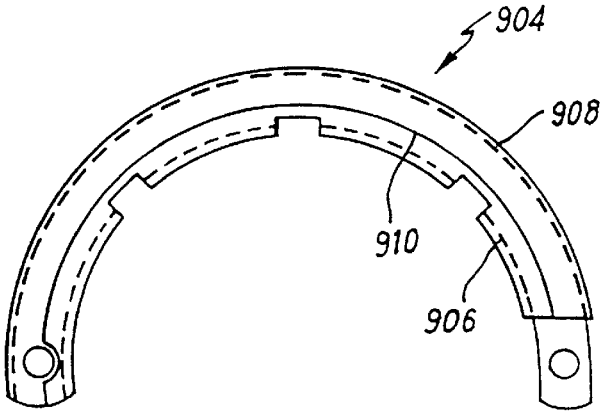
Figure 48C:
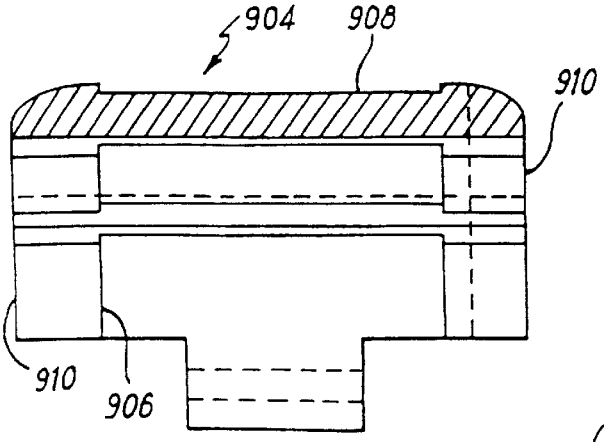
Figure 48D:
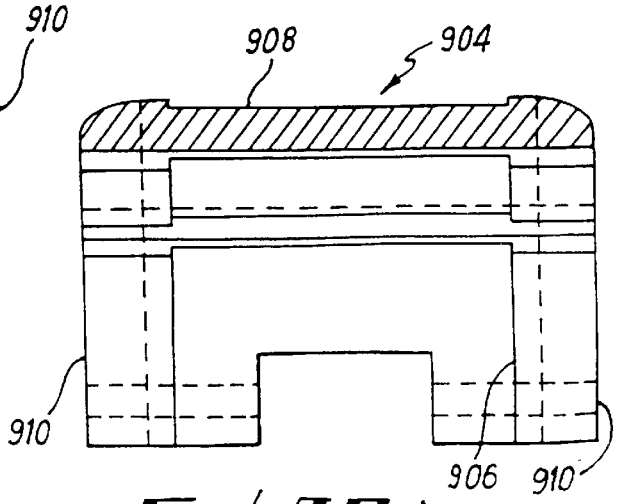
Figure 49:
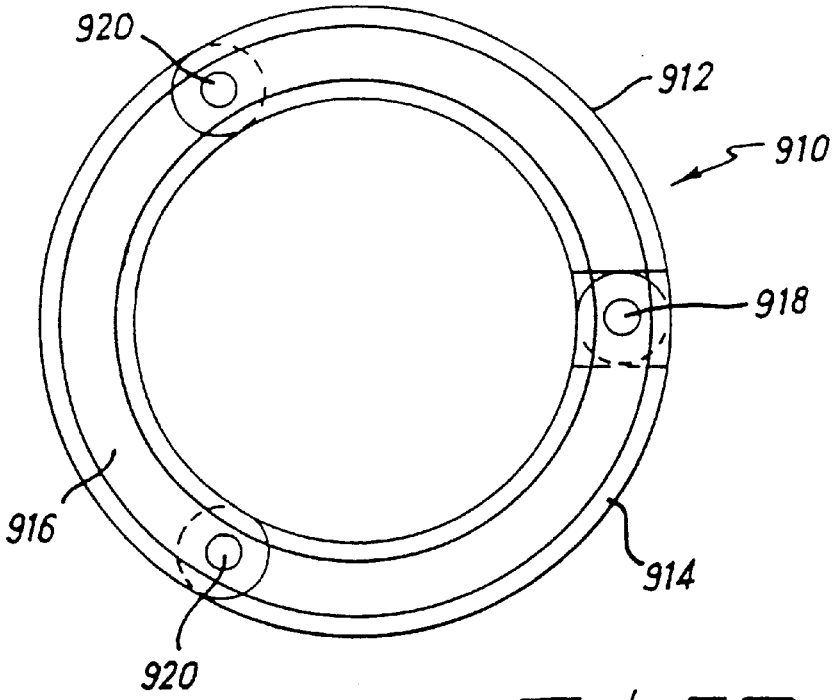
Figure 50:
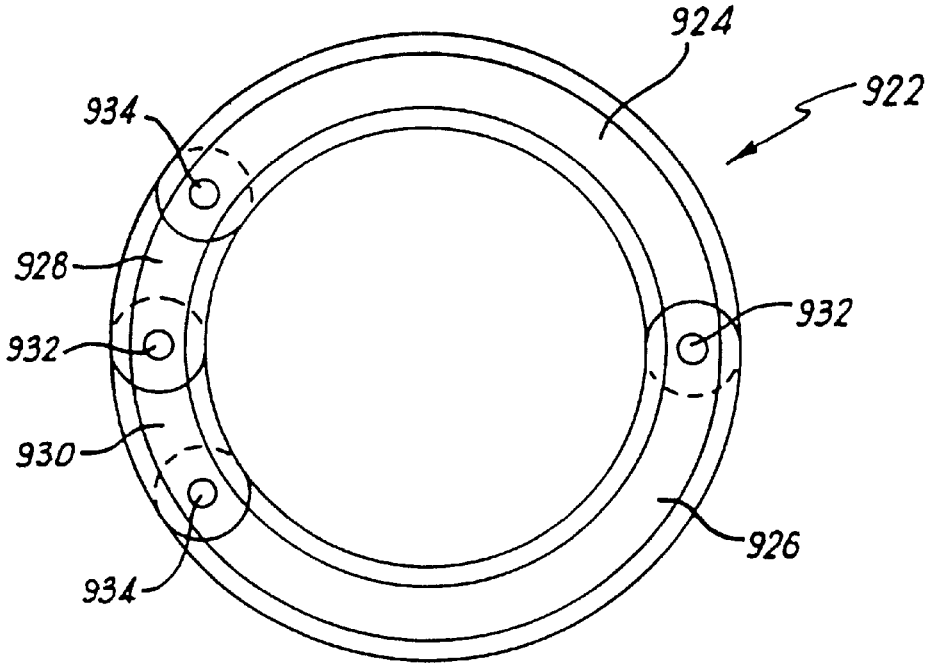

FIG. 32 is a partial, sectional side view of the protector of FIG. 31 mounted on a drill pipe adjacent a pipe joint;

FIGS. 33(*a*), (*b*) and (*c*) are respectively first and second side views and an end view of an inner bearing element for use with the protector of FIG. 32;

FIGS. 34(*a*), (*b*) and (*c*) are respectively first and second side views and an end view of an outer bearing element for use with the protector of FIG. 32;

FIGS. 35(*a*)–(*e*) are respectively first and second side and end views and an assembled view of rim bearing elements for use with the protector of FIG. 32;

FIG. 36(*a*) is a partial, sectional side view of a protector mounted on a drill pipe between a pipe joint and a clamp, and FIGS. 36(*b*) and (*c*) are enlarged detail views of portions of the clearance gap between the protector and pipe joint and the protector and clamp respectively;

FIG. 37(*a*) is a partial, sectional side view of a protector mounted on a drill pipe, and FIGS. 37(*b*) (*c*), (*d*) and (*e*) are enlarged detail views of portions of the clearance gap between the protector and the drill pipe, showing alternative surface configurations of the protector surface;

FIGS. 38(*a*) and (*b*) are sectional end views of a protector mounted on a drill pipe showing alternative surface configurations of a bearing element located therebetween;

FIGS. 39(*a*)–(*f*) are side views of lengths of drill pipe showing alterative assemblies of protectors and clamps mounted thereon;

FIGS. 40(*a*)–(*j*) are partial end views of portions of protector showing various configurations of internal grooves or flutes and fluid passages;

FIGS. 41(*a*), (*b*) and (*c*) are, respectively, end and first and second side views of a preferred embodiment of annular clamp;

FIGS. 42(*a*), (*b*) and (*c*) are, respectively, end and first and second side views of still another preferred embodiment of annular clamp;

FIGS. 43(*a*), (*b*) and (*c*) are, respectively, end and first and second side views of yet another preferred embodiment of annular clamp;

FIGS. 44(*a*), (*b*), (*c*) and (*d*) are, respectively, a first sectional side view, an end view and third and fourth sectional side views of a preferred embodiment of annular protector body;

FIGS. 45(*a*), (*b*), (*c*) and (*d*) are, respectively, a first sectional side view, an end view and third and fourth sectional side views of another preferred embodiment of annular protector body;

FIGS. 46(*a*), (*b*), (*c*) and (*d*) are, respectively, a first sectional side view, an end view and third and fourth sectional side views of still another preferred embodiment of annular protector body;

FIGS. 47(*a*), (*b*), (*c*) and (*d*) are, respectively, a first sectional side view, an end view and third and fourth sectional side views of still another preferred embodiment of annular protector body;

FIGS. 48(*a*), (*b*), (*c*) and (*d*) are, respectively, a first sectional side view, an end view and third and fourth sectional side views of still another preferred embodiment of annular protector body;

FIGS. 49 and 50 are end views of first and second embodiments of protector body formed from more than two part-annular sections; and FIG. 51 is a partial sectional view of a modified arrangement for connecting part-annular sections of clamp or protector body using bolts or screws, including compressible shroud means to isolate the shank of the bolts or screws from the external environment.

Figure 3:
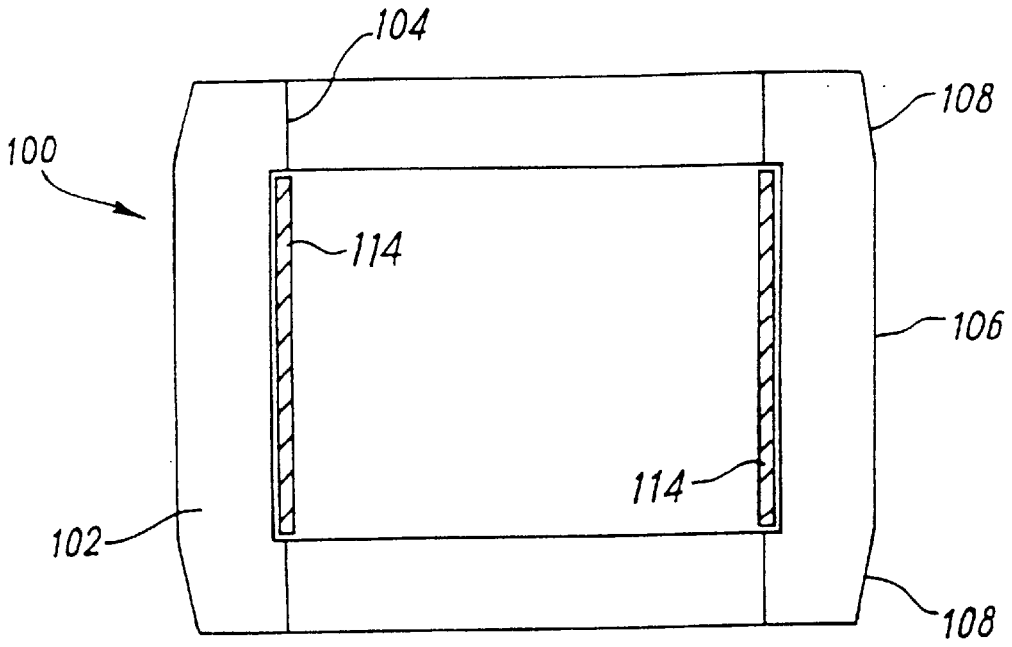
FIG. 3 is a longitudinal sectional elevation of a first embodiment of protector in accordance with the present invention.
Figure 4:
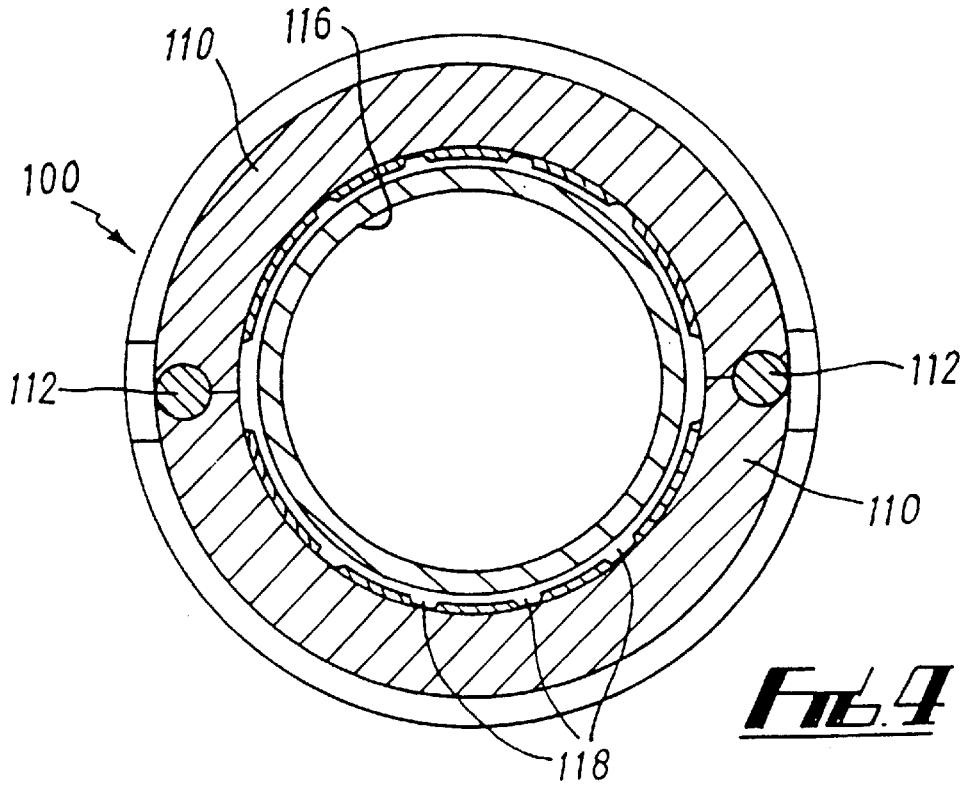
FIG. 4 is a plan view of the first embodiment.

Referring first to FIGS. 3 and 4, a first embodiment 100 of pipe string protector comprises an annular body 102 having a cylindrical bore 104 and a generally cylindrical periphery 106 with bevelled ends 108. The annular body 102 is in two hemi-annular body sections 110 whose ends are formed as hinges and mutually coupled by hinge pins, screws or bolts 112 (FIG. 4). Alternative structural arrangements of the annular protector body 102 are possible, including alternative means of securing the body sections, as shall be discussed further below.

The bore 104 is fitted with bearing means comprising two hemi-cylindrical bushes 114 of material suitable for functioning as a bearing in the conditions prevailing in a well. The bushes 114 have radially inwardly facing surfaces dimensioned to fit with a small clearance around a pipe string 116 (FIG. 4).

The bushes 114 preferably have longitudinal grooves 118 to facilitate lubrication by drilling mud and hence facilitate movement of the protector 100 with respect to the pipe string 116 during use of the protector 100. The grooves preferably have bevelled side walls, but may vary in size, number and configuration. The arrangement of the clearance of the annular body 102 around the pipe string 116 and of the longitudinal grooves 118 may provide a thin film lubrication or hydrodynamic bearing effect, at least under certain conditions, using the drilling mud as the lubricating fluid, which further reduces the friction between the pipe string and the bushing 114 in use. Such circulation of fluid also serves to flush out debris and to cool the adjacent components.

The thin film lubrication/hydrodynamic bearing effect referred to above can be promoted by selection of the clearance gap between the bearing member and the adjacent rotating surface, and can be further enhanced by the use of suitably configured grooves or flutes. In the various configurations of bearings disclosed herein, the thin film lubrication can take place between the bearing surface and the drill pipe, between the bearing surface and the protector body, or both (in the case of a floating bearing), or between the surfaces of adjacent bearing elements. The relevant clearance gaps can be selected to provide thin film lubrication up to an approximate predetermined load, whereafter the thin fluid film will break down and the adjacent surfaces will contact one another directly. It is preferred that the materials of the bearing surfaces of the protector are selected to minimise the friction between the surfaces under these conditions.

In FIG. 3, the bushes 114 are shown as being located in a rebate within the bore 104 of the annular body 102, the longitudinal ends of the bushes 114 being spaced inwardly from the ends of the annular body. However, the bushes 114 could extend the full length of the bore 104. The bearing surface provided by the bushes 114 might alternatively be provided by discrete portions applied to the required areas of the inner surfaces of the annular body, rather than by the hemi-cylindrical bushes as shown.

In this and other embodiments of the invention described herein, the annular body 102 is preferably formed from metal, most preferably aluminium or aluminium alloy, or from plastic or elastomeric materials capable of sustaining the mechanical loads encountered in use. Composites of different materials may also be used.

The bushes 114 of this embodiment and the corresponding bearing members of other embodiments described herein are preferably formed from plastic or elastomeric materials, or in some cases steel or other metals. Suitable materials include carbon reinforced polyetheretherketone, polytetrafluoroethylene, polyphthalamide, polyvinylidene fluoride and rubber compounds.

The materials from which the annular body and bearing means may be formed, besides preferred materials discussed elsewhere herein, are preferably selected from the following:

- metals including: aluminium and aluminium alloys; steel and steel alloys; copper alloys including gun metal, aluminium bronze, phosphor bronze, cupro-nickel; zinc alloys;
- coatings including polytetrafluoroethylene (PTFE), electroless nickel, zinc and paints, rubber and rubber compounds;
- plastics and elastomers, including: carbon reinforced polyetheretherketone; polyphthalamide; polyvinylidene fluoride; rubber compounds; phenolic resins or compounds; thermosetting plastics; thermoplastic elastomers; thermoplastic compounds; thermoplastics including polyetheretherketone, polyphenylenesulfide, polyphthalamide, polyetherimide, polysulphone, polyethersulphone, all polyimides, all polyamides (including nylon compounds), polybutyleneterephthalate, polyetherketoneketone; and
- filler materials for use with the above mentioned metals and plastics, including: glass, carbon, PTFE, silicon, teflon, molybdenum disulphide, graphite, oil and wax.

Particularly preferred materials for the annular body are: aluminium alloy, copper alloy, high performance plastic or phenolic resin, zinc alloy or iron alloy.

Particularly preferred materials for the bearing means are: polyetheretherketone, phenolic resins, polyphthalamides, liquid crystal polymer, acetals, polyphenylenesulfide, polyamides (nylons), polyetherketoneketone or polyetherimide.

It is particularly preferred that the materials used for bearing surfaces, either of the annular body or of any bearing elements associated therewith, are of a type which are capable of acting as sacrificial, self-lubricating materials, or are combined with filler materials which are capable of acting in such a manner.

Figure 5:
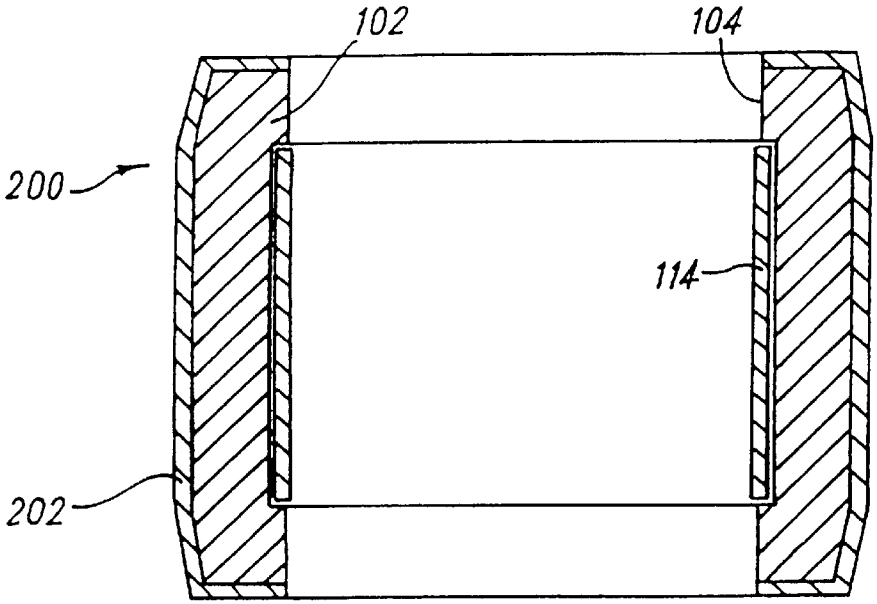
FIG. 5 is a longitudinal sectional elevation of a second embodiment of protector in accordance with the present invention.
Figure 6:
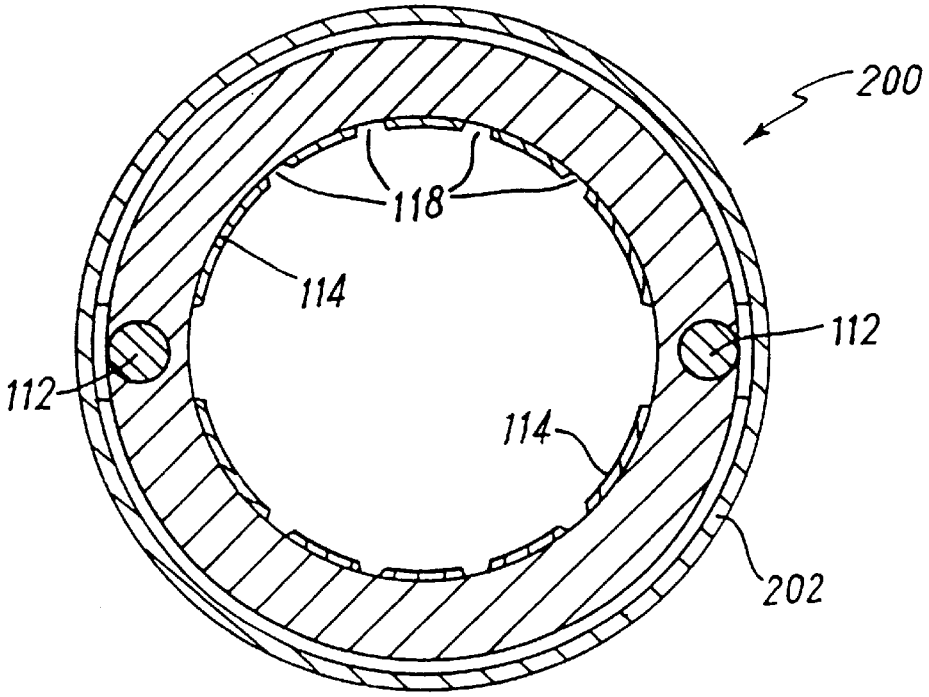
FIG. 6 is a plan view of the second embodiment.

A second embodiment 200 of pipe string protector as illustrated in FIGS. 5 and 6 is generally similar to the first embodiment 100, and those parts of the second embodiment 200 which are identical or equivalent to like parts of the first embodiment 100 are given the same reference numerals.

The principal difference in the second embodiment 200 with respect to the first embodiment 100 is the application to the periphery 106 of an external coating 202 of reinforced plastics, or other materials of the same type as the inner bushes 114, to reduce friction between the exterior of the protector 200 and the well bore (not shown) or a casing (see FIG. 7 and 8) lining the well bore. The provision of such external bearing means is applicable to all of the embodiments of the protector as described herein, and alternative arrangements of such external bearings are described below in relation to other embodiments.

Figure 7:
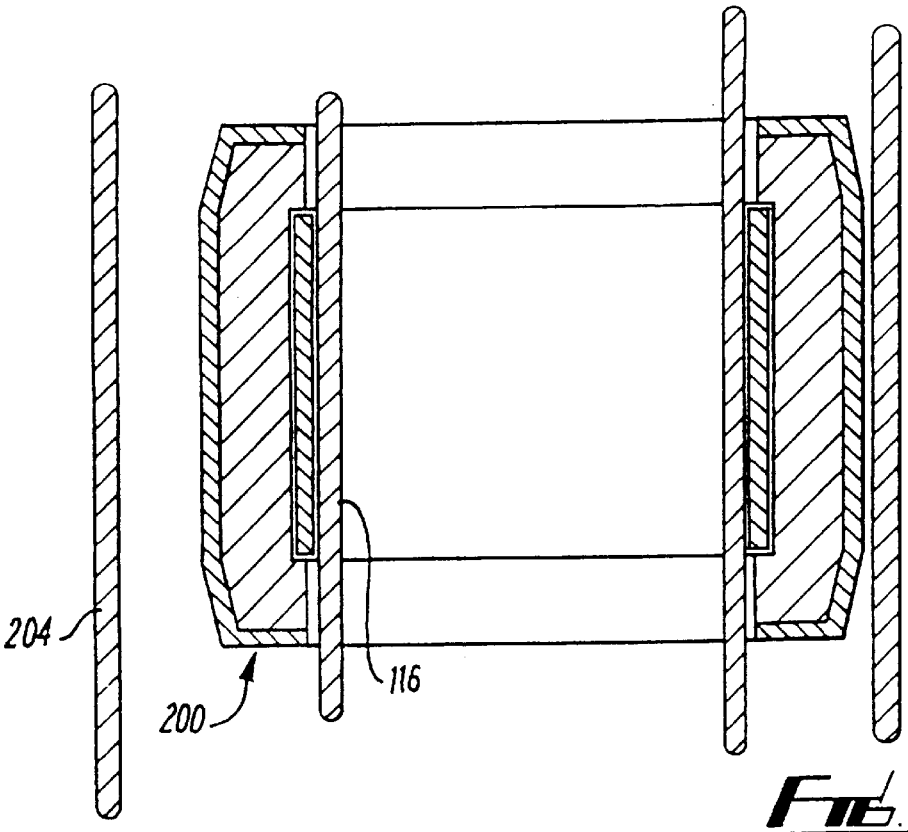
FIGS. 7 and 8 show the second embodiment in use.
Figure 8:
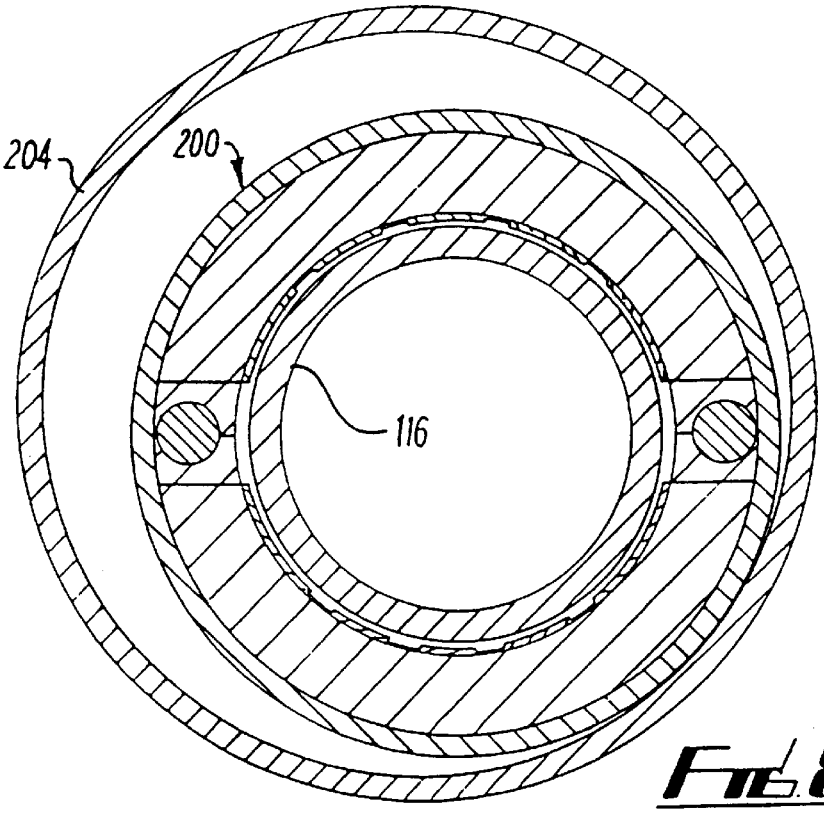

FIGS. 7 and 8 show the protector 200 fitted around the pipe string 116 within a well bore casing 204.

Figure 1:
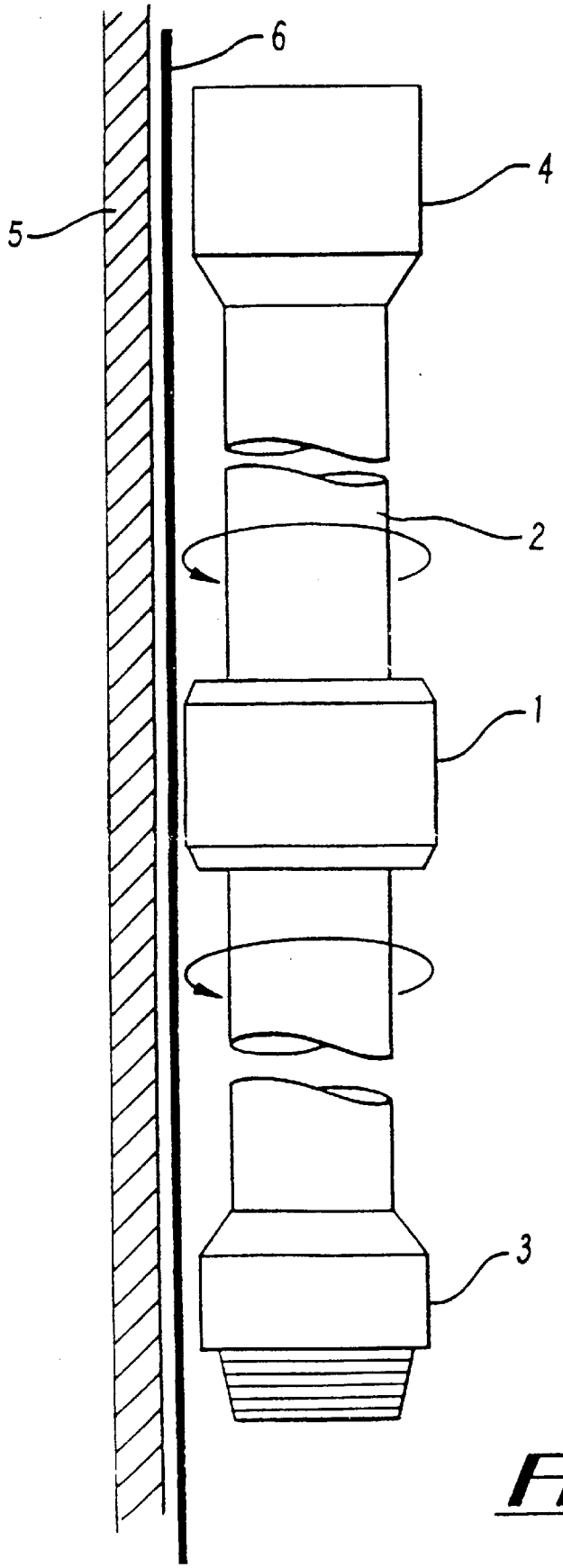
FIG. 1 is a schematic side view of a protector installed on a drill-pipe in a well bore, illustrating the use of protectors of the present type.
Figure 2:
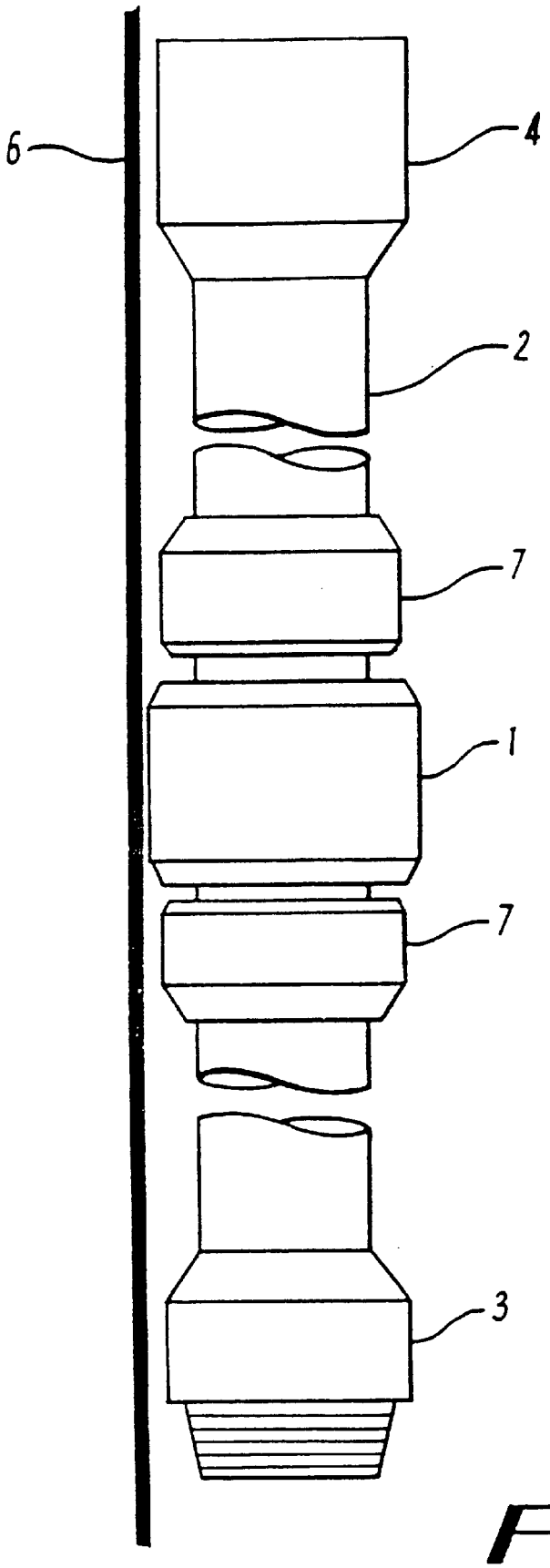
FIG. 2 is a schematic side view, similar to FIG. 1, in which longitudinal movement of the protector is restrained by annular clamp means.

The first and second embodiments can be used either as shown in FIG. 1, in which case the protectors are free to travel longitudinally along the pipe string, or as in FIG. 2, in combination with suitable retaining clamps, in which case they can be located at a specific longitudinal positions or allowed a limited range of longitudinal movement, depending upon the spacing of the clamps.

Figure 9:
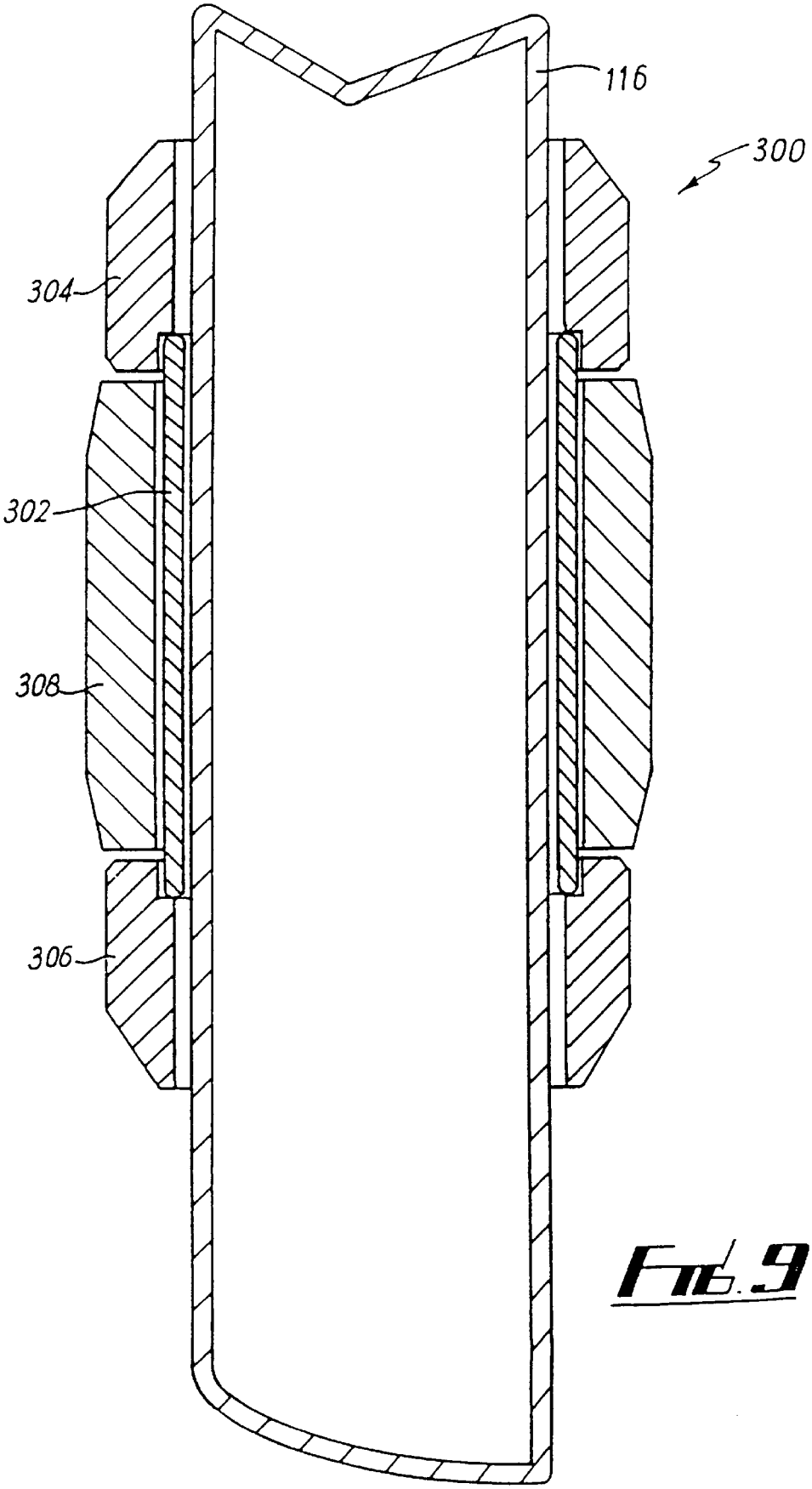
FIG. 9 is a longitudinal sectional elevation of a third embodiment of protector in accordance with the present invention.

In a third embodiment 300 (FIG. 9) a two-piece bush 302 is clamped around the pipe string 116 by upper and lower ring clamps 304 and 306. An annular protector body 308 is fitted around the bush 302 with sufficient clearance over the bush 302 and between the clamps 304, 306 as to be freely rotatable. Lubricating grooves (not shown) may be provided on the outer surface of the bush 103 and/or on the inner surface of the annular body so as to provide thin film lubrication/hydrodynamic bearing effect as in the first and second embodiments. The clearances between the annular end faces of the clamps and the adjacent annular end faces of the annular body allow the circulation of such fluid.

The longitudinal spacing of the clamps 304 and 306 is shown as being slightly greater than the length of the annular body 308, so that the protector is effectively located at a fixed position on the drill string. However, the clamps could be more widely spaced allowing the protector a limited range of longitudinal movement.

Structural details applicable to the annular body 308 and ring clamps 304 and 306 will be described below.

Figure 10:
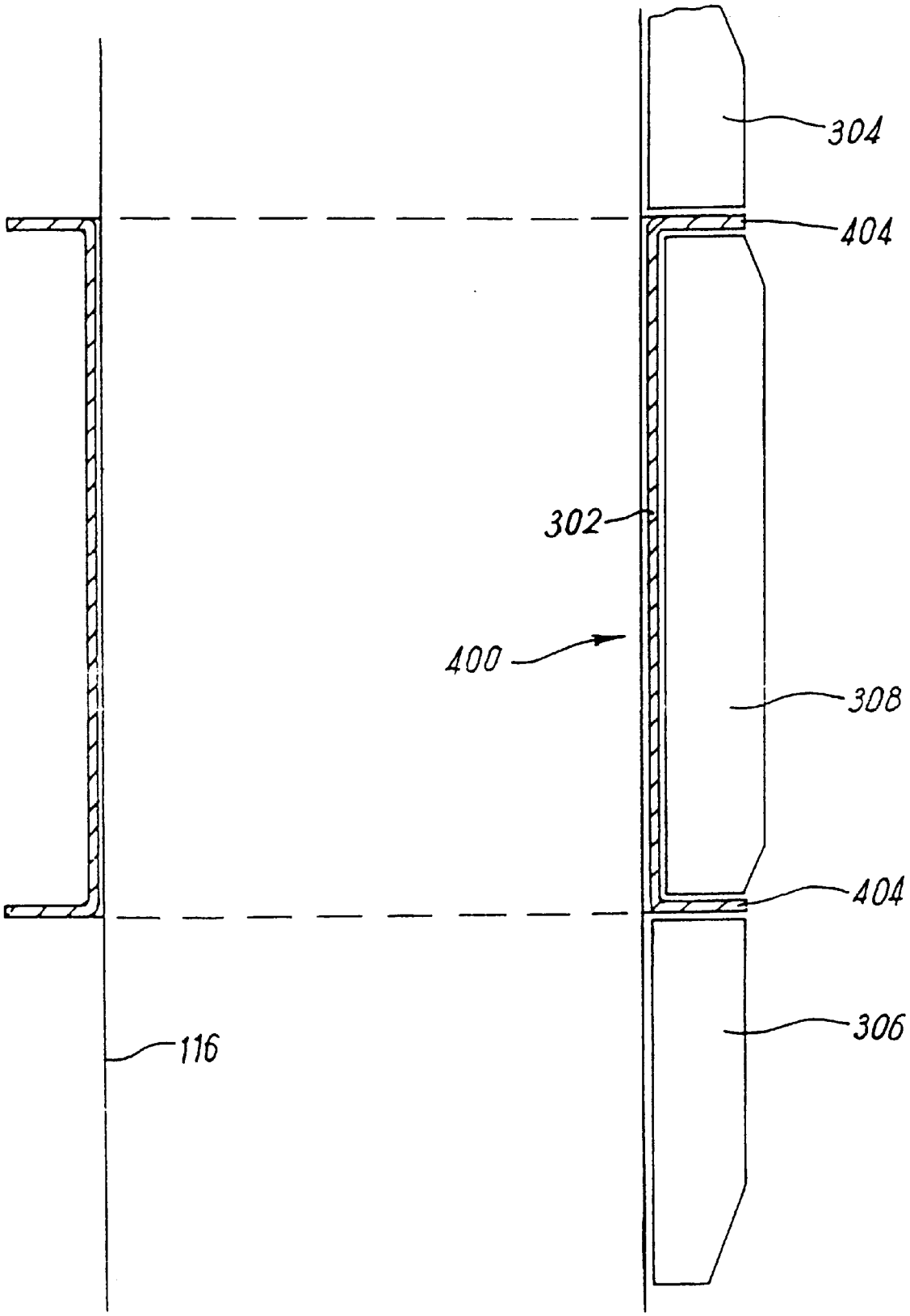
FIG. 10 is a longitudinal sectional elevation of a fourth embodiment of protector in accordance with the present invention.

A fourth embodiment 400 (FIG. 10) is generally similar to the third embodiment 300 (FIG. 9), and those parts of the fourth embodiment 400 which are identical or equivalent to like parts of the third embodiment 300 are given the same reference numerals.

The principal difference in the fourth embodiment 400 with respect to the third embodiment 300 is that the bush 302 is not clamped to the pipe string 116, but is provided with longitudinal end flanges 404 which serve as end retainers locating the bush 302 with respect to the rotatable annular protector body 308.

In this case the bush 302 is rotatable with respect to both the pipe string 116 and the annular body 308, and suitable clearances and lubrication grooves (not shown) may again be provided on the inner and/or outer surfaces of the bush 302 and/or on the inner surface of the annular body 308. The respective clearances between the flanges 404 and the adjacent end surfaces of the annular body and/or the clamps, and between the bush 302 and the pipe string 116 and/or the annular body 308, are such as to allow circulation of drilling fluid for this purpose.

As before, the spacing of the clamps 304 and 306 may be varied either to locate the protector at a specific position or to allow a range of longitudinal movement.

Figure 11A:
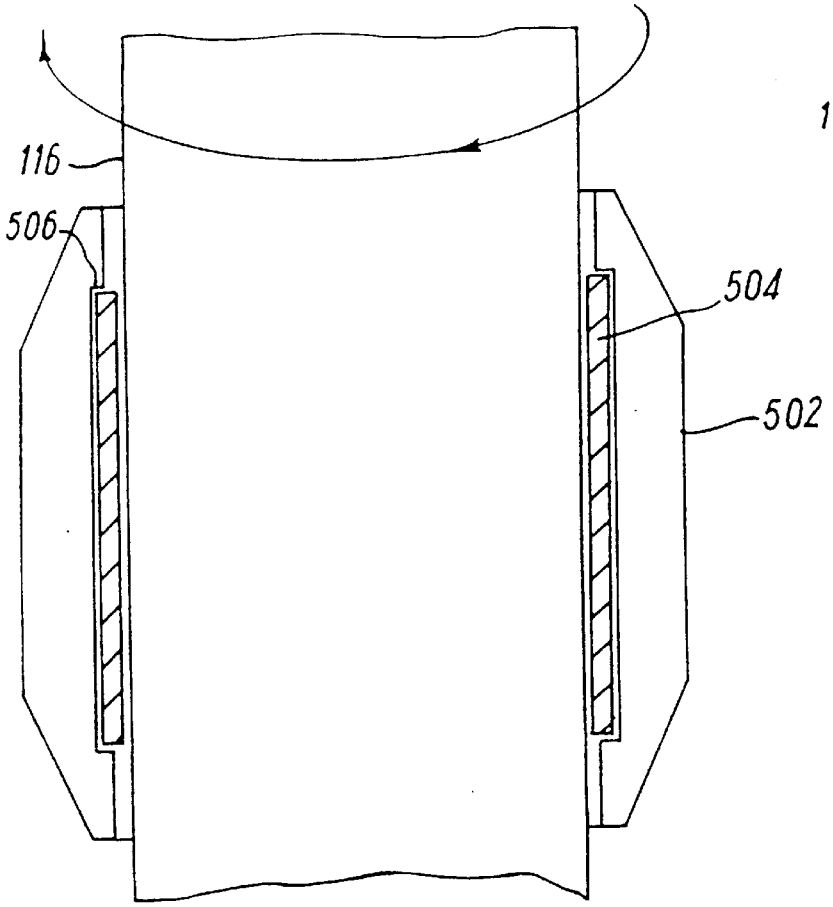
FIG. 11(*a*) is a longitudinal sectional elevation of a fifth embodiment of protector in accordance with the present invention, and FIGS. 11(*b*) and 11(*c*) are enlarged details of FIG. 11(*a*)
Figure 11B:
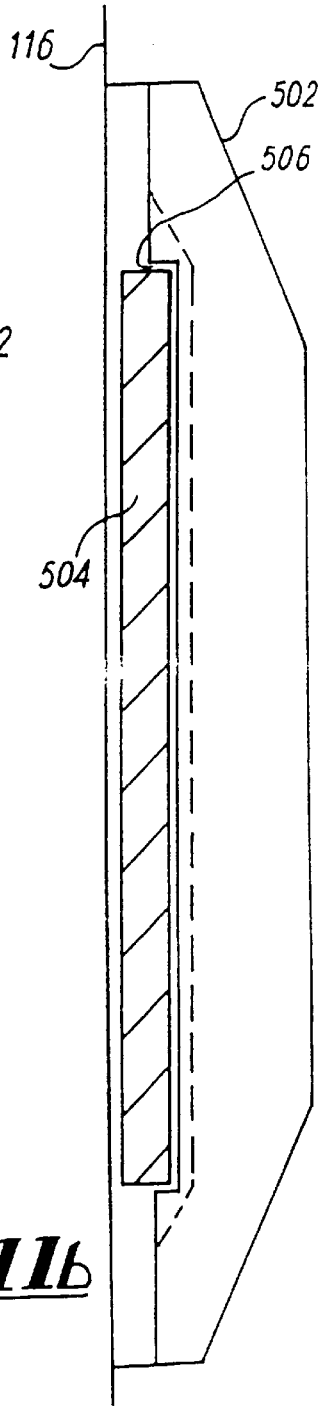
Figure 11C:
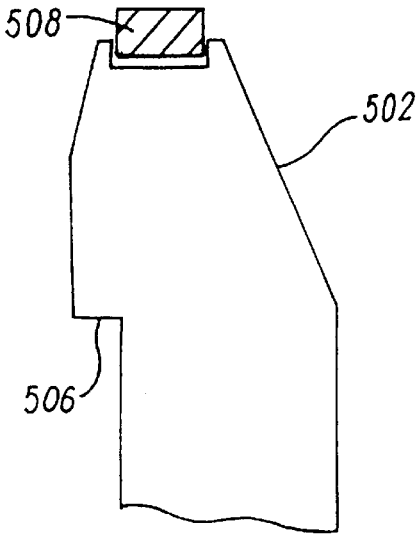

FIGS. 11 (*a*) to (*c*) show a fifth embodiment, comprising an annular body 502 and bush 504 surrounding a pipe string 116. As in the fourth embodiment, the bush 504 is free to rotate with respect to both the pipe string 116 and the annular body 502, but is retained within a rebate 506 in the interior bore of the annular body 502. This embodiment may be used with or without retaining clamps as required.

Suitable clearances and grooves or flutes (not shown) may again be provided on the inner and/or outer surfaces of the bush 302 and/or on the inner surface of the annular body 308 for thin film lubrication/hydrodynamic bearing purposes.

Where retaining clamps are employed, the upper and lower annular faces of the protector may be provided with annular bearing members 508, as shown in FIG. 11(*c*), to reduce friction between the clamps and the protector when in contact. Alternatively, the bearing could be provided on the faces of the clamps. This modification is applicable to all embodiments of protector described herein when used with retaining clamps. The annular bearing members may be formed from the same types of material as the other bearing members previously described, including plastic and elastomeric compounds etc.

The bevelled surfaces of the annular body of this embodiment are also extended somewhat in comparison with previous embodiments. The configuration of the annular body may be varied in this respect in all embodiments, the overall shape of the protectors, and clamps, being selected to minimise the possibility of snagging within the well bore.

Figure 12:
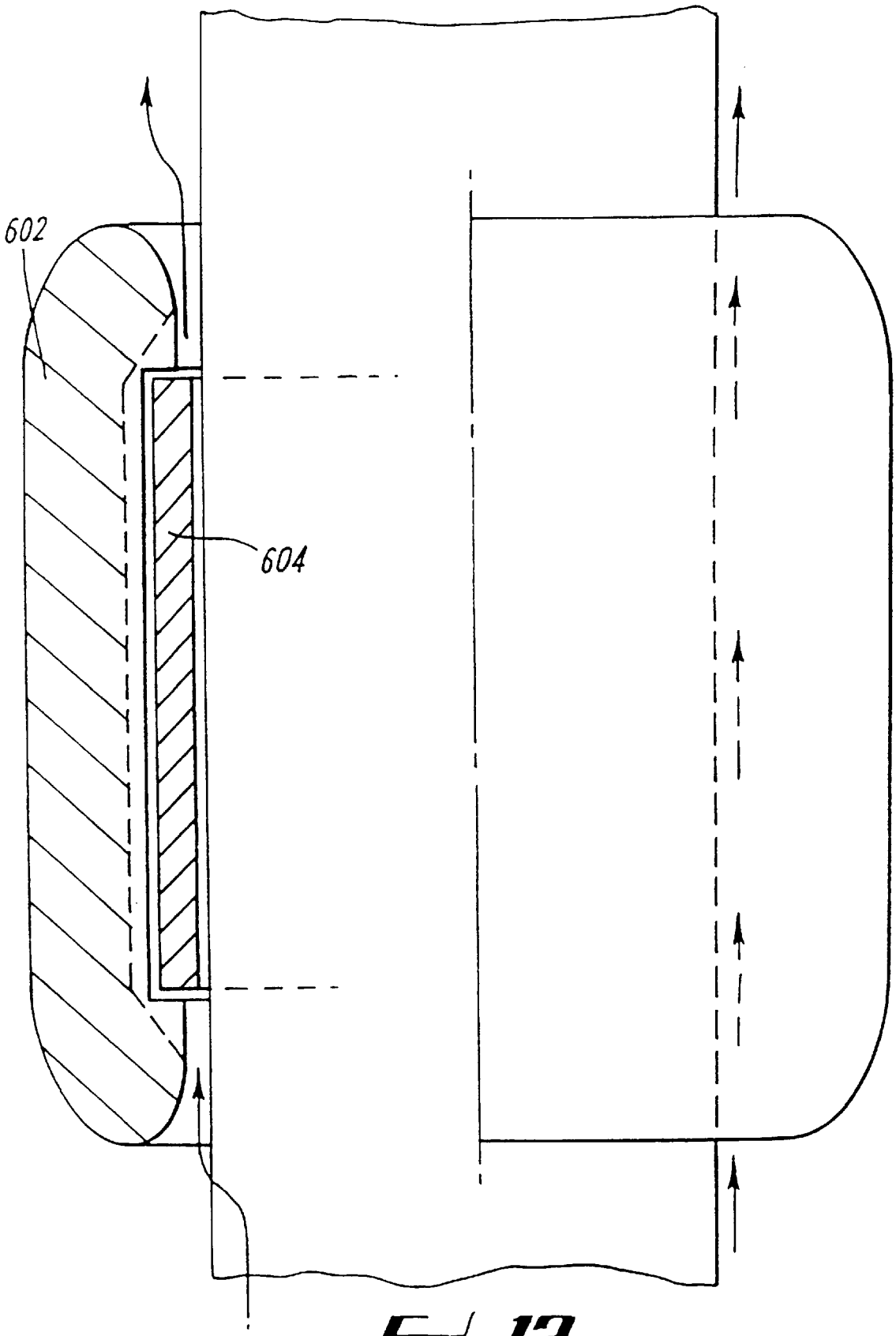
FIG. 12 is a side view, partly in section, of a sixth embodiment of protector in accordance with the present invention.

FIG. 12 shows a sixth embodiment of protector comprising an annular body 602 and bush 604. This is substantially the same as the fifth embodiment except that the end faces of the annular body 602 are arcuate in cross-section, as compared to the generally planar bevelled faces of previous embodiments. This modification is also applicable to other embodiments.

Figure 13:
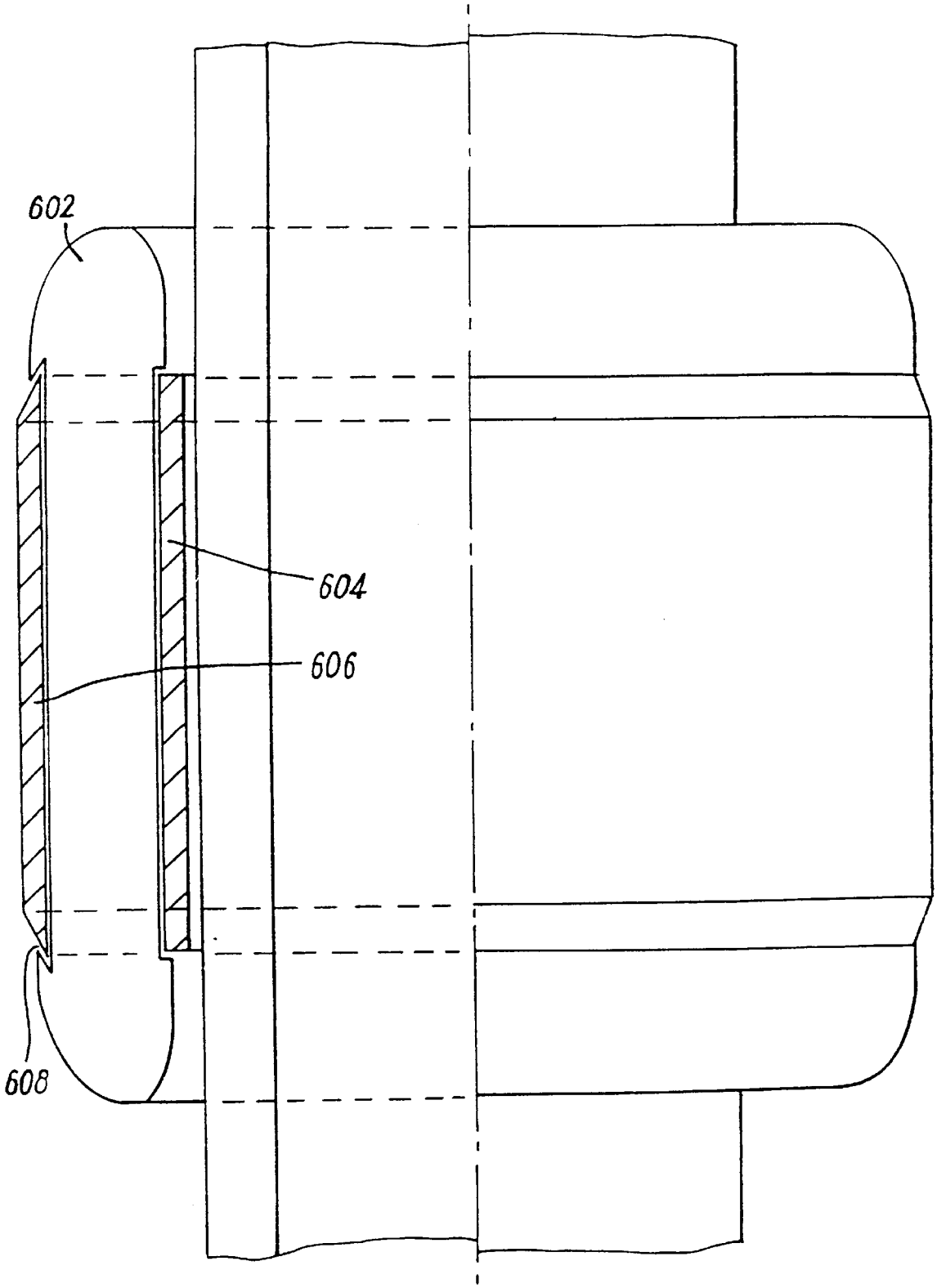
FIG. 13 is a side view, partly in section, of a seventh embodiment of protector in accordance with the present invention.

FIG. 13 shows a variation on the sixth embodiment further including an external bearing member 606 located in an annular rebate 608 on formed in the outer surface of the annular body 602. The upper and lower edges of the external bearing member 606 are bevelled and locate in angled shoulders around the upper and lower peripheries of the rebate 608. This modification is also applicable to other embodiments.

FIGS. 14 to 21 illustrate constructional arrangements showing variations in the manner in which the annular protector bodies of the various embodiments of the invention can be assembled from first and second hemi-annular body sections (as previously referred to in relation to FIGS. 3 and 4). Other features generally applicable to the various embodiments of the invention are also illustrated. These constructions, and certain other features, are also generally applicable to retaining clamps for use in combination with the protector bodies as previously described.

Figure 14:
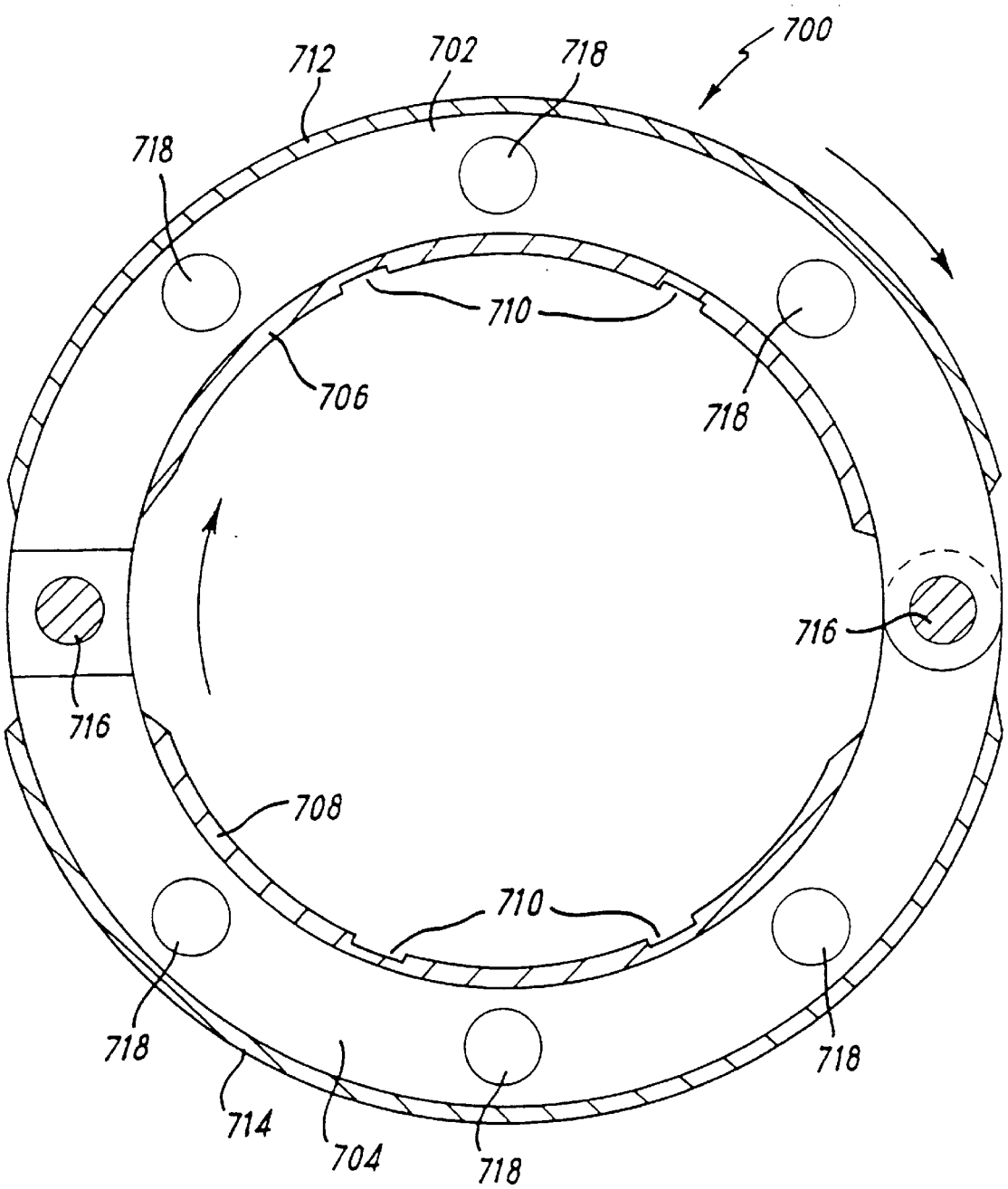
FIG. 14 is a plan view of a protector in accordance with the invention, showing constructional details applicable to several of the embodiments of FIGS. 1 to 13, and also to embodiments of annular clamps in accordance with the invention as shown in subsequent drawings.
Figure 15B:
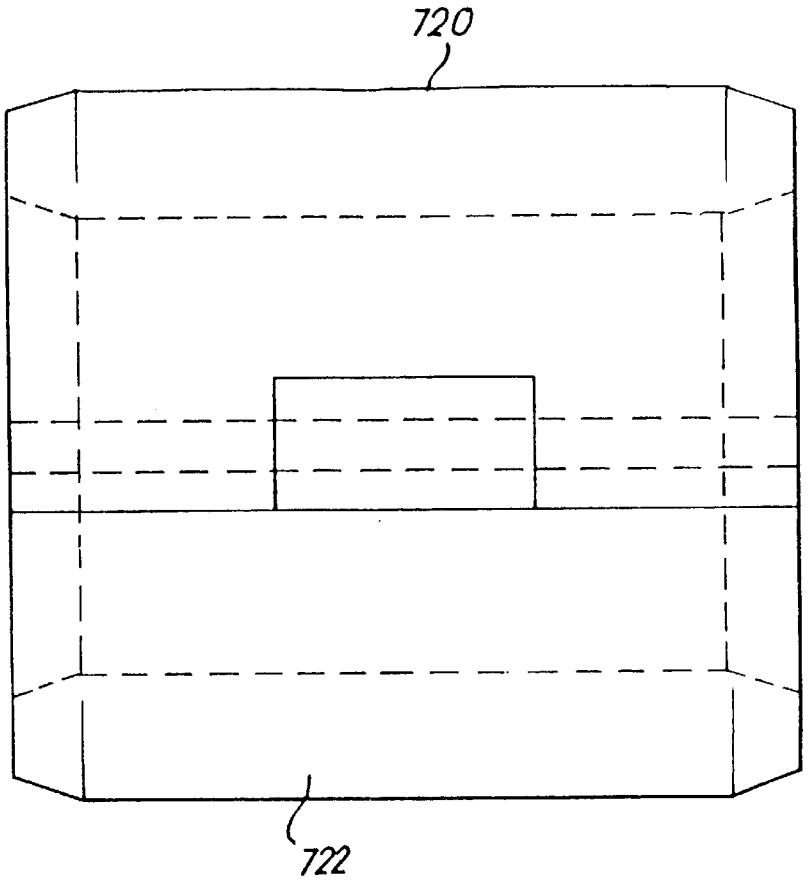
Figure 15A:
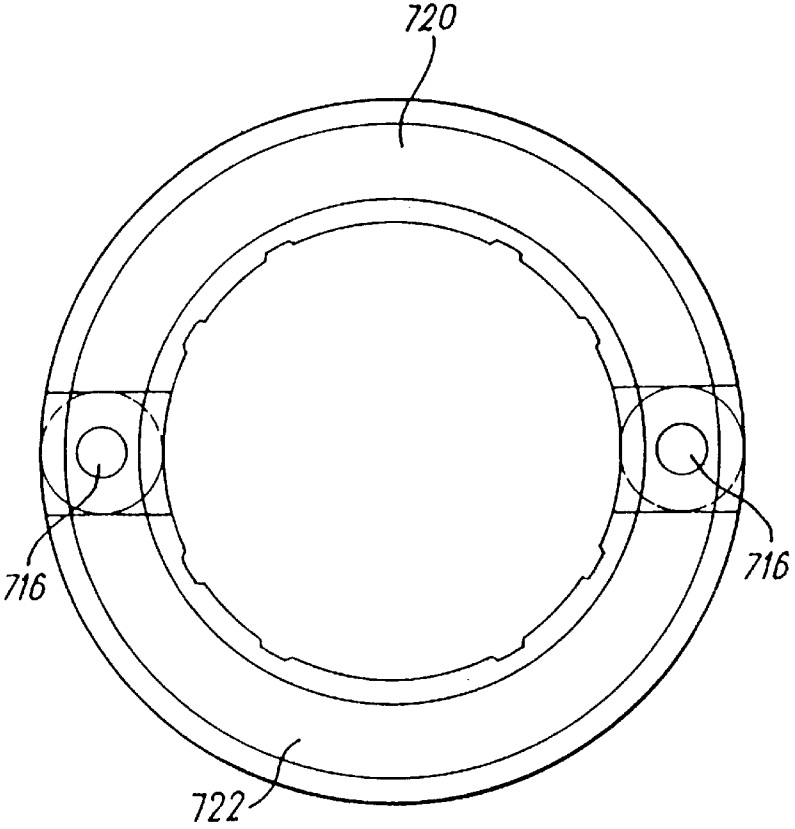
Figure 15C:
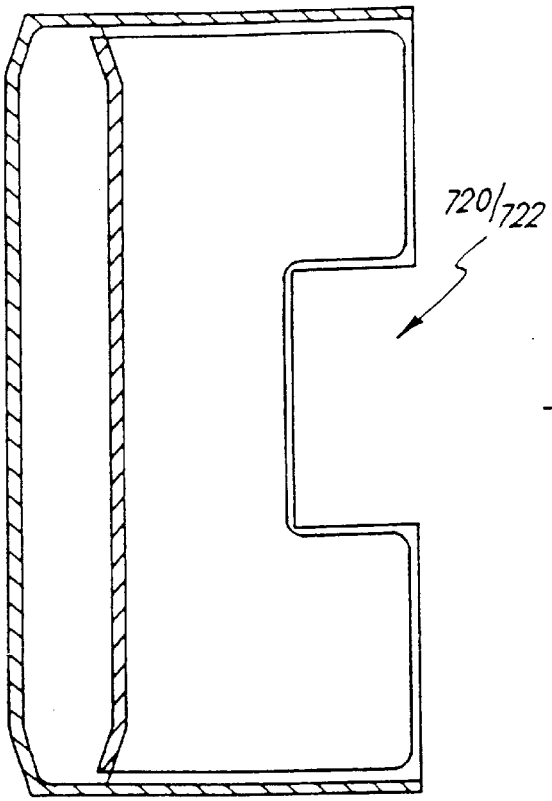
Figure 15D:
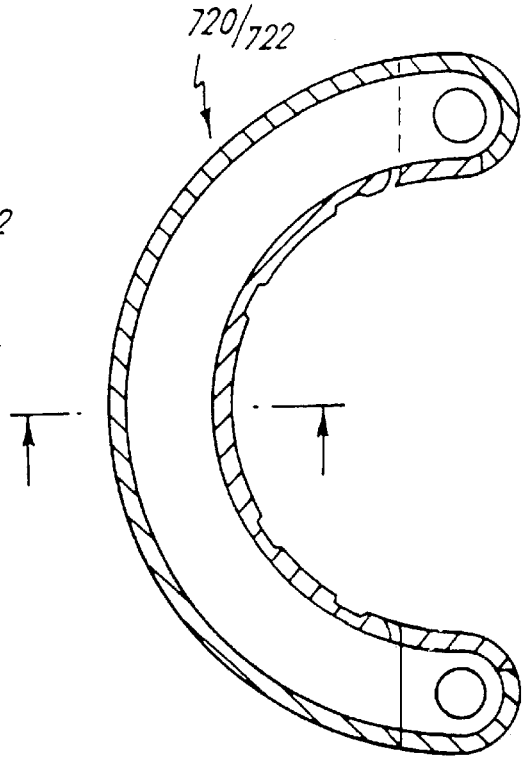
Figure 15E:
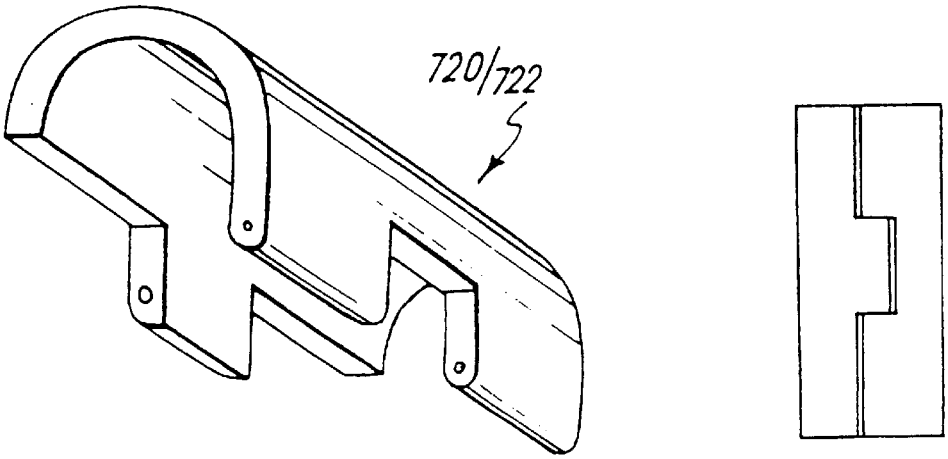
Figure 16A:
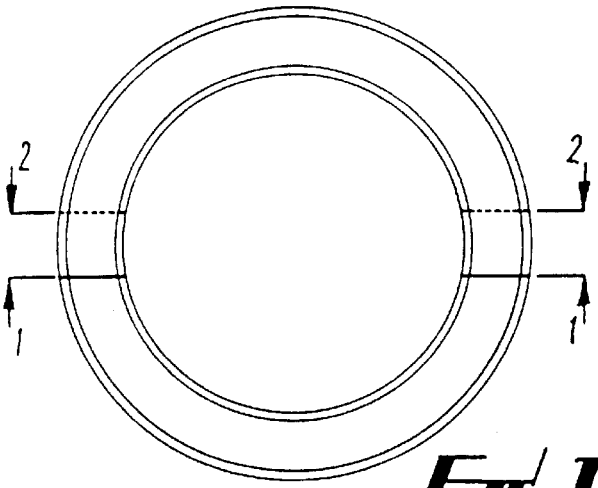
Figure 16C:
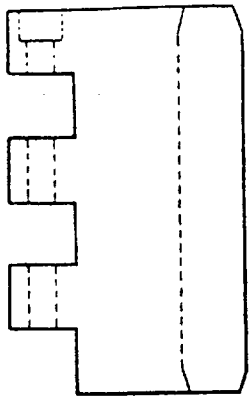
Figure 16B:
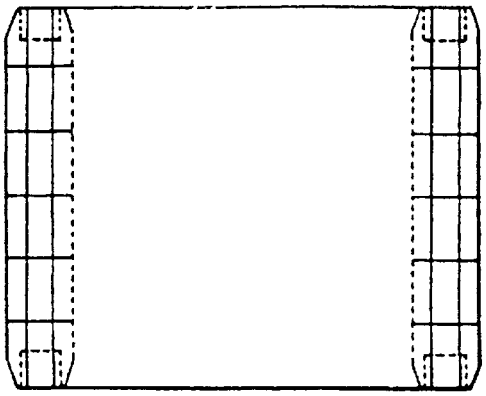
Figure 16D:
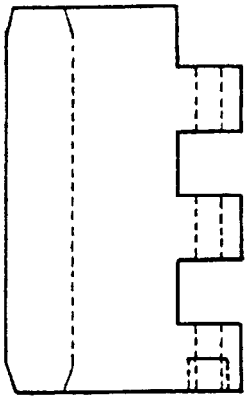
Figure 16E:
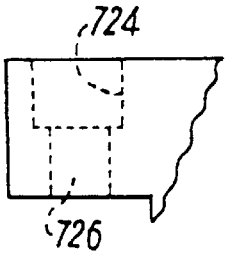
Figure 16F:
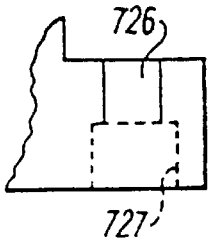
Figure 17A:
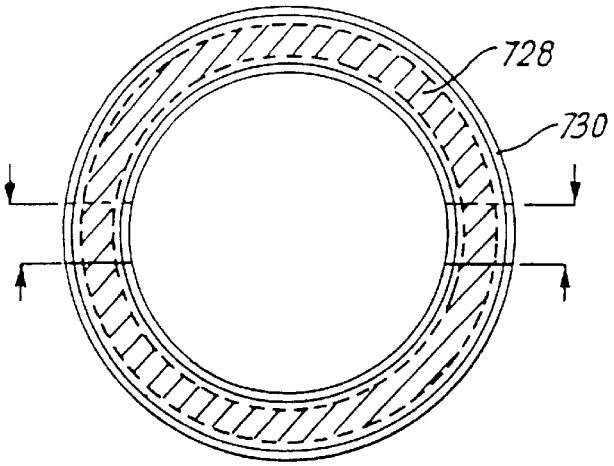
Figure 17C:
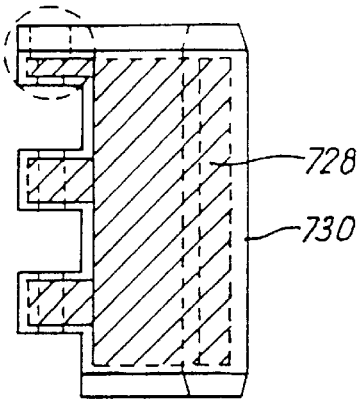
Figure 17B:
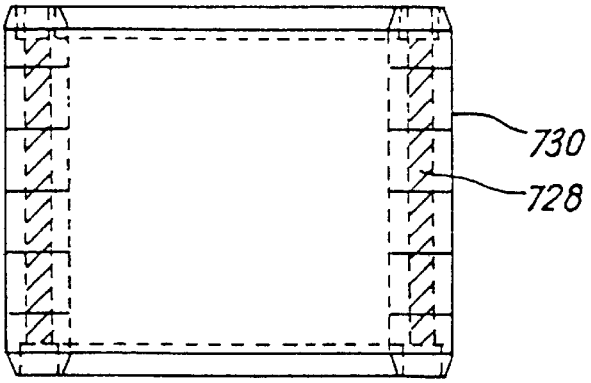
Figure 17D:
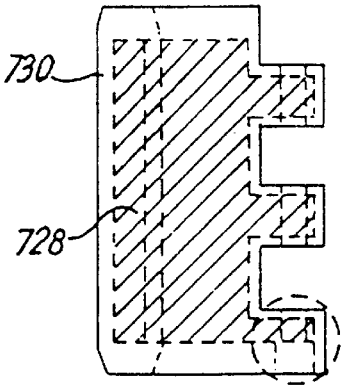
Figure 17E:
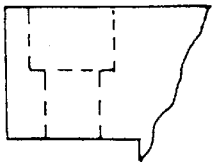
Figure 17F:
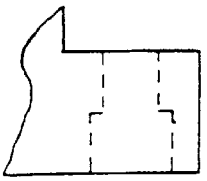

FIG. 14 shows an end view of an annular protector body 700 comprising first and second hemi-annular sections 702 and 704. The protector is shown with internal and external bearing means comprising first and second inner bearing members 706 and 708, having lubrication grooves 710, and first and second outer bearing members 712 and 714. However, the construction of the annular body is not limited to embodiments including such bearing elements, and is also applicable to retaining clamps in accordance with the invention.

The hemi-annular sections are secured together in position around the pipe string by means of pins, roll pins or bolts 716 (referred to herein generally as "pins") extending through bores formed in interengaging portions of the sections 702 and 704. FIGS. 15 to 21 illustrate various arrangements of such interengaging portions. The pins 716 may be retained in place by any suitable means including nut and bolt arrangements, socket-head, philips-head, standard or spline set-screws or cap-screws, spiral retaining rings, spring clips, circlips or pins, helicoil inserts, specially shaped plastic inserts etc. The pins and retaining devices may be treated or coated as required to prevent corrosion, contamination or chemical attack. They may also be formed from such exotic nickel-based alloys as Incoloy, Inconel, Monel and Marinel to prevent corrosion, contamination or chemical attack.

In certain ones of the constructions to be described, the interengaging portions and pin 716 on at least one side of the annular body together provide a hinge arrangement whereby the protector may be partially assembled before presentation to the pipe string and insertion of the second pin at the opposite side. In this case the adjacent ends of the two sections at the hinge side must be configured to allow relative rotation of the two sections about the pin axis between an open and a closed position. In other constructions described below, the two sections remain separate until they are presented to the pipe string and the pins are inserted to secure the sections together.

As is also shown in FIG. 14, the sections 702 and 704 may also be provided with a plurality of through bores 718 to allow free circulation of drilling fluid past the protector. Similar circulating ports may also be provided in the retaining clamps.

FIGS. 15 (*a*)–(*e*) show a first construction in which the two sections 720 and 722 of the annular body each include complementary castellations in their mating edges. In use, the pins 716 are inserted into aligned bores extending through the castellations to secure the two sections together. FIG. 15 (*e*) shows how portions of the mating edges may be rounded to permit the sections to rotate about one of the pins so as to provide a hinge arrangement as referred to above. This version includes a single castellation on each edge. The castellations may be substantially square, as shown, or may be bevelled or rounded as required.

FIGS. 16 (*a*)–(*f*) show a second construction which is a variation on the first, in which three castellations are included on each mating edge. This version further includes hexagonal rebates 724 at one end of the bores 726 through the castellations and cylindrical bores 727 at the other ends of the bores, for use in securing the hinge pins by means of nuts etc. The configuration of such rebates may vary to suit particular retaining devices as previously discussed.

FIGS. 17 (*a*)–(*f*) show a third construction, essentially the same as the second, in which the annular body sections each comprise a core portion 728 formed from a first material, and an outer covering 730 formed from a second material, which is bonded and/or mechanically coupled to the core. The core might suitably be of plastic or alloy and the covering might be a rubber-type compound or plastic. The fabrication of the annular body from two or more materials in this way can also be applied to other constructions of the various embodiments.

FIGS. 18 (*a*)–(*c*) show a fourth construction similar to the third.

FIGS. 19 (*a*)–(*c*) show a fifth construction in which the external surface of the annular body is formed with an arrangement of longitudinally extending flutes or channels 732 to allow free circulation of mud. The arrangement of the flutes can vary and can also be applied to the interior surface of the annular body. Such flutes are applicable to other embodiments and constructions.

FIGS. 20 (*a*) and (*b*) show a sixth construction of hinged hemi-annular sections applied to a protector which is relatively short in the longitudinal direction.

FIGS. 21 (*a*) and (*b*) show a seventh construction of hinged hemi-annular sections applied to a protector which is relatively long in the longitudinal direction.

FIGS. 22 (*a*)–(*c*) show a first construction of a retaining clamp 740 comprising first and second hemi-annular sections 742 and 744 which are hinged together at one side and secured by a plurality (two in this example) of screws or bolts 746 at the other side. In this case the hinge arrangement comprises a plurality (two in this example) of hinge plates 748 located in slots formed in adjacent edges of the hemi-annular sections. Hinge pins 750 are located in longitudinal bores extending through the respective sections and the hinge plates located therein. At the opposite side, the bolts 746 are located in transverse bores extending through the other adjacent edges of the hemi-annular sections.

The number of bolts and hinge plates may vary, and this construction of clamp is also applicable to various embodiments of protector bodies.

FIGS. 23 (*a*)–(*c*) show a second construction of retainer clamp (also applicable to protector bodies) in which hemi-annular sections are hinged at one side by inter-engaging castellations (as in previously described embodiments of protector) and secured at the other side by a plurality (three in this example) of screws or bolt as in the first clamp construction.

However constructed, retainer clamps in accordance with the invention may have their internal surfaces serrated or grooved to assist in gripping the pipe string. The clamps are preferably bevelled as shown, particularly at the ends thereof remote from the protector body, in use. The ends of the clamps adjacent the protector body may be provided with a relatively short bevel, leaving an annular surface to act as a thrust bearing when in contact with the protector. As previously mentioned, further bearing means may be provided between the annular end surfaces of the clamps and the protector. The bevels generally act to prevent snagging of the clamps on obstructions within the well bore.

The provision of bevels on the clamp ends adjacent the protector is particularly desirable in those cases where the clamps are spaced apart so as to allow a range of longitudinal movement of the protector. The clamps may be further provided with grooves, flutes and through bores, as previously described in relation to the protector bodies, to facilitate the circulation of drill fluid as required.

FIG. 51 (sheet 32/51 of the drawings) shows a modification of the screw/bolt connection of the clamps of FIGS. 22 and 23. A tubular shroud 940 of compressible material such as plastic or rubber is located in annular recesses 942 formed in the adjacent end faces of the clamp sections 944, 946 around the ends of the screw receiving bore. The shroud 940 is thus located between the end faces of the clamp sections and surrounds a portion of the shank of the screw 948 extending therebetween. The shroud 940 compresses upon tightening the screw 948, sealing against the recesses 942 and isolating the shank of the screw 948 from the external environment. The shroud 940 could be employed without the recesses 940.

Particularly preferred materials for the clamp means are: aluminium alloy, copper alloy, zinc, zinc alloy or iron alloy.

FIGS. 24 (*a*) and (*b*) show a further construction of protector body in which the two hemi-annular sections 752 and 754 are secured together by means of high strength metal plates 756 located in recesses formed in the mating edge faces of the section 752 and 754. Pins 758 are inserted in bores extending through either end of the plates 756 to secure the sections together. Spacer elements 760 of rubber, plastic, metal or alloy may be located between the mating surfaces if required. The plates at one or both sides may also be configured as hinge plates as in the clamp construction of FIG. 22, and this protector construction is also applicable to retainer clamps. The number of plates may be varied as required, and the end surfaces of the hemi-annular sections may be modified so as to allow the pins and plates to operate as hinges.

FIG. 25 is a perspective view of one hemi-annular section 762 of a protector similar to that of FIG. 24, with metal plates 756 and a spacer/seal elements 760 in location.

FIGS. 26 (*a*)–(*c*) show an alternative construction of clamp (or protector) comprising two hemi-annular sections 770 and 772 hinged together at one side by any of the hinge arrangements described above. The outer surfaces of the sections are formed with shaped recesses 774 and 776 adjacent their mating surfaces, which recesses are configured to receive a high tensile steel clip 778 (FIG. 26 (*c*)) which secures the clamp in position.

FIG. 27 shows a perspective view of the clip 778 and FIGS. 28 (*a*) and (*b*) show a tool 780 for installing and removing the clip. The clip 778 has an aperture 782 formed therein, which aligns in use with a notch 784 formed in one of the recesses 774, 776 of the clamp sections. This allows the clip 778 to be engaged by a hook portion 786 of the tool 780, whereby the clip 778 may be levered in and out of engagement with the clamp sections.

FIG. 29 illustrates an alternative configuration of protector body 787. In this case the inner surface is provided with a plurality of grooves or flutes 788 which are arcuate in transverse cross section. The external surface comprises a series of arcuate section segments 790 defining a plurality flutes or grooves 792 at the junctions thereof. This configuration provides high annular flow and high strength, and may be formed from similar materials as previous embodiments, in two hemi-annular sections as with any of the previously described constructions.

FIGS. 30 (*a*) and (*b*) show still a further embodiment of protector utilising an alternative rotary bearing arrangement.

The example shown has a general configuration similar to the embodiment of FIG. 11, an inner sleeve 800 being retained within a rebate formed in the inner surface of the annular protector body 802. The inner sleeve 800, which may be formed from the same types of material as previously described bearing members, is provided with a first set of O-rings or other suitable seals 804 which form seals, in use, between the drill pipe 806 and the inner surface of the sleeve 800.

The annular body, which may be formed from the same types of materials as any of the preceding embodiments, also includes a second set of O-rings or other suitable seals 808, which form seals, in use, between the drill pipe 806 and the ends of the inner surface of the annular body above and below the rebate which accommodates the inner sleeve. A sealed volume is thus defined between the protector and the inner sleeve.

FIG. 30 (*a*) is a perspective view of one of two hemi-annular sections 814 forming the annular body in this embodiment, showing how the second set of seals 808 extends along the mating end faces of the sections to completely close the sealed volume. The two sections can be secured together around the pipe by any appropriate means selected from those previously described, particularly the examples shown in FIGS. 22, 24 and 26.

In use of this embodiment, a fluid lubricant, preferably a gel type, is introduced into the sealed volume via an inlet port 810 extending through the annular body, the port 810 being provided with a suitable plug or valve 811. A plugged or valved bleed port 812 is also provided. The lubricant is initially pressurised to force the inner sleeve tightly around the pipe to the extent of partially or completely restricting movement of the entire assembly, and at the same time filling the sealed volume between the annular protector body and the inner sleeve. Subsequently, the pressure is adjusted to allow the protector body to rotate relatively freely with respect to the drill pipe and the inner sleeve.

The embodiment of FIG. 30 may also incorporate additional features of the annular body described in relation to other embodiments, including composite material construction, through bores for fluid passage, external grooves and flutes, external bearing material and the like, and the overall shape of the protector may also vary as previously described.

The complete assembly may be retained in place on the pipe by the lubricant pressure, and/or by other means (such as a rough surface finish) securing the inner sleeve to the pipe, and/or by means of retaining clamps as in previously described arrangements.

In the foregoing description of embodiments of the invention, a wide range of materials suitable for use as the various bearing elements have been discussed. The use of "sacrificial self-lubricating" materials such as low friction thermoplastics, with or without lubricant filler materials, and metals, again with or without lubricant fillers or plugs, is particularly preferred for the bearing elements, in view of certain characteristics of such materials as shall now be discussed.

Assuming that the bearing is in contact with a limited area, the bearings of this type will form a low friction contact surface by sacrificially wearing and depositing the lubricating element, incorporated into the bulk of the material, onto the opposing contact surface.

This form of lubrication works on a molecular level by filling in the microscopic troughs that are found on even the most seemingly smooth surfaces. This results in two surfaces effectively coated with a lubricating element rubbing against each other with reduced friction and wear rates. This form of lubrication is characterised by relatively high wear and friction during an initial period of operation, referred to as the "run-in" period.

All surfaces in frictional contact tend to heat up, and one limiting factor of thermoplastics is that they are thermal insulators and thus retain heat very well. Under excessive loads, thermoplastics may heat up to the point where they start to melt. This is called "thermal runaway" and is typically found in situations where no lubricating liquid is used. This effect limits the loads which a thermoplastic can take, at given speeds, in dry operation. This limit is called the PV (Pressure Velocity) limit. This may be less of a problem with other types of sacrificial, self-lubricating materials such as metals.

However, when a lubricating liquid is applied, the liquid absorbs heat generated by friction and conducts it away from the contact surfaces. The greater the flow of liquid, the greater will be the heat dissipation effect. A viscous liquid such as oil, retains heat longer and will thus have a reduced cooling effect for a given rate of flow. Water, on the other hand, cools down more quickly and is easier to pump than more viscous liquids, and thus makes a more effective circulating coolant.

With regard to metals, some metals such as leaded bronzes (including gun metal) may behave in this manner in their own right. Otherwise, most metals can be made to be self-lubricating to some degree by adding lubricating filler materials thereto; eg by sintering or casting. Plugs of lubricant material can also be embedded in the bearing surfaces.

Further examples of particularly preferred embodiments of the invention will now be described, incorporating combinations of features previously discussed above, together with additional features which may also be applicable to previously described embodiments.

FIG. 31(*a*) shows a side view of a preferred form of protector 820 and (optional) retaining clamps 822 mounted on a drill pipe 824. FIGS. 31(*b*) and 31(*c*) show end and side views respectively of one half of the protector 820. The protector 820 comprises an annular body 826 formed in a split ring configuration as before, suitably hinged at one side and united with a pin, screw, bolt or the like at the other. The annular body 826 is provided with bevelled surfaces 828, 830 at either end thereof around both its inner and outer peripheries, and the inner surface is provided with longitudinally extending grooves or flutes 832.

The protector further includes bearing elements suitably of the same types and materials as previously described, namely: an inner bearing 834 secured to the inner surface of the annular body 826, formed in two hemi-annular parts and having grooves or flutes 836 corresponding to those 832 of the annular body 826; an outer bearing 838 secured to the outer surface of the annular body 826, also formed in two hemi-annular parts and being bevelled around its upper and lower edges 838*a* and 838*b*; and first and second rim bearings 840 secured to the end surfaces of the annular body 826 between said inner and outer bevelled surfaces 828, 830.

Where any of the bearing elements forming part of embodiments of the invention are described as having bevelled or radiused edges it will be understood that there may be circumstances in which it is preferable that such edges are right-angled, without bevels or radiusing.

All of the bearing elements 834, 838, 840 are preferably mounted in corresponding recesses formed in the annular body 826, and may be fixedly secured in place or may be loose fitting. They may be retained by virtue of their interengagement with the recesses in the annular body, by mechanical means, or by bonding (eg using high temperature epoxies) or by any combination of these.

FIG. 31(*d*) illustrates a possible arrangement for the mechanical fixing of the outer bearing 838 to the annular body 826, in which the bearing element 838 is held in place by a fixing member 842 having an angled face which bears on the bevelled surface 838*a* of the bearing element 838 and which is secured to the annular body 820 by means of screws or the like 844. Similar arrangements might be applied to the other bearing elements.

The bevelling of the outer periphery of the ends of the annular body 826 and of the outer bearing 838 assists in deflecting the protector 820 from downhole obstacles so as to minimise damage caused thereby and also promotes smooth flow of fluid between the protector and the borehole or casing.

The retaining clamps 822 are of the same general type as previously described and are preferably formed from aluminium or AB2 or other materials as previously discussed having good mechanical and anti-corrosive properties. The clamps 822 are again formed in a split-ring configuration using hinges and/or screw/bolt fasteners. The longitudinal ends of the clamps 822 are preferably substantially perpendicular to the drill pipe 824 and have an outside diameter less than that of the protector 820. They are also preferably configured, for example by the provision of bevelled or arcuate surfaces around the peripheries of their longitudinal ends, so as to avoid snagging on downhole obstructions and to channel lubricating fluid into the clearance gap between the protector 820 and the drill pipe 824. The clamps 822 may further be provided with internal fluid flow flutes as previously discussed for this latter purpose. The rim bearings 840 of the protector provide low friction contact between the protector 820 and clamps 822 upon relative thereof.

FIG. 32 shows a partial cross section through a protector 820 mounted on drill pipe 824 within a borehole or borehole casing 846, showing the location of the inner, outer and rim bearings 834, 838 and 840 in their corresponding recesses formed in the annular body 826. In this illustration the clamps 822 are omitted, and the protector is shown abutting a joint portion 848 of the drill pipe 824, which prevents the further movement of the protector 820 along the pipe. The inner bevelled surface 828 of the annular body 826 contacts the surface of the tool joint 848 and may be provided with a further bearing element, taper bearing 850 located in a corresponding recess in the bevelled surface 828. A similar taper bearing is located at the other end of the protector 820.

As noted above, the overall configuration of the protector is designed to avoid unnecessary restriction of fluid flow and to ensure the flow of lubricating fluid between the protector and the borehole and through the clearance gap between the protector and the drill pipe, and to avoid snagging on obstructions.

The inner bearing 834 is preferably a floating bearing; ie rotatable with respect to the annular body 820 and drill pipe 824, being maintained in position by the shoulders of the recess in which it is located. Free movement of the inner bearing 834 relative to the annular body and the drill pipe is promoted by providing small clearance gaps between it and both the annular body and the drill pipe, so as to allow the smooth flow of fluid to cool, lubricate and flush the relative bearing surfaces. The clearance gaps between the relative surfaces in combination with the centrifugal forces generated by rotation of the drill pipe and the fluid viscosity and flow rates are such as to allow hydrodynamic/elastrohydrodynamic and mixed lubrication behaviour up to a pre-calculated design load to take place between the bearing 834 and the annular body 820 and between the bearing 834 and the drill pipe 824. This effect also has the additional benefit of allowing the protector to act as a vibrational dampener when operating in this phase. The inner bearing 834 is preferably formed from a material such as thermoplastic material or other material as previously discussed, which, in the event of the design load being surpassed and the lubricating fluid film being broken (ie once surface to surface contact takes place between relatively rotating surfaces), would self-sacrifice and wear preferentially with regard to the relative rotating member and provide a self-lubricating effect by depositing lubricating material on the other member. The bearing 834 is thus designed to be both expendable and easily refurbishable. Although preferably floating, the inner bearing 834 can also be fixed to the annular body 820.

Where sacrificial self-lubrication is required, the bearing can be formed from any of a range of materials possessing the required tribology characteristics as discussed above. Particularly preferred are PEEK, PPS, ORKOT, NYLON 6& 66& 11& 12& and ACETAL. An example of an inner bearing element 834 is shown in FIG. 33(*a*) (*b*) and (*c*). One such element would be applied to each half of the annular body 826.

The outer bearing 838 is secured in a recess in the outer surface of the annular body 826, the ends of the bearing being bevelled or radiused as discussed above to promote fluid flow and avoid snagging. The outer bearing provides low friction contact between the borehole/casing and the protector 820, such that the protector 820 may at times rotate relative to the borehole and at other times may in be non-rotating, sliding contact with the borehole. The outer bearing operates generally and may provide self-lubrication in the same way as the inner bearing 834, and may be formed from the same or similar materials. An example of an outer bearing member 838 is shown in FIGS. 34(*a*), (*b*) and (*c*). Again, one such member would be fitted to each half of the annular body 826.

The rim bearings 840, providing low friction contact between the ends of the protector 820 and the clamps 822 (when used), so that the protector is always free to rotate with respect to the clamps. The rim bearing operates generally and may provide self-lubrication in the same way as the inner bearing 834, and may be formed from the same or similar materials. An example of rim bearing members 840 is shown in FIGS. 35(*a*), (*b*) and (*c*).

The taper bearings 850 may also have bevelled/radiused edges to promote smooth fluid flow and to deflect debris. Their primary function is to provide low friction contact between the bevelled end surface 828 of the annular body 826 and the surface of the tool joint 848. The taper bearing operates generally and may provide self-lubrication in the same way as the inner bearing 834, and may be formed from the same or similar materials.

Additional aspects of the configuration of the protector, which may be incorporated into any of the preceding embodiments, will now be discussed in relation to FIGS. 36(*a*), (*b*) and (*c*).

FIG. 36(*a*) shows a partial sectional view of a protector 852 mounted on a drill pipe 854 between a pipe joint 856 and a clamp 858, inside a borehole/casing 860. The following aspects of the configuration will be discussed in relation to the surfaces of the protector body, but are equally applicable to surfaces of bearing elements mounted on the corresponding surfaces of the protector body.

FIG. 36(*b*) is an enlarged view showing the clearance gap between the inner bevelled surface 862 of the protector 852 and the surface of the pipe joint 856. As shown, in an exaggerated manner, the bevel angle of the protector surface 862 with respect to the side of the protector body is selected to be slightly greater than the angle of the pipe joint surface with respect to the drill pipe surface, so that the bevelled surface and pipe joint surface are just off parallel with one another and diverge slightly towards the end of the protector. This promotes the build up of a lubricating film of fluid between the surfaces, preventing the two surfaces sealing together and maintaining fluid flow between the drill pipe and the internal diameter of the protector. The use of sacrificial self-lubricating bearing materials in the bearing surfaces, as aforementioned, would prevent sticking and minimise torque/drag build-up by keeping the friction between the contacting surfaces as low as possible in the event that the fluid film is destroyed by excessive loads.

FIG. 36(*c*) is a second enlarged view showing the clearance gap between the end surface 864 of the protector 852 and the surface of the pipe clamp 858. As shown, again in an exaggerated manner, the end surface 864 is disposed at an angle which is slightly off perpendicular to the drill pipe, so that the bevelled surface and the clamp end surface are just off parallel with one another and diverge slightly towards the drill pipe. This again promotes the build up of a lubricating film of fluid between the respective surfaces. Sacrificial self-lubricating bearing materials can be employed in the bearing surfaces, as above and for the same reasons.

FIGS. 37(*a*), (*b*), (*c*), (*d*) and (*e*) show variations applicable to the clearance gap between the internal diameter of the protector and the drill pipe. FIG. 37(*a*) is a partial sectional view showing the protector 866 mounted on a drill pipe 868 inside a borehole/casing 870.

FIGS. 37(*b*), (*c*), (*d*) and (*e*) are enlarged views of the clearance gap between the protector and the drill pipe, showing different configurations of the internal surface of the protector. In FIG. 37(*b*) the internal bore of the protector is formed with a slight taper so that its internal surface is slightly off parallel with the drill pipe. In FIG. 37(*c*) the internal bore of the protector is parallel with the drill pipe. In FIG. 37(*d*) the internal bore of the protector is formed with a jagged edge effect which is parallel with the drill pipe. In FIG. 37(*e*) the internal diameter has a rippled edge effect which is parallel with the drill pipe. These configurations may be applied to the protector body and/or to bearing elements mounted thereon, and sacrificial self-lubricating materials may be employed therewith.

FIGS. 38(*a*) and (*b*) show sectional end views of a protector 872 mounted on a drill pipe 874, with an inner bearing element 876 located therebetween in a recess formed in the internal bore of the protector (indicated by a broken line). The bearing element is free floating with clearance gaps between the bearing element and the protector and between the bearing element and the drill pipe. In FIG. 38(*a*) the bearing has a smooth surface around its inner and outer circumferences. In FIG. 38(*b*) the bearing has a rippled surface around its outer and inner circumferences. If the bearing element was fixed to the protector, its inner circumference only might be rippled. Again, sacrificial self-lubricating materials might be used for such bearing elements.

FIGS. 40(*a*)–(*j*) schematically illustrate a number of different configurations of fluid flow channels which might be applied to the inner bore of the protector (or inner bearing) or, if inverted, to the outer surface of the protector (or outer bearing). These include various configurations of grooves and flutes which would be formed in the surface of the protector body (or bearing element) which allow passage of fluid and which provide enhanced lubrication under various conditions, and three types of fluid channel (FIGS. 40(*e*), (*h*) and (*j*)) which would be formed through the protector body and are concerned only with fluid passage. Grooves, flutes and passages of the types shown in FIG. 40 might also be applied to the annular clamps.

FIGS. 39(*a*)–(*f*) show a number of possible assembly configurations in which protectors and clamps in accordance with the invention might be employed on a length of pipe. FIG. 39(*a*) shows a protector free floating without clamps, allowing longitudinal movement between pipe joints. FIG. 39(*b*) shows a protector free floating between two clamps, allowing longitudinal movement therebetween; the position of the clamps on the pipe might be varied. FIGS. 39 (*c*) and (*d*) show two fixed position assemblies at different positions on the pipe, in which the position of the protector is fixed by two closely adjacent clamps. FIG. 39(*e*) shows an arrangement of two protectors and three clamps, the protectors being free floating between respective end clamps and a common central clamp (alternatively the protectors might be free floating between a single central clamp and respective pipe joints). FIG. 39(*f*) shows an arrangement for ultra high loads with three fixed position assemblies each of one protector and two clamps on a single pipe length. Other variations in the combination of protectors, clamps and their relative positions will be apparent.

FIGS. 41 to 43 show preferred configurations of clamps 822 of the type shown in FIG. 31(*a*). FIGS. 41(*a*), (*b*) and (*c*) show one example in which the halves of the clamp are connected at one side using a castellated hinge 878 arrangement as previously described and the other side is connected by bolts 880 or the like in transverse bores, also as previously described. FIGS. 42(*a*), (*b*) and (*c*) show a similar clamp in which the halves are connected at one side by a double hinge arrangement 882 as previously described and at the other side by bolts 884 or the like as in FIG. 41. The clamps of both FIGS. 41 and 42 are bevelled around their upper and lower outer ends to promote fluid flow and to prevent snagging, and have internal grooves or flutes 886 to allow fluid passage. FIGS. 43(*a*), (*b*) and (*c*) show a further clamp similar to that of FIG. 42, further including an internal insert 886 of a material having a coefficient of thermal expansion differing from that of the clamp body. If the coefficient of the insert is greater than that of the body, then the differential expansion of the body and insert will produce a preload in the fastening means securing the clamp halves together, thereby reducing the problem of thermal slackening. Conversely, if the coefficient of the insert is substantially less than that of the body and of the drill pipe then an increase in temperature produces an increased clamping force on the drill pipe, again reducing the problem of thermal slackening.

FIGS. 44 to 48 show alternative preferred configurations of annular protector bodies, which can be formed from metals or plastics of the types previously referred to.

FIGS. 44(*a*), (*b*), (*c*) and (*d*) show one of two identical halves 888 of a protector body with bevelled surfaces on the inner and outer surfaces thereof. The inner bevel angle may be selected to be just off parallel with the pipe joint angle as discussed above. Grooves or flutes 890 are also formed on the inner surface as previously discussed, and the ends of the hemi-annular half are configure to provide a castellated hinge as has also been discussed previously. This embodiment is intended to be formed without separate bearing elements, from any of the metals, plastics or elastomers previously defined, and may be coated with coating materials as previously defined.

FIGS. 45(*a*), (*b*), (*c*) and (*d*) illustrate one half 892 of a protector body similar to that of FIG. 45 except that the ends of the body are radiused instead of bevelled, and that the body further includes fluid passages 894 extending therethrough as previously discussed. Such passages serve to reduce the obstruction presented to fluid in the borehole by the protector and thereby reduce the swab and surge effect of liquid in the hole, and also serve to reduce the weight of the protector.

FIGS. 46(*a*), (*b*), (*c*) and (*d*) illustrate one half 896 of a further embodiment of a protector body similar to that of FIG. 46 except that the fluid passages are omitted and the body is provided with a recess 898 on its inner surface for mounting a fixed or floating inner bearing member of the type previously discussed.

FIGS. 47(*a*), (*b*), (*c*) and (*d*) illustrate one half 900 of a further embodiment of a protector body similar to that of FIG. 46 but also including fluid passages 902 as in FIG. 45.

FIGS. 48(*a*), (*b*), (*c*) and (*d*) illustrate one half 904 of still another embodiment of a drill pipe protector similar to that of FIG. 46, including an inner recess 906 for an inner bearing member, and further recesses 908, 910 on its outer and both end surfaces respectively for receiving outer and rim bearing members as previously discussed. Such a protector might also be provided with fluid passages as shown in FIGS. 45 and 47.

FIGS. 49 and 50 illustrate a further variation of the invention in which the protector bodies are formed from more than two part-annular sections.

FIG. 49 shows a protector body 910 formed from three part-annular sections 912, 914, 916, of equal size, with the sections 912 and 914 connected together by interleaved castellations and a hinge pin 918, as previously described in relation to other embodiments, and the third section 916 connected to both sections 912 and 914 by means of interleaved castellations and set screws 920.

FIG. 50 shows a further protector body 922 formed from two relatively long part-annular sections 924, 926 and two relatively shorter part-annular sections 928, 930. The two longer sections 924, 926 are connected together at one end by interleaved castellations and a hinge pin 932, as are the two shorter sections 928, 930. The other ends of the longer sections are connected to the respective other ends of the shorter sections by interleaved castellations and set screws 934.

Other arrangements of multi-part bodies may be envisaged, using any of the means of connecting body sections as previously discussed herein. Such protectors may be formed from any of the materials previously discussed, and may incorporate features such as the various types of bearing elements, body shapes, grooves or flutes, fluid passages etc, suitably adapted, as have been described in relation to other embodiments.

A further variation of the invention, not illustrated, is as follows. Where the inner bearing is formed as a separate element from the annular protector body, first and second (or more) separate, concentric bearing elements may be employed. For example, one such element might be fixed to the annular body and the second be a floating element between the first element and the drill pipe. Alternatively, the first element might be fixed to the drill pipe and the other be free floating between the first and the annular body. As a further alternative, one element might be fixed to the annular body and the other fixed to the drill pipe. A third element might be employed free floating between the first and second elements, which might be fixed to the drill pipe and/or annular body as noted above. The clearances between the adjacent bearing elements can be selected to promote thin film lubrication therebetween, and adjacent bearing surfaces may be provided with grooves or flutes etc as discussed in relation to the other types of bearing surfaces described herein, and formed from low friction/sacrificial materials. The use of multiple concentric bearing elements of this type will further reduce friction between the annular protector and the drill pipe.

The invention thus provides improvements relating to various aspects of the configuration and constructional details of pipe protectors and associated retaining clamps.

The various configurations of protector bodies and bearing arrangements described all serve to reduce the rotational friction between the pipe and the well bore or casing, and to reduce the longitudinal drag or friction as the drill string is raised or lowered. The external configurations of the protector and clamps also reduce drag associated with snagging or hanging up in the bore or casing. Together, these factors provide for unhindered movement of the drill string through a given length of casing or open hole.

The configuration of the protector body and adjacent clamps to promote thin film lubrication, and the selection of materials which exhibit inherently low friction and/or sacrificial self-lubricating properties further assist in this regard. The clearance gap between the inner bearing of the protector body and the drill pipe is selected to promote thin film lubrication up to a certain load, whereafter the selection of bearing materials provide a low friction contact bearing, preferably by sacrificial self-lubrication. This "mixed-lubrication" operation of the preferred embodiments provides a protector which will minimise rotational torque over as wide a range of operational loads as possible.

The provision of a low friction outer bearing is also advantageous in reducing longitudinal drag between the protector and the borehole/casing when raising or lowering the drill string in the borehole.

The number of protectors applied to each joint of the drill string can be varied according to need; eg to suit requirements in severe dogleg sections, highly angled or very deep wells, horizontal drilling, formation problems, particular well bore configurations, or combinations of these. Protector assemblies in accordance with the invention may also be advantageously applied in conventional straight wells.

It is to be understood that features of the various embodiments and constructions may be applied to other embodiments as noted in the foregoing description and that constructional details described in relation to protector bodies may be applied to retaining clamps, and vice versa, also as noted. Generally, the various features described may be used in different combinations according to need, and the various aspects of the invention are applicable to protector assemblies dimensioned to suit drill pipes and well bores of differing diameters.

Other modifications and variations can be adopted without departing from the scope of the invention.

We claim:

1. A protector assembly for a pipe string movable within the bore of a well, said protector assembly comprising a generally annular body internally dimensioned to fit around said pipe string and externally dimensioned to fit within said bore, said body being formed from a first material or materials, and further comprising bearing means interposed between said annular body and said pipe string so as to permit free rotation of said pipe string relative to said annular body in the event of said annular body contacting the surface of said bore, wherein said annular body is formed from a rigid material in at least two, hingeably connected, part-annular sections each having first and second matting end surfaces which are secured together around the drill pipe, said bearing means includes a bush adapted to be secured around the drill pipe, said bearing means includes a bush adapted to be secured to an external surface of said pipe string, in used, by means of first and second annular clamp means located above and below said annular body and engaging first and second ends of said bush, and wherein said annular body and said bush are formed from high performance plastic material.

2. A protector assembly as claimed in claim 1, wherein said bearing means comprises a material adapted to provide sacrificial self-lubrication upon moving contact between said bearing means and said drill pipe.

3. A protector assembly as claimed in claim 1 wherein the annular body is shaped so as to minimize the risk of snagging within the well bore and/or to promote fluid flow around and through the protector assembly, the longitudinal ends thereof being bevelled or curved and wherein said annular body is provided with bevelled surfaces around the interior circumference thereof at each longitudinal end, the bevel angle of said surfaces being selected to match the angle of inclination of the surfaces of joints of a drill pipe upon which the assembly is intended to be installed.

4. A protector assembly as claimed in claim 3, wherein said bevel angle is selected so that said bevelled surfaces are slightly off parallel with said pipe joint surfaces.

5. A protector assembly as claimed in claim 1 therein an outer surface of said bush is provided with longitudinally extending grooves or flutes hereby drilling fluid may circulate to act as a lubricant and coolant.

6. A protector assembly as claimed in claim 1, wherein said first and second annular clamp means are adapted to restrict longitudinal movement of the annular body along the pipe string, in use, and wherein at least one of the annular body and the clamp means are provided with bearing means on the annular end surfaces thereof which are subject to contact with one another in use.

7. A protector assembly as claimed in claim 6, wherein the annular end surfaces of the annular body and the clamp means are arranged to be slightly off parallel with one another. polyphthalamides, liquid crystal polymer, acetals, polyphenylenesulfide, polyamides (nylons), polyetherketoneketone or polyetherimide.

8. A protector assembly as claimed in claim 6, wherein the clamp means are adapted to grip the drill pipe by at least one means selected from: grooves or serrations on their inner, pipe-contacting surfaces; a coating the inside diameter of the clamp with a high temperature epoxy resin, or the like, having an abrasive aggregate dispersed therein.

9. A protector assembly as claimed in claim 6, wherein said annular clamp is formed from two semi-annular sections having first and second mating end surfaces which are secure together around the drill pipe.

10. A protector assembly as claimed in claim 1, wherein said clamp means is formed from aluminium alloy, copper alloy, zinc, zinc alloy or iron alloy.

11. A protector assembly as claimed in claim 1, wherein the bearing means interposed between the annular body and the drill pipe has a clearance gap between itself and the annular body which is selected to promote thin film fluid lubrication.

12. A protector assembly as claimed in claim 11, wherein said bearing means is formed from a material selected to provide a low friction contact bearing in the event of said thin film fluid lubrication breaking down.

13. A protector assembly as claimed in claim 12, wherein said bearing material exhibits sacrificial self-lubricating properties.

14. A protector assembly as claimed in claim 1, wherein said bearing means comprises at least first and second substantially concentric bearing elements interposed between said annular body and said drill pipe.

15. A protector assembly for a pipe string movable within the bore of a well, said protector assembly comprising a generally annular body internally dimensioned to fit around said pipe string and externally dimensioned to fit within said bore, said body being formed from a first material or materials, and further comprising bearing means interposed between said annular body and said pipe string so as to permit free rotation of said pipe string relative to said annular body in the event of said annular body contacting the surface of said bore, wherein said annular body is formed from a rigid material in at least two, hingeably connected, part-annular sections each having first and second mating end surfaces which are secured together around the drill pipe, said bearing means comprising a coating of elastomeric material covering at least the inner surfaces of said part-annular sections.

16. A protector assembly for a pipe string movable within the bore of a well, said protector assembly comprising a generally annular body internally dimensioned to fit around said pipe string and externally dimensioned to fit within said bore, said body being formed from a first material or materials, and further comprising bearing means interposed between said annular body and said pipe string so as to permit free rotation of said pipe string relative to said annular body in the event of said annular body contacting the surface of said bore, wherein said annular body is formed from a rigid material in at least two, hingeably connected, part-annular sections each having first and second mating end surfaces which are secured together around the drill pipe, said bearing means comprising at least one bearing element interposed, in use, between said annular body and said pipe string and is rotatable with respect to both.

17. A protector assembly for a pipe string movable within the bore of a well, said protector assembly comprising a generally annular body internally dimensioned to fit around said pipe string and externally dimensioned to fit within said bore, said body being formed from a first material or materials, and further comprising bearing means interposed between said annular body and said pipe string so as to permit free rotation of said pipe string relative to said annular body in the event of said annular body contacting the surface of said bore, wherein the bearing means interposed between the annular body and the drill pipe has a clearance gap between itself and the drill pipe and/or between itself and the annular body which is selected to promote thin film fluid lubrication, wherein said bearing means is formed from a material selected to provide a low friction contact bearing in the event of said thin film fluid lubrication breaking down, and wherein said bearing material exhibits sacrificial self-lubricating properties. plurality of separate elements located on the surfaces of said annular body or said pipe string.

18. A protector assembly as claimed in claim 17, wherein said materials from which said one or more of the annular body and the bearing means is formed incorporate filler materials selected from: glass, carbon, PTFE, silicon, teflon, molybdenum disulphide, graphite, oil and wax.

19. A protector assembly as claimed in claim 17, wherein said annular body is formed from aluminium alloy, copper alloy, high performance plastic or phenolic resin, zinc alloy or iron alloy.

20. A protector assembly for a pipe string movable within the bore of a well, said protector assembly comprising a generally annular body internally dimensioned to fit around said pipe string and externally dimensioned to fit within said bore, said body being formed from a first material or materials, and further comprising bearing means interposed between said annular body and said pipe string so as to permit free rotation of said pipe string relative to said annular body in the event of said annular body contacting the surface of said bore, wherein said annular body is formed from a rigid material in at least two, hingeably connected part-annular sections each having first and second mating end surfaces which are secured together around the drill pipe, wherein at least one pair of mating surfaces or said sections are connected by means of complementary castallations and a pin, screw or bolt inserted into a longitudinal bore extending through the castellations, and wherein said castellations are configured to provide a hinge arrangement.

21. A protector assembly for a pipe string movable within the bore of a well, said protector assembly comprising a generally annular body internally dimensioned to fit around said pipe string and externally dimensioned to fit within said bore, said body being formed from a first material or materials, and further comprising bearing means interposed between said annular body and said pipe string so as to permit free rotation of said pipe string relative to said annular body in the event of said annular body contacting the surface of said bore, wherein the assembly further includes at least one substantially annular clamp means, adapted to be secured to said pipe string on at least one side of said annular body along the pipe string, in use, and wherein the grip of said clamp means is enhanced by means of coating the inside diameter of the clamp with a high temperature epoxy resin, or the like, having an abrasive aggregate dispersed therein.

* * * * *